US005151345A

United States Patent [19]

Hasebe

[11] Patent Number: 5,151,345

[45] Date of Patent: Sep. 29, 1992

[54] SILVER HALIDE COLOR PHOTOGRAPHIC MATERIALS

[75] Inventor: Kazunori Hasebe, Kanagawa, Japan

[73] Assignee: Fuji Photo Film Co., Ltd., Kanagawa, Japan

[21] Appl. No.: 611,639

[22] Filed: Nov. 13, 1990

[30] Foreign Application Priority Data

Nov. 14, 1989 [JP] Japan ..... 1-297218

[51] Int. Cl.[5] ..... G03C 1/80

[52] U.S. Cl. ..... 430/525; 430/271; 430/276; 430/523; 430/524; 430/531; 430/567; 430/947; 430/950

[58] Field of Search ..... 430/523, 524, 525, 531, 430/272, 275, 950, 567, 570, 271, 276, 947

[56] References Cited

U.S. PATENT DOCUMENTS 4,639,412 1/1987 LaBelle et al. ..... 430/523
4,865,962 9/1989 Hasebe et al. ..... 430/569

FOREIGN PATENT DOCUMENTS 0327768 8/1989 European Pat. Off. ..... 430/950
0387015 9/1990 European Pat. Off. ..... 430/950

*Primary Examiner*—Hoa Van Le
*Attorney, Agent, or Firm*—Sughrue, Mion, Zinn, Macpeak & Seas

[57] ABSTRACT

A silver halide color photographic material comprising a reflective support comprising a support base material coated with a waterproof resin layer, and at least one silver halide emulsion layer thereon, wherein at least one silver halide emulsion layer thereon comprises silver halide grains containing at least 90 mol % silver chloride, having a silver bromide-rich region near at least one apex of the silver halide grain, and having a mean bromide content at the surface of the grain of not more than 15 mol %, wherein the waterproof resin layer having the silver halide emulsion layer thereon contains titanium oxide in an amount of 14% or more by weight; and further the optical reflection density of the photographic material at 680 nm is not lower than 0.70.

7 Claims, No Drawings

SILVER HALIDE COLOR PHOTOGRAPHIC MATERIALS

FIELD OF THE INVENTION

This invention relates to a silver halide color photographic material having an excellent image sharpness, having a high sensitivity, and having excellent rapid processing properties. In particular, this invention relates to a color photographic paper.

BACKGROUND OF THE INVENTION

With the popularization of color photographic light-sensitive materials, the color development process has been more and more simplified and shortened. On the other hand, the requirement for images having a high quality has increased more and more.

In such circumstances, photographic light-sensitive materials for color prints, have been investigated to improve their color reproducibility and tone reproducibility, to shorten the processing time, and to improve the sharpness.

It has been recently found that a high silver chloride emulsion is preferred as a silver halide emulsion for quick processing and such a technique has been widely employed.

In regard to image quality, particularly from the viewpoint of improving on image sharpness, a method of using dyes for preventing irradiation has been proposed.

For example, dye improvements are described in JP-A-50-145125, JP-A-52-20830, JP-A-50-147712, JP-A-59-111641, JP-A-61-148448, JP-A-61-151538, JP-A-61-151649, JP-A-61-151650, JP-A-61-151651, JP-A-61-170742, JP-A-61-175638, JP-A-61-235837, JP-A-61-248044, JP-A-62-164043, JP-A-62-253145, JP-A-62-253146, JP-A-62-253142, JP-A-62-275262, and JP-A-62-283336 (the term "JP-A" as used herein means an "unexamined published Japanese patent application"), *Research Disclosure (RD)*, No. 17643, page 22 (Dec., 1978), and ibid, No. 18716,page 647 (Nov., 1979).

Also, a method of forming an antihalation layer (AH) in a color photographic light-sensitive material for the same purpose is described, for example, in U.S. Pat. Nos. 2,326,057, 2,882,156, 2,839,401, and 3,706,563, JP-A-55-33172, JP-A-59-193447 and JP-A-62-32448.

JP-A-63-286849 also describes that the optical reflection density on use of the above-described diffusible dyes or coloring agents for AH is increased over a certain density.

However, when the optical reflection density is increased, the sensitivity is greatly decreased with the improvement of the sharpness. Hence it is difficult to improve sharpness while maintaining a sufficient practical sensitivity using only the above-described means.

Also, to increase the reflection density it is necessary to use a large amount of dye(s) but the use of a large amount of dye results in a softening the gradation, which is one of the reasons why a practical high reflection density is not obtained.

The method of forming AH requires an addition of one new layer to the conventional layer structure, which undesirably increases the difficulty in the production of the photographic light-sensitive material.

To solving these problems, improvement in supports has been investigated.

A baryta-coated paper has hitherto been used as a support for light-sensitive materials for color prints but recently for shortening the photographic processing time, a waterproof or resin-coated paper formed by coating polyethylene on both surfaces of a base paper has been used. In this case, to maintain the sharpness of the print image on the waterproof paper at the level of sharpness on a baryta-coated paper, titanium oxide or zinc oxide is dispersed in the polyethylene layer but the sharpness is still inferior to that achieved presently in using a baryta-coated paper. Improvement in the polyethylene layer containing titanium oxide for the above-described purpose is described, e.g., in JP-B-58-43734 (the term "JP-B" as used herein means an "examined Japanese patent application"), JP-A-58-17433, JP-A-58-14830, and JP-A-61-259246.

Also, a method of coating a coating composition containing an unsaturated organic compound having one or more double bonds in the same molecule and polymerizable by electron rays and a white pigment on a base paper and hardening the layer by applying electron rays while heating to form a waterproof resin layer or layers on the base paper is described in JP-A-57-27257, JP-A-57-49946, JP-A-61-262738, and JP-A-62-61049.

A silver halide photographic material using a mirror plane reflective or secondary diffusion reflective support is described, e.g., in JP-A-63-24251 and JP-A-63-24253.

However, by improvement only of a support, the increase in improvement in sharpness is still insufficient and development of additional improvements is required.

SUMMARY OF THE INVENTION

An object of this invention is to provide a silver halide color photographic material, in particular, a color photographic paper having excellent image sharpness, having a high sensitivity,, and having excellent rapid development processing characteristics.

More particularly, an object of this invention is to provide a silver halide emulsion having a sufficiently high sensitivity even in using a large amount of a dye and not resulting in a softening of gradation, thereby the aforesaid technique of improving the sharpness can be achieved.

A further object of this invention is to further increase the sharpness of images usually observable by defining the balance of the sharpness of each of a cyan coloring layer, a magenta coloring layer, and a yellow coloring layer.

It has now been discovered that the above-described objects are attained by an improvement in the support used and the silver halide emulsion coated thereon and prescribing a preferred reflection density.

That is, the present invention provides:

(1) A silver halide color photographic material having at least one silver halide emulsion layer on a reflective support comprising a support base material coated with a waterproof resin, wherein at least one of said silver halide emulsion layers thereon comprises silver halide grains having at least 90 mol % silver chloride, having a silver bromide-rich region near at least one grain apex of the silver halide grains, and having a mean silver bromide content at the surface of the grains of not more than 15 mol %; the waterproof resin layer on which the silver halide emulsion layer is formed contains titanium oxide in an amount of not lower than 14% by weight based on the total weight of the waterproof resin and white pigment including titanium oxide; and further the optical reflection density of the photographic material at 680 n.m. is not lower than 0.70.

(2) A silver halide color photographic material in (1) above, wherein the optical reflection density of the silver halide color photographic material at 550 n.m. is lower than the optical reflection density thereof at 680 n.m.

(3) A silver halide color photographic material as in (1) or (2) above, wherein the optical reflection density of the silver halide color photographic material at 470 n.m. is not lower than 0.20.

(4) A silver halide color photographic material as in (1), (2), or (3) above, wherein the silver bromide-rich region and/or another region of the silver halide grains used for the silver halide color photographic material contains an iridium compound.

(5) A silver halide color photographic material having at least one silver halide emulsion layer on a reflective support having the diffusion reflectivity of second kind, wherein at least one of the silver halide emulson layers comprises silver halide grains comprising at least 90 mol % silver chloride, having a silver bromide rich region near at least one apex of the silver halide grain, and having a mean silver bromide content at the surface of the grains of not higher than 15 mol %; and the optical reflection density of the photographic material at 680 n.m. is not lower than 0.70.

In this invention, the term "near the apex" means within the area of the regular square having a length of preferably about ⅓ (more preferably about 1/5) of the diameter of a circle having the same area as the projected area of cubic or substantially cubic regular crystal silver chlorobromide grains as one side and having the apex (the cross point of a cubic or substantially cubic regular crystal grain) as one corner thereof. The content of the silver chlorobromide grains having the silver bromide-rich region according to this invention is preferably not lower than 70 mol % of the amount of the total silver halide grains.

DETAILED DESCRIPTION OF THE INVENTION

Preferred methods of producing the silver halide emulsions for the silver halide color photographic materials of this invention are explained in detail below.

(1) The host silver halide crystals for producing the silver halide emulsion for use in this invention are cubic or tetradecahedral crystal grains substantially having a (100) planes (these crystals may have roundish corners and further a higher order plane) and the halogen composition thereof is silver chlorobromide containing at least 90 mol % silver chloride and not more than 2 mol % silver iodide or silver chloride containing no silver bromide, and preferably is silver halide containing at least 95 mol %, more particularly at least 99 mol % silver chloride or pure silver chloride. The mean grain size of the host silver halide grains is preferably from 0.2 μm to 2 μm and the grain size distribution thereof is preferably monodisperse.

The monodisperse silver halide emulsion for use in this invention is a silver halide emulsion having a grain size distribution with a variation coefficient ($S/\bar{r}$) of the grain sizes of the silver halide grains of at least 0.25, wherein $\bar{r}$ is the mean grain size and S is the standard deviation of the grain sizes. That is if the grain size of each silver halide grain is $r_i$ and the number of the grains is $n_i$, the mean grain size $\bar{r}$ is defined as follows:

$$r = \frac{\Sigma n_i \cdot r_i}{\Sigma n_i}$$

and the standard deviation S is defined as follows.

$$S = \sqrt{\frac{\Sigma (r - r_i)^2 \cdot n_i}{\Sigma n_i}}$$

The grain size in this invention is the diameter corresponding to the projected area corresponding to the area projected in the case of microphotographing by the method (usually using an electromicroscope) well known in the field as described in T. J. James et al, *The Theory of the Photographic Process,* 3rd Edition, pages 34–36, published by MacMillan Co., 1966. In this case, the projection-corresponding diameter of the silver halide grain is defined as the diameter of a circle having an area equal to the projected area of the silver halide grain as described in the James et al.

Accordingly, when the form of the silver halide grains is other than a sphere (e.g., a cubic form, an octahedral form, a tetradecahedral form, a tabular form, a potato-like form, etc.), the mean grain size $\bar{r}$ and the standard deviation S thereof can be determined as above.

The coefficient of variation in regard to the grain sizes of silver halide grains is 0.25 or less, preferably 0.20 or less, more preferably 0.15 or less, and most preferably 0.10 or less.

(2) Then, bromide ion or high-silver bromide fine grains are supplied to the above-described host silver halide grains to deposit a new silver halide phase enriched with silver bromide on the surface of the host silver halide grains. In supplying bromine ion, this step proceeds as a so-called "halogen conversion" by a halogen ion exchange reaction at the surface of the host silver halide grains. In supplying high-silver bromide fine grains, the step proceeds by a "recrystallization" reaction of forming crystals having a more stable composition between the host silver halide grains and the high-silver bromide fine grains and this step is different from the above-described conversion reaction. In such a recrystallization reaction, the driving force for the reaction is the increase of entropy and the reaction is completely different from Ostwald ripening. This is described, e.g., in H. C. Yutzy, *Journal of American Chemical Society,* 59, 916 (1937).

It is quite surprising that in spite of the fact that the above-described two steps are two reactions which are utterly different from each other, both reactions select the vicinity of the apex of the host silver halide grains as the position of forming the new phase more enriched with silver bromide.

(3) The object of this invention in obtaining a very high sensitivity by the concentration of latent images or development centers can be more effectively achieved by using a compound (CR compound) capable of controlling or inhibiting the initiation of the halogen conversion.

A CR compound is a compound having the function of delaying or completely inhibiting the initiation of halogen conversion and recrystallization by selectively adsorbing on specific crystal planes as compared to the case of the compound not being adsorbed on the planes and in particular, in this invention, a CR compound is a material adsorbing mainly (selectively) on the (100) plane of the silver halide grains to inhibit the initiation of the conversion and recrystallization on the (100) plane.

Suitable CR compounds which can be used in this invention, are cyanine dyes, merocyanine dyes, mercaptoazoles (specific examples thereof being the compounds shown by formulae (XXI), (XXII), and (XXIII) described in detail in European Patent EP 0273,430), and nucleic acid decomposition products (e.g., the products formed during decomposition of, e.g., deoxyribonucleic acid or ribonucleic acid, adenine, guanine, uracyl, cytosine, and thymine), but the compounds represented by following formulae (Is), (IIs), and (IIIs) are particularly preferred in this invention.

A specific example of the alkenyl group is vinylmethyl and specific examples of the aralkyl group are benzyl and phenethyl.

In formula (Is), $m_{101}$ represents a number of from 0 to 3 and when $m_{101}$ is 1, $R_{103}$ represents a hydrogen atom, a lower alkyl group, an aralkyl group, or an aryl group.

Specific examples of aryl groups are a substituted phenyl group and an unsubstituted phenyl group.

In the above formula, $R_{104}$ represents a hydrogen atom. When $m_{101}$ is 2 or 3, $R_{103}$ represents a hydrogen atom and $R_{104}$ represents a hydrogen atom, a lower alkyl group having from 1 to 4 carbon atoms or an aralkyl group, and this group may combine with $R_{102}$ to form a 5- or 6-membered ring. Also, when $m_{101}$ represents 2 or 3 and $R_{104}$ represents a hydrogen atom, $R_{103}$ may combine with another $R_{103}$ to form a hydrocarbon (Is)

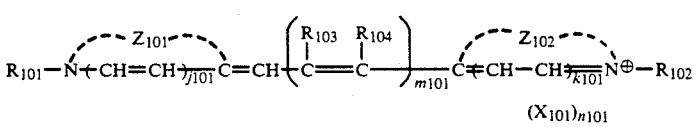

wherein $Z_{101}$ and $Z_{102}$ each represents an atomic group necessary for forming a heterocyclic nucleus.

Examples of a heterocyclic nucleus include a 5- or 6-membered cyclic nucleus (the ring may have bonded thereto a condensed ring or further may have be substituted) containing one or more of a nitrogen atom, a sulfur atom, an oxygen atom, a selenium atom or a tellurium atom as a hetero atom is preferred.

Specific examples of the above-described heterocyclic nucleus are a thiazole nucleus, a benzothiazole nucleus, a naphthothiazole nucleus, a selenazole nucleus, a benzoselenazole nucleus, a naphthoselenazole nucleus, an oxazole nucleus, a benzoxazole nucleus, a naphthoxazole nucleus, an imidazole nucleus, a benzimidazole nucleus, a naphthimidazole nucleus, a 4-quinoline nucleus, a pyrroline nucleus, a pyridine nucleus, a tetrazole nucleus, an indolenine nucleus, a benzindolenine nucleus, an indole nucleus, a tellurazole nucleus, a benzotellurazole nucleus, and a naphthotellurazole nucleus.

In formula (Is), $R_{101}$ and $R_{102}$ each represents an alkyl group, an alkenyl group, an alkynyl group, or an aralkyl group. In this invention, the above-described groups and the groups described below include substituted groups as well. For example, the alkyl group includes an unsubstituted alkyl group and a substituted alkyl group, the group may be a straight chain, branched or cyclic alkyl group and number of the carbon atoms of the alkyl group is preferably from 1 to 8.

Specific examples of substituents for the substituted alkyl group are a halogen atom (e.g., chlorine, bromine, and fluorine), a cyano group, an alkoxy group, a substituted or unsubstituted amino group, a carboxylic acid group, a sulfonic acid group, and a hydroxy group. The alkyl group may have one or more substituents.

ring or a heterocyclic ring and these rings are preferably 5- or 6-membered rings.

In formula (Is), $j_{101}$ and $k_{101}$ each represents 0 or 1, $X_{101}$ represents an acid anion; and $n_{101}$ represents 0 or 1.

(IIs)

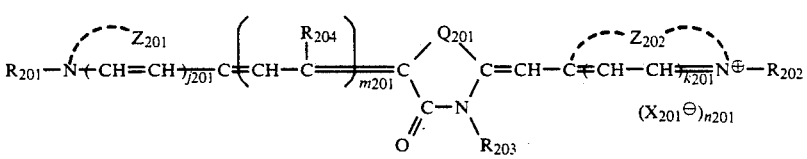

wherein $Z_{201}$ and $Z_{202}$ have the same meaning as $Z_{101}$ and $Z_{102}$; $R_{201}$ and $R_{202}$ have the same meaning as $R_{101}$ and $R_{102}$; $R_{203}$ represents an alkyl group, an alkenyl group, an alkynyl group or an aryl group (e.g., a substituted or unsubstituted phenyl group); $m_{201}$ represents 0, 1, or 2; and $R_{204}$ represents a hydrogen atom, a lower alkyl group, or an aryl group, and when $m_{201}$ represents 2, the $R_{204}$ may combine with the other $R_{204}$ to form a carbocylic ring or a heterocyclic ring, which is preferably a 5- or 6-membered ring.

In formula (IIs), $Q_{201}$ represents a sulfur atom, an oxygen atom, a selenium atom, or

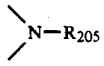

(wherein $R_{205}$ has the same meaning as $R_{203}$) and $j_{201}$, $k_{201}$, $X^{\ominus}_{201}$, and $n_{201}$ have the same meaning as $j_{101}$, $k_{101}$, $X^{\ominus}_{101}$, and $n_{101}$ described above.

(IIIs)

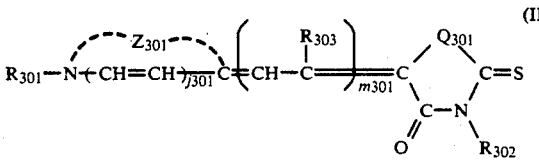

wherein $Z_{301}$ represents an atomic group necessary for forming a heterocyclic ring and examples of the heterocyclic ring are those described above for $Z_{101}$ and $Z_{102}$ and also a thiazolidine nucleus, a thiazoline nucleus, a benzothiazoline nucleus, a naphthothiazoline, a selenazolidine nucleus, a selenazoline nucleus, a benzoselenazoline nucleus, a naphthoselenazoline nucleus, a benzoxazoline nucleus, a naphthoxazoline nucleus, a dihydropyridine nucleus, a dihydroquinoline nucleus, a benzimidazoline nucleus, and a naphthimidazoline nucleus.

In formula (IIIs), $Q_{301}$ has the same meaning as $Q_{201}$; $R_{301}$ has the same meaning as $R_{101}$ or $R_{102}$; $R_{302}$ has the same meaning as $R_{203}$; $m_{301}$ has the same meaning as $m_{201}$; $R_{303}$ has the same meaning as $R_{204}$, when $m_{301}$ is 2 or 3, $R_{303}$ may combine with another $R_{303}$ to form a carbocyclic ring or a heterocyclic ring; and $j_{301}$ has the same meaning as $j_{101}$.

The CR compound increases the selectivity of the location initially forming a new phase more enriched with silver bromide than the host silver halide grains and also prevents this new phase initially formed from converting the entire surface of the host silver halide grains into a uniform new layer by further repeating recrystallization with the surface of the host grains, and accelerates the formation and maintenance of this "new phase more enriched with silver bromide" epitaxially grown at the vicinity of the apex of the host grains. Furthermore, it is astonishing that by the formation of the new phase formed at a limited location, a very high sensitization is achieved, which is an object of this invention.

The above-described high sensitization in this invention, at the same time, tends to result in a pressure desensitization. Pressure desensitization is the phenomenon that when a pressure is applied to a photographic light-sensitive material before light-exposure, the sensitivity of the pressed area is reduced and the silver bromide content in the new phase is more enriched in silver bromide than the host silver halide grains, this phenomenon tends to increase. Thus, the silver bromide content of the phase is higher than that of the host grain and is preferably 90 mol % or less, and more preferably 60 mol % or less.

The silver halide grains in this invention contain at least 90% silver chloride as a mean value in the grains and has a new epitaxially grown phase enriched with silver bromide as compared with the host silver halide grain near the apexes of the host grains, and may have a slowly changing region of halogen composition between the new phase and the host grain.

Such a structure of the silver halide grains can be observed using various analytical techniquess.

First, by observation of an electron microscope, a change in the form of the grains is observed in that a new phase is junctioned near the apex of the grain.

Also, the halogen composition of the host silver halide grains and the new phases can be determined by an X-ray diffraction method.

The halogen composition of the surface of silver halide grains can be measured by an XPS (X-ray Photoelectron Spectroscopy) method using, for example, an ESCA 750 type spectrometer made by Shimazu-du Pont K.K. The details of these measurement methods are described in Someno & Amoi, *Hyoomen Bunseki (Surface Analysis)*, published by Koodan Sha K.K., 1977.

By knowing the halogen compositions of the host silver halide grains and new phases formed using X-ray diffraction and by knowing the mean silver halide composition of the surface of the grains, the extent of the new phases enriched with silver bromide accounting for the total surfaces can be substantially determined.

Also, the existing position of the new phases more enriched with silver bromide than the host silver halide grains and measurment of the extent which the phases near the apexes of the grains occupy can be measured by an EDX (Energy Dispersive X-ray analysis) method using an EDX spectrometer equipped with a transmission type electron microscope as a method other than the above-described electronmicroscopic observation. This method is described in Takayoshi Soejima, *Denshisen (Electron Ray) Microanalysis)*, published by Nikkan Kogyo Shinbun Sha, 1987.

The new phase in this invention is preferably locally disposed near the apex of host silver halide grain and also in terms of the mean halogen composition of the surface of the host silver grain, the content of silver bromide is preferably 15 mol % or less, and more preferably 10 mol % or less. If the mean silver bromide content is high at the surface, the localization degree of the new phases near the apexes of the host silver halide grains is reduced and also, in this case, the sensitivity of the silver halide grains is reduced.

For the new phases formed by a preferred production method of this invention, electron microscopy shows that the phase has a which is epitaxially joined to a corner of the host silver halide grain and which has grown there.

The preferred mean grain size of the silver halide grains of the fine grain high-silver bromide emulsion used for forming the new phases enriched with silver bromide in this invention depends upon the grain sizes and the halogen composition of the host grains but is usually 0.3 μm or less, and more preferably 0.1 μm or less.

It is necessary for the halogen composition of the fine grain high-silver bromide emulsion to have a higher silver bromide content than that of the host silver halide grains and the emulsion contains silver bromide of preferably at least 50 mol %, and more preferably at least 70 mol %.

The fine grain high-silver bromide emulsion can, if necessary, contain silver iodide. Also, as the case may be, the emulsion may contain ions or a compound of a noble metal such as iridium, rhodium, platinum, etc.

The fine grain high-silver bromide emulsion is mixed with the host silver halide grains in the range of from 0.1 mol % to 50 mol %, preferably from 0.2 to 20 mol %, and more preferably from 0.2 to 8 mol % to the host silver halide grains. The mixing temperature can be freely selected in the range of from 30° C. to 80° C.

In the silver chloride emulsion for use in this invention, the latent images or development centers are concentrated, a very high sensitivity is obtained, the stability is greatly improved, and an excellent safety can be obtained while restraining the formation of fog and without spoiling rapid developability. Also, it is astonishing that a high-contrast emulsion is obtained, the occurrence of pressure desensitization is reduced, and the formation of fog at the unexposed portions is less.

The CR compound for use in this invention can be selected from sensitizing dyes. The CR compound useful for the (100) planes is particularly selected from the compounds represented by the above-described formulae (Is), (IIs), and (IIIs) and also can function as a sensitizing dye. Thus, the CR compound is useful for acheiving high spectral sensitivity and in particular, the spectral sensitivity can be further stabilized by the partial recrystallization of the surface of the silver halide grains. The discovery of such an excellent combination of effects is astonishing.

Furthermore, to increase high sensitization and stabilization even further, the CR compound may be combined with other sensitizing dyes or super color sensitizing dyes.

For example, an aminostilbene compound substituted by a nitrogen-containing heterocyclic nucleus group [e.g., a compound of general formula (I), and in particular Compounds (I-1) to (I-17) as described in JP-A-62-174738 (the term "JP-A" as used herein means an "unexamined published Japanese patent application") and the compounds described in U.S. Pat. Nos. 2,933,390 and 3,635,721], aromatic organic acid-formaldehyde condensation products (e.g., the compounds described in U.S. Pat. No. 3,743,510), cadmium salts, azaindene compounds, may be used in combination. Also, the combinations described in U.S. Pat. Nos. 3,615,613, 3,615,641, 3,617,295 and 3,635,721 are particularly useful.

Specific examples of CR compounds represented by the above-described formulae (Is), (IIs), and ((IIIs) are compounds (CR-1) to (CR-55) described in European Patent EP 0273,430.

The high-silver chloride grains having the silver bromide-rich phases for use in this invention can contain an iridium compound in an amount of from $10^{-8}$ mol to $10^{-5}$ mol per mol of silver whereby the effect of this invention can be increased even further.

The feature of the support for use in this invention is in that fine particles of titanium oxide are dispersed in a waterproof resin layer in an amount of at least 14% by weight, and preferably from 15% by weight to about 60% by weight based on the weight of the resin and white pigment including titanium oxide. It is preferable that the surface of the fine particles of the titanium oxide pigment be treated with an inorganic oxide such as silica, aluminum oxide, etc., and/or a dihydric to tetrahydric alcohol such as 2,4-dihydroxy-2-methylpentane, trimethylolethane, etc., described in JP-A-58-17151. The thickness of the waterproof resin layer containing the fine particles of titanium oxide is from 2 to 200 μm, and preferably from 5 to 80 μm. In this case, the waterproof resin layer containing fine particles of titanium oxide in this invention may be used with other waterproof resin layer(s) containing other white pigment at a different content or not containing a white pigment.

In this case, it is preferred for the waterproof resin layer to contain fine particles of titanium oxide in this invention disposed as a layer farthest from the support.

The variation coefficient of occupied area ratio(%) of fine pigment particles is 0.20 or less, preferably 0.15 or less and more preferably 0.10 or less.

The dispersibility of the fine particles of titanium oxide in the waterproof resin layer can be evaluated by the variation coefficient of the occupied area ratio (%) obtained from photograph of the occupied area which is obtained by removing the resin at the surface of the resin or to a thickness of about 0.1 μm, and preferably about 500 Å by ion sputtering by glow discharging and observing the exposed fine particles of the pigment with an electron microscope. The ion sputtering method is described in detail in Yooichi Murayama and Kunihiro Kashiwagi, *Surface Treatment Technique Using Plasma, Kikai no Kenkyu (Study of Machine),* Vol. 33, No. 6 (1981).

For controlling the variation coefficient of the fine particles of the white pigment to 0.20 or less, it is preferred to sufficiently knead the white pigment in the presence of a surface active agent and also it is preferred to use pigment particles surface-treated with a dihydric to tetrahydric alcohol as described above.

The occupied are a ratio (%) of fine particles of the white pigment per unit area defined above can be most typically obtained by dividing the observed area into adjacent unit areas each having a unit area of 6 μm×6 μm and measuring the occupied area ratio (%) (Ri) of the fine particles projected in the unit area. Also, the coefficient of occupied area ratios (%) can be obtained by the ratio of $s/\overline{R}$, i.e., the ratio of the standard deviation s of Ri to the mean value ($\overline{R}$) of Ri. The number (n) of unit area measured is preferably 6 or more.

Thus, the coefficient of variation $s/\overline{R}$ can be obtained by the following:

$$\sqrt{\frac{\sum_{i=1}^{n}(Ri-R)^2}{n-1}} \Big/ \frac{\sum_{i=1}^{n} Ri}{n}$$

The waterproof resin layer may contain, in addition to titanium oxide, other white pigments such as barium sulfate, calcium sulfate, silicon oxide, zinc oxide, titanium phosphate, aluminum oxide, etc.

The white support which is used for the silver halide color photographic material of this invention is composed of a base material coated with a waterproof resin layer. Examples of the base material, include base papers obtained from natural pulp, synthetic pulp, or a mixture thereof; polyester films such as polyethylene terephthalate films, polybutylene phthalate films, etc.; cellulose triacetate films; and synthetic resin films such as polystyrene films, polypropylene films, polyolefin films, etc.

The base paper for use in this invention is selected from materials generally used for photographic papers. More specifically, a natural pulp selected from a needle-leaved tree pulp, a broadleaf tree pulp, etc., as the main raw material containing, if desired, a pigment such as clay, talc, calcium carbonate, urea resin fine particles, etc., a size such as rosin, an alkylketene dimer, a higher fatty acid, paraffin wax, an alkenylsuccinic acid, etc., a paper strength increasing agent such as polyacrylamide, etc., and a fixing agent such as aluminum sulfate, a cationic polymer, etc., can be used.

In particular, a neutral paper using an alkylketene dimer, an alkenylsuccinic acid, etc., and having a pH of from 5 to 7 (measured using a pH meter employing GST-5313F as a planar electrode, made by Tooa Denpa Kogyo K.K.) is particularly preferred. Furthermore, a synthetic pulp may be used in place of the above-described natural pulp or a mixture of a natural pulp and a synthetic pulp can be used.

The surface of the pulp paper can be subjected to a surface sizing treatment with a film-forming polymer such as gelatin, starch, carboxymethyl cellulose, polyacrylamide, modified polyvinyl alcohol, etc. In this case, the modified polyvinyl alcohol can be a carboxy group-modified polymer, a silanol-modified polymer, a copolymer of polyvinyl alcohol and acrylamide, etc.

Also, the coating amount of the film-forming polymer where the paper is surface sized with the film-forming polymer is from 0.1 to 5.0 g/m$^2$, and preferably from 0.5 to 2.0 g/m$^2$. Furthermore, the film-forming polymer may contain, if desired, an antistatic agent, an optical whitening agent, a pigment, a defoaming agent, etc.

Also, the base paper can be manufactured from a pulp slurry containing the above-described pulp and, if desired, additives such as a pigment, a size, a paper strength increasing agent, a fixing agent, etc., using a paper manufacturing machine such as a Fourdrinier paper machine, etc., dried, and rolled. Before or after drying, the paper is subjected to the surface sizing treatment and between the drying and rolling, the paper is subjected to a calendering treatment. When the surface sizing treatment is carried out after drying, the calender treatment can be conducted before or after the surface sizing treatment.

Whether or not the base paper used as the base material for the support in this invention is a neutral paper can be determined by measuring the pH value thereof using a planar electrode GST-5313F made by Tooa Denpa Kogyo K.K. The pH value of the neutral paper is at least 5, and preferably from 5 to 9.

Also, when the waterproof resin layer in this invention is formed from a vinyl chloride resin, the resin itself may constitute the support.

The waterproof resin for use in this invention is a resin having a water absorption of 0.5% or less by weight, and preferably 0.1% or less by weight. Examples of suitable resin are a polyolefin (e.g., polyethylene, polypropylene, and a copolymer thereof), a vinyl polymer or copolymer (e.g., polystyrene, polyacrylate, and a copolymer thereof), and apolyester and copolymers thereof. A polyolefin resin is preferred, and low-density polyethylene, high-density polyethylene, polypropylene, or a blend thereof is preferably used. If desired, an optical whitening agent, an antioxidant, an antistatic agent, a releasing agent, etc., are added to the resin.

Furthermore, unsaturated compounds having at least one polymerizable carbon-carbon double bond in the same molecule, such as methacrylic acid ester compounds as described in JP-A-57-27257, JP-A-57-49946, and JP-A-61-262738 and di-, tri- or tetra-acrylic acid ester shown by the general formula described in JP-A-61-262738 can be also used. In this case, after coating the resin on the base material, the resin layer is hardened by irradiation with electron rays to form a waterproof resin layer. Titanium oxide or other white pigments are dispersed in the unsaturated organic compound. Also, other resins can be mixed or dispersed in the compound.

Methods of coating the waterproof resin layer in this invention include a lamination method, such as a dry lamination method and a non-solvent type dry lamination method described in *New Lamination Working Handbook,* edited by Kakoo Gijutsu Kenkyu Kai (1983). Also, for coating, a gravure roll coating method, a wire bar coating method, a doctor blade coating method, a reverse roll coating method, a dip coating method, an air knife coating method, a calender coating method, a kiss coating method, a squeeze coating method, a coating type coating method, etc., can be selectively used.

The surface of the support is preferably subjected to a corona discharging treatment, a glow discharging treatment, or a flame treatment and then protective colloid layers for the silver halide color photographic materials are formed on the support.

The total thickness of the support is preferably from 30 to 350 g/m$^2$ (about 30 to 400 $\mu$m), and more preferably from about 50 to 200 g/m$^2$.

The optical reflection density in this invention is measured using a reflection densitometer generally used in the field and can be determined as follows.

A standard reflection plate is disposed at the back surface of the same during measurement, whereby the measurement error by light transmitting of the sample is prevented.

$$\text{Optical reflection Density} = \log_{10}(Fo/F)$$

Fo: Reflected luminous flux of a standard white plate

F: Reflected luminous flux of the sample

It is necessary that the required optical reflection density in this invention be at least 0.70, preferably from 0.7 to 2.0, more preferably from 0.8 to 1.9, and most preferably from 1.0 to 1.8.

Also, the ratio of the optical reflection density at 550 n.m. to that at 680 n.m. is preferably 1 or less, preferably 0.8 or less, more preferably 0.6 or less, and most preferably from 0.5 to 0.2. Furthermore, the optical reflection density at 470 n.m. is preferably at least 0.2, and more preferably at least 0.3.

To obtain the optical reflection density in this invention, the amount of the following dye(s) added can be adjusted. These dyes may be used alone or as a combination thereof. Also, there is no particular restriction on the layer(s) containing the dye, and the dye(s) can be added to a layer between the support and the lowermost light-sensitive emulsion layer, light-sensitive emulsion layer(s), interlayer(s), protective layer, or a layer between the uppermost light-sensitive emulsion layer and the protective layer.

The dyes for achieving this purpose are selected from dyes which do not substantially spectrally sensitize silver halide.

Conventional methods can be used to add these dyes and, for example, the dyes can be added as a solution in water or in an alcohol such as methanol, etc.

As to the amount of the dye added, the following coating amount can be employed as a standard.

Cyan Dye: 20 mg/m$^2$ to 100 g/m$^2$ (most preferred amount)

Magenta Dye: 0 to 50 mg/m$^2$ (preferred amount) 0 to 10 mg/m$^2$ (most preferred amount)

Yellow Dye: 0 to 30 mg/m$^2$ (preferred amount) 5 to 20 mg/m$^2$ (most preferred amount)

In this case, a method of incorporating the dye being added to a layer in a form diffusing throughout the entire layer during the time from coating the light-sensitive layers to drying is more preferred than a method of fixing the dye in a specific layer from the standpoint of increasing the effect of this invention and preventing an increase in the production cost due to the necessity to form a specific layer containing the dye.

Examples of dyes which can be used for the above-described purpose are oxonol dyes having a pyrazolone nucleus or a barbituric acid nucleus described in British Patents 506,385, 1,177,429, 1,311,884, 1,338,799, 1,385,371, 1,467,214, 1,433,102, and 1,553,516, JP-A-48-85130, JP-A-49-114420, JP-A-52-117123, JP-A-55-161233, and JP-A-59-111640, JP-B-39-22069, JP-B-43-13168, JP-B-62-23527 (the term "JP-B" as used herein means an "examined published Japanese patent application"), U.S. Pat. Nos. 3,247,127, 3,469,985, and 4,078,933; other oxonol dyes described in U.S. Pat. Nos. 2,533,472, and 3,379,533, British Patent 1,278,621; azo dyes described in British Patents 575,691, 680,631, 599,623, 786,907, 907,125, and 1,045,609, U.S. Pat. No. 4,255,326, JP-A-59-211043; azomethine dyes described in JP-A-50-100116 and JP-A-54-118247, British Patents 2,014,598 and 750,031; anthraquinone dyes described in U.S. Pat. No. 2,865,752; arylidene dyes described in U.S. Pat. Nos. 2,538,009, 2,688,541 and 2,538,008, British Patents 584,609 and 1,210,252, JP-A-50-40625, JP-A-51-3623, JP-A-51-10927, and JP-A-54-118,247, JP-B-48-3286 and JP-B-59-37303; styryl dyes described in JP-B-28-3082, JP-B-44-16594, and JP-B-59-28898; triarylmethane dyes described in British Patents 446,583 and 1,335,422, JP-A-59-228250; merocyanine dyes described in British Patents 1,075,653, 1,153,341, 1,284,730, 1,475,228, and 1,542,807; and cyanine dyes described in U.S. Pat. Nos. 2,843,486 and 3,294,539.

Of these dyes, dyes which are particularly preferably used in this invention are dyes represented by following formula (I), (II), (III), (IV), (V), or (VI).

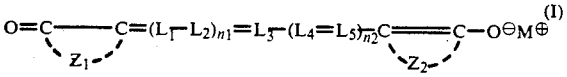

(I)

wherein $Z_1$ and $Z_2$, which may be the same or different, each represents a non-metal atomic group necessary for forming a heterocyclic ring; $L_1$, $L_2$, $L_3$, $L_4$, and $L_5$ each represents a methine group; $n_1$ and $n_2$ each represents 0 or 1; and $M^+$ represents a hydrogen atom or a monovalent cation.

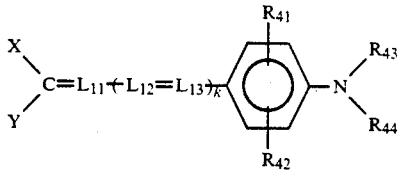

(II)

wherein X and Y, which may be the same or different, each represents an electron attracting group, X and Y may combine with each other to form a ring; $R_{41}$ and $R_{42}$, which may be the same or different, each represents a hydrogen atom, a halogen atom, an alkyl group, an alkoxy group, a hydroxy group, a carboxy group, a substituted amino group, a carbamoyl group, a sulfamoyl group, an alkoxycarbonyl group, or a sulfo group; $R_{43}$ and $R_{44}$, which may be the same or different, each represents a hydrogen atom, an alkyl group, an alkenyl group, an aryl group, an acyl group, or a sulfonyl group, $R_{43}$ and $R_{44}$ may combine with each other to form a 5- or 6-membered ring, and $R_{41}$ and $R_{43}$ or $R_{42}$ and $R_{44}$ each may combine with each other to form a 5- or 6-membered ring; at least one of X, Y, $R_{41}$, $R_{42}$, $R_{43}$, and $R_{44}$ has a sulfo group or a carboxy group as a substituent; $L_{11}$, $L_{12}$, and $L_{13}$ each represents a methine group; and k represents 0 or 1.

$Ar_1—N=N—Ar_2$ (III)

(wherein $Ar_1$ and $Ar_2$, which may be the same or different, each represents an aryl group or a heterocyclic group.

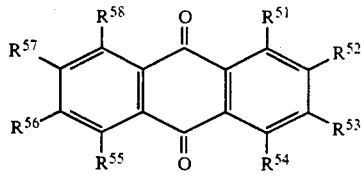

(IV)

wherein $R^{51}$, $R^{54}$, $R^{55}$, and $R^{58}$, Which may be the same or different, each represents a hydrogen atom, a hydroxy group, an alkoxy group, an aryloxy group, a carbamoyl group, or an amino group shown by

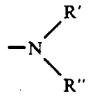

(wherein R' and R'', which may be the same or different, each represents a hydrogen atom, an alkyl group having at least one sulfonic acid group or carboxy group, an aryl group having at least one sulfonic acid group or carboxy group); and $R^{52}$, $R^{53}$, $R^{56}$, and $R^{57}$, which may be the same or the different, each represents a hydrogen atom, a sulfonic acid group, a carboxy group, an alkyl group having at least one sulfonic acid group or carboxy group, or an aryl group having at least one sulfonic acid group or carboxy group.

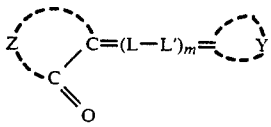

(V)

wherein L and L' each represents a substituted or unsubstituted methine group or a nitrogen atom; m represents an integer of from 0 to 3; Z represents a non-metallic atomic group necessary for forming a pyrazolone nucleus, a hydroxypyridone nucleus, a barbituric acid nucleus, a thiobarbituric acid nucleus, a dimedone nucleus, an indane-1,3-dione nucleus, a rhodanine nucleus, a thiohydantoin nucleus, an oxazolidin-4-one-2-thione nucleus, a homophthalimido nucleus, a pyrimidine-2,4-dione nucleus, or a 1,2,3,4-tetrahydroquinoline-2,4-dione nucleus; and Y represents a non-metallic atomic group necessary for forming an oxazole nucleus, a benzoxazole nucleus, a naphthoxazole nucleus, a thiazole nucleus, a benzothiazole nucleus, a naphthothiazole nucleus, a benzoselenazole nucleus, a pyridine nucleus, a quinoline nucleus, a benzoimidazole nucleus, a naphthimidazole nucleus, an imidazoquinoxaline nucleus, an indolenine nucleus, an isooxazole nucleus, a benzisooxazole nucleus, a naphthisooxazole nucleus, or an acridine nucleus, Z and Y each may further be substituted.

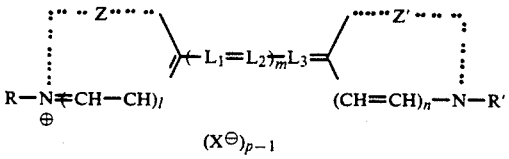

(A)

or

-continued

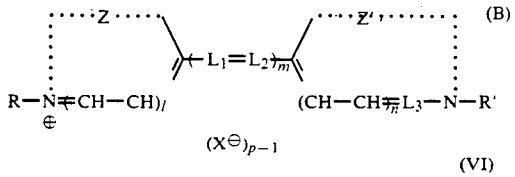

(VI)

wherein R and R', which may be the same or different each represents a substituted or unsubstituted alkyl group; $L_1$, $L_2$, and $L_3$, which may be the same or different, each represents a substituted or unsubstituted methine group; m represents an integer of from 0 to 3; Z and Z', which may be the same or different, each represents a non-metallic atomic group necessary for forming a substituted or unsubstituted 5- or 6-membered heterocyclic ring; l and n each represents 0 or 1; $X^-$ represents an anion; and p represents 1 or 2, when the compound of the formula forms an intramolecular salt, p is 1.

The above dyes are explained in detail below.

The heterocyclic ring formed by the non-metallic atomic group represented by $Z_1$ and $Z_2$ is preferably a 5- or 6-membered heterocyclic ring, and may be a single ring or a condensed ring. Specific examples thereof are 5-pyrazolone, 6-hydroxypyridone, pyrazolo[3,4-b]-pyridine-3,6-dione, barbituric acid, pyrazolidinedione, thiobarbituric acid, rhodanine, imidazopyridine, pyrazolo pyrimidine, pyrrolidone, and pyrazoloimidazole.

The methine group represented by $L_1$, $L_2$, $L_3$, $L_4$, and $L_5$ may be substituted (e.g., with methyl, ethyl, phenyl, chlorine, sulfoethyl, carboxyethyl, dimethylamino, and cyano) and the substituents may combine with each other to form a 5- or 6-membered ring (e.g., cyclohexene, cyclopentene, and 5,5-dimethylcyclohexene).

bine with each other to form a 5- or 6-membered ring); and $L_1$, $L_2$, $L_3$, $L_4$, $L_5$, $n_1$, $n_2$, and $M^+$ have the same meaning as defined in the above-described formula (I).

(I-b)

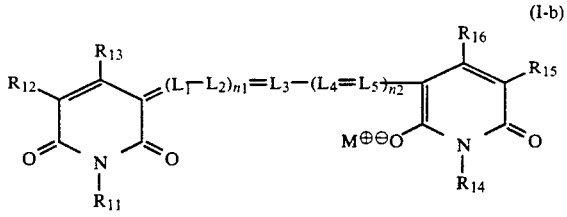

wherein $R_{11}$ and $R_{14}$ each represents a hydrogen atom, an aliphatic group, an aromatic group, a heterocyclic group, $-NR_{17}R_{18}$, $-NR_{17}CONR_{17}R_{18}$, $-NR_{18}COR_{19}$, or $-NR_{18}SO_2R_{19}$; $R_{12}$ and $R_{15}$ each represents a hydrogen atom, an aliphatic group, an aromatic group, a heterocyclic group, a cyano group, a sulfonic acid group, $-NR_{17}R_{18}$, $-NR_{18}COR_{19}$, $-NR_{18}SO_2R_{19}$, $-NR_{17}COR_{17}R_{18}$, $-COOR_{17}$, $-CONR_{17}R_{18}$, $-COR_{19}$, $-SO_2R_{19}$ or $-SO_2NR_{17}R_{18}$; $R_{13}$ and $R_{16}$ each represents a hydrogen atom, an aliphatic group, an aromatic group, a heterocyclic group, $-OR_{17}$, $-COOR_{17}$, $COR_{19}$, $-CONR_{17}R_{18}$, $-NR_{17}R_{18}$, $-NR_{18}COR_{19}$, $-NR_{18}SO_2R_{19}$, $-NR_{17}CONR_{17}R_{18}$, $SO_2R_{19}$, $-SO_2NR_{17}R_{18}$, $-OR_7$, or a cyano group (wherein $R_{17}$ and $R_{18}$ each represents a hydrogen atom, an aliphatic group, or an aromatic group; $R_{19}$ represents an aliphatic group, or an aromatic group, $R_{17}$ and $R_{18}$ or $R_{18}$ and $R_{19}$ may combine with each other to form a 5- or 6-membered ring); and $L_1$, $L_2$, $L_3$, $L_4$, $L_5$, $n_1$, $n_2$, and $M^+$ have the same meaning as defined above in formula (I).

(I-c)

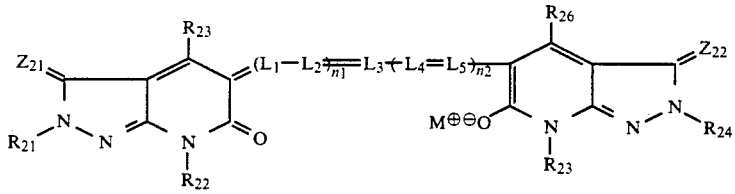

$M^+$ represents a hydrogen atom or a monovalent cation and examples of monovalent cations are $Na^+$, $K^+$, $HN^+(C_2H_5)_3$, $NH^+$, and $Li^+$.

Of the dyes represented by formula (I), particularly preferred dyes are those represented by the following formula (I-a), (I-b), (I-c), (I-d), or (I-e):

(I-a)

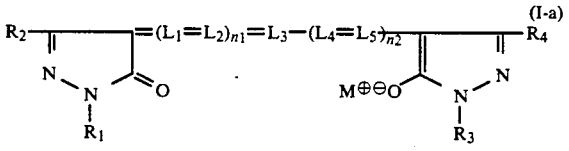

wherein $R_1$ and $R_3$ each represents an aliphatic group, an aromatic group, or a heterocyclic group; $R_2$ and $R_4$ represents an aliphatic group, an aromatic group, $-OR_5$, $-COOR_5$, $-NR_5R_6$, $-CONR_5N_6$, $-NR_5CONR_5R_6$, $-SO_2R_7$, $-COR_7$, $-NR_6COR_7$, $-NR_6SO_2R_7$, or a cyano group (wherein $R_5$ and $R_6$ each represents a hydrogen atom, an aliphatic group, or an aromatic group and $R_7$ represents an aliphatic group or an aromatic group, $R_5$ and $R_6$ or $R_6$ and $R_7$ may comwherein $R_{21}$ and $R_{24}$ each represents an aliphatic group, an aromatic group, or a heterocyclic group; $R_{22}$ and $R_{25}$ each represents a hydrogen atom, an aliphatic group, an aromatic group, a heterocyclic group, $COR_{29}$, or $SO_2R_{29}$; $R_{23}$ and $R_{26}$ each represents a hydrogen atom, a cyano group, an alkyl group, an aryl group, $-COOR_{27}$, $-OR_{27}$, $-NR_{27}R_{28}$, $-N(R_{28})COR_{29}$, $-N(R_{28})SO_2R_{29}$, $-CONR_{27}R_{28}$, or $-N(R_{27})CONR_{27}R_{28}$ (wherein $R_{29}$ represents an aliphatic group or an aromatic group and $R_{27}$ and $R_{28}$ each represents a hydrogen atom, an aliphatic group, or an aromatic group); $Z_{21}$ represents an oxygen atom or $NR_{30}$; $Z_{22}$ represents an oxygen atom or $NR_{31}$ (wherein $R_{30}$ and $R_{31}$ each represents a non-metallic atomic group necessary for forming a 5-membered ring by combining with $R_{21}$ or $R_{24}$); and $L_1$, $L_2$, $L_3$, $L_4$, $L_5$, $n_1$, $n_2$, and $M^+$ have the same meaning as defined above in formula (I), at least one of $R_{21}$, $R_{22}$, $R_{23}$, $R_{24}$, $R_{25}$, $R_{26}$, $L_1$, $L_2$, $L_3$, $L_4$, and $L_5$, however, represents a group having at least one carboxylic acid group or sulfonic acid group.

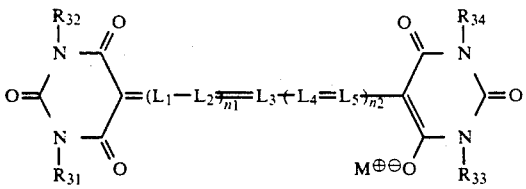

(I-d)

wherein $R_{31}$, $R_{32}$, $R_{33}$, and $R_{34}$ each represents a hydrogen atom, an aliphatic group, an aromatic group, or a heterocyclic group and $L_1$, $L_2$, $L_3$, $L_4$, $L_5$, $n_1$, $n_2$, and $M^+$ have the same meaning as in formula (I).

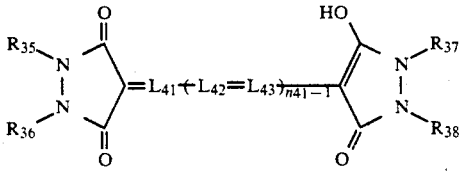

(I-e)

wherein $R_{35}$, $R_{36}$, $R_{37}$, and $R_{38}$ each represents an aliphatic group, an aromatic group, or a heterocyclic residue; $L_{41}$, $L_{42}$, and $L_{43}$ each represents a methine group; $n_{41}$ represents 1,2, or 3, at least one of $R_{35}$, $R_{36}$, $R_{37}$, and $R_{38}$ has, however, a carboxy group or a sulfo group and the sum of the number of these groups is at least two.

The dyes represented by formula(I-a) are described in detail below.

The aliphatic group represented by $R_1$, $R_2$, $R_3$, $R_4$, $R_5$, $R_6$, and $R_7$ includes a straight chain, branched or cyclic alkyl group, an aralkyl group, or an alkenyl group and examples thereof are methyl, ethyl, n-butyl, benzyl, 2-sulfoethyl, 4-sulfobutyl, 2-sulfobenzyl, 2-carboxyethyl, carboxymethyl, trifluoromethyl, dimethylaminoethyl, and 2-hydroxyethyl.

Examples of aromatic group represented by $R_1$, $R_2$, $R_3$, $R_4$, $R_5$, $R_6$, and $R_7$ are phenyl, naphthyl, 4-sulfophenyl, 3-sulfophenyl, 2,5-disulfophenyl, 4-carboxyphenyl, and 5,7-disulfo-3-naphthyl.

In particular, when $n_1$ is 1 or 2, and n is 0, the phenyl group represented by $R_1$ and $R_2$ has preferably two or more sulfonic acid groups.

The heterocyclic group represented by $R_1$ and $R_2$ is a 5- or 6-membered nitrogen-containing heterocyclic group (including a condensed ring) and examples thereof are 5-sulfopyridin-2-yl and 5-sulfobenzothiazol-2-yl.

Examples of the 5- or 6-membered ring formed by the combination of $R_5$ and $R_6$ or $R_6$ and $R_7$, are a pyrrolidine ring, a piperidine ring, a pyrrolidone ring, a morpholine ring, etc.

Specific examples of dyes represented by formula (I-a) are shown below but the invention is not to be construed as being limited to these examples.

| No. | $R_1$, $R_3$ | $R_2$, $R_4$ | $=(L_1-L_2)_{n1}=L_3-(L_4=L_5)_{n2}-$ | $M^{\oplus}$ |
|---|---|---|---|---|
| I-a-1 | 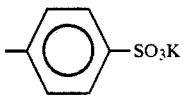 | $-CH_3$ | $=CH-$ | H |
| I-a-2 | 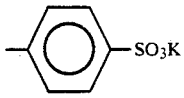 | $-CONHC_3H_7^{(n)}$ | $=CH-$ | H |
| I-a-3 | 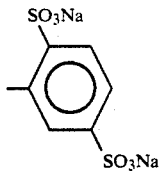 | $-OH$ | $=CH-CH=CH-$ | Na |
| I-a-4 | 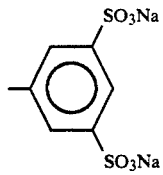 | $-OC_2H_5$ | $=CH\leftarrow CH=CH\rightarrow_2$ | Na |
| I-a-5 | $-CH_2CH_2SO_3K$ | $-COOC_2H_5$ | $=CH-CH=CH-$ | H |
| I-a-6 | 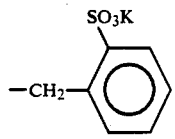 | $-CONHC_4H_9^{(n)}$ | $=CH-CH=CH-$ | H |
| I-a-7 | $-CH_2CH_2SO_3K$ | $-COOK$ | $=CH\leftarrow CH=CH\rightarrow_2$ | H |

-continued

| No. | $R_1$, $R_3$ | $R_2$, $R_4$ | $=(L_1-L_2)_{n1}=L_3-(L_4=L_5)_{n2}-$ | $M^{\oplus}$ |
|---|---|---|---|---|
| I-a-8 | 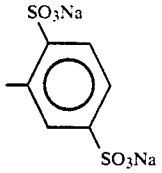 | $-COCH_3$ | $=CH-(CH=CH)_2$ | Na |
| I-a-9 | 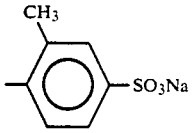 | $-CF_3$ | $=CH-(CH=CH)_2$ | H |
| I-a-10 | 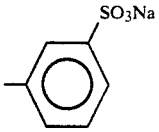 | $-NHCOCH_3$ | $=CH-CH=CH-$ | H |
| I-a-11 | 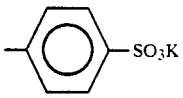 | $-COOC_2H_5$ | $=CH-(CH=CH)_2$ | H |
| I-a-12 | 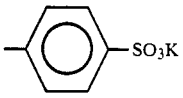 | $-COOK$ | $=CH-CH=CH-$ | H |
| I-a-13 | 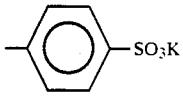 | $-NHCONHCH_3$ | $=CH-CH=CH-$ | H |
| I-a-14 | $-(CH_2)_4SO_3K$ | $-OH$ | $=CH-$ | H |
| I-a-15 | 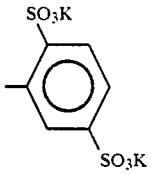 | $-COOK$ | $=CH-CH=CH-$ | K |
| I-a-16 | 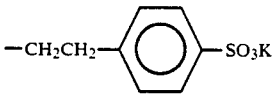 | $-C_6H_5$ | $=CH-CH=CH-$ | H |
| I-a-17 | 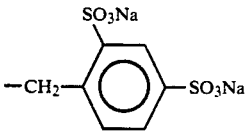 | $-COOC_2H_5$ | $=CH-(CH=CH)_2$ | Na |
| I-a-18 | 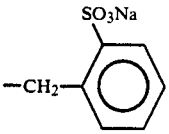 | $-CONHCH_2CH_2OH$ | $=CH-(CH=CH)_2$ | H |
| I-a-19 | 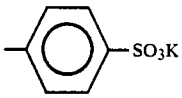 | $-CONHCH_2CH_2SO_3K$ | $=CH-(CH=CH)_2$ | H |
| I-a-20 | $-(CH_2)_3SO_3K$ | $-CONHC_7H_{15}^{(n)}$ | $=CH-CH=CH-$ | H |
| I-a-21 | $-CH_2COOK$ | $-COOK$ | $=CH-CH=CH-$ | K |

-continued

| No. | $R_1$, $R_3$ | $R_2$, $R_4$ | $=(L_1-L_2)_{n1}=L_3-(L_4=L_5)_{n2}-$ | $M^{\oplus}$ |
|---|---|---|---|---|
| I-a-22 | $-CH_2CH_2SO_3K$ | $-N(CH_3)_2$ | $=CH\leftarrow CH=CH\rangle_2$ | H |
| I-a-23 | $-(CH_2)_3SO_3K$ | $-CN$ | $=CH\leftarrow CH=CH\rangle_2$ | H |
| I-a-24 | 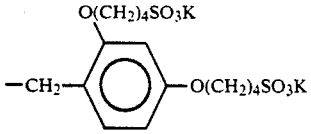 | $-CH_2Cl$ | $=CH\leftarrow CH=CH\rangle_2$ | H |
| I-a-25 | $-(CH_2)_2SO_3Na$ | $-OH$ | $=CH\leftarrow CH=CH\rangle_2$ | H |
| I-a-26 | 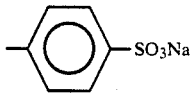 | $-CH_3$ | $=CH-\overset{CH_3}{\overset{\vert}{C}}=CH-$ | Na |
| I-a-27 | 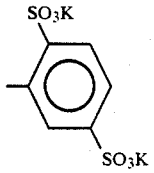 | $-COOC_2H_5$ | $=CH\leftarrow CH=CH\rangle_2$ | H |
| I-a-28 | 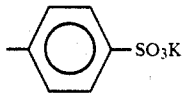 | $-CONHC_2H_5$ | $=CH-CH=CH-$ | H |
| I-a-29 | 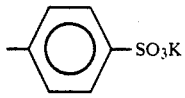 | $-NHCOC_3H_7^{(i)}$ | $=CH-CH=CH-$ | H |
| I-a-30 | $-CH_2CH_2SO_3K$ | 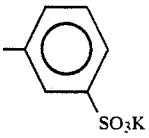 | $=CH-CH=CH-$ | H |
| I-a-31 | 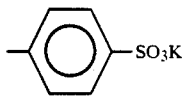 | $-CH_3$ | $=\overset{CH_3}{\overset{\vert}{C}}-CH=CH-$ | H |
| I-a-32 | 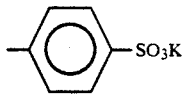 | $-{}^{t}C_4H_9$ | $=CH-CH=CH-$ | H |
| I-a-33 | 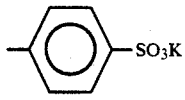 | $-CN$ | $=CH\leftarrow CH=CH\rangle_2$ | H |
| I-a-34 | 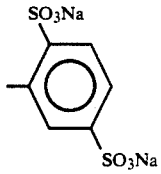 | $-COCH_3$ | $=CH-CH=\overset{CH_3}{\overset{\vert}{C}}-CH=CH-$ | Na |
| I-a-35 | 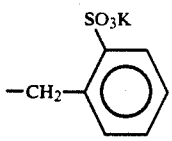 | $-COOK$ | $=C\leftarrow CH=CH\rangle_2$ | H |

-continued

| No. | $R_1$, $R_3$ | $R_2$, $R_4$ | $=(L_1-L_2)_{n1}=L_3-(L_4=L_5)_{n2}-$ | $M^{\oplus}$ |
|---|---|---|---|---|
| I-a-36 | 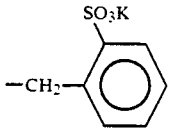 | $-COOK$ | $=CH-CH=CH-$ | H |
| I-a-37 | 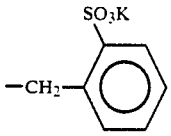 | $-CONHC_4H_9^{(t)}$ | $=CH\leftarrow CH=CH\rightarrow_2$ | H |
| I-a-38 | 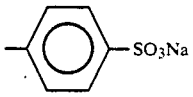 | $-NHSO_2CH_3$ | $=CH\leftarrow CH=CH\rightarrow_2$ | H |
| I-a-39 | 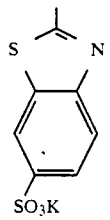 | $-CN$ | $=CH\leftarrow CH=CH\rightarrow_2$ | H |
| I-a-40 | 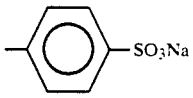 | $-OC_2H_5$ | $=CH\leftarrow CH=CH\rightarrow_2$ | H |
| I-a-41 | 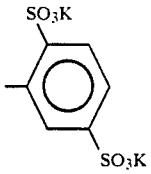 | $-CN$ | $=CH\leftarrow CH=CH\rightarrow_2$ | H |

The above-described dyes can be synthesized by the methods described in British Patents 506,385, 1,177,429, 1,338,799, 1,385,371, 1,467,214, 1,433,102 and 1,553,516, JP-A-48-85130, JP-A-55-161233, JP-A-52-20330, JP-A-59-111640, and JP-A-62-273527.

The dyes shown by formula (I-b) are described in detail below.

Examples of the aliphatic groups represented by $R_{11}$, $R_{12}$, $R_{13}$, $R_{14}$, $R_{15}$, $R_{16}$, $R_{17}$, $R_{18}$, and $R_{19}$ are methyl, ethyl, isopropyl, 2-chloroethyl, trifluoromethyl, benzyl, 2-sulfobenzyl, 4-sulfophenethyl, carboxymethyl, 2-carboxyethyl, 2-sulfoethyl, 2-hydroxyethyl, dimethylaminoethyl, and cyclopentyl.

Examples of the aromatic groups represented by $R_{11}$, $R_{12}$, $R_{13}$, $R_{14}$, $R_{15}$, $R_{16}$, $R_{17}$, $R_{18}$, and $R_{19}$ are phenyl, naphthyl, 3-sulfophenyl, 4-sulfophenyl, 2,5-disulfophenyl, 4-(3-sulfopropyloxy)phenyl, 3-carboxyphenyl, and 2-carboxy-phenyl.

Examples of the heterocyclic group represented by $R_{11}$, $R_{12}$, $R_{13}$, $R_{14}$, $R_{15}$, and $R_{16}$ are 2-pyridyl, morpholino, and 5-sulfobenzimidazol-2-yl.

Examples of 5- or 6-membered rings formed by the combination of $R_{17}$, and $R_{18}$, or $R_{18}$ and $R_{19}$ are a piperidine ring, a pyrrolidine ring, a morpholine ring, a pyrrolidone ring, etc.

Specific examples of the dye represented by formula (I-b) are illustrated below but the dyes for use in this invention are not to be construed as being limited to these compounds.

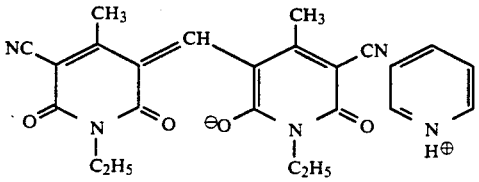

(I-b-1)

-continued
(I-b-2)
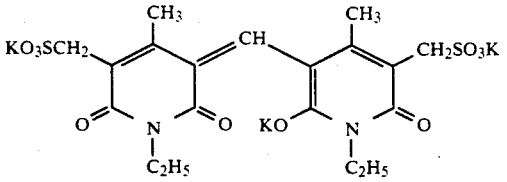
(I-b-3)
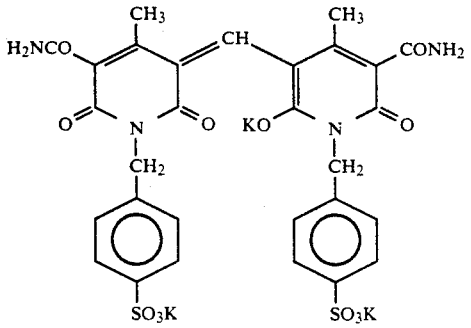
(I-b-4)
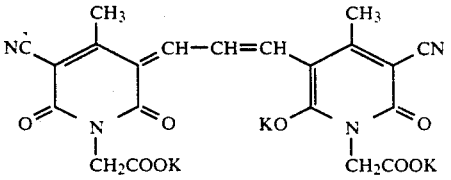
(I-b-5)
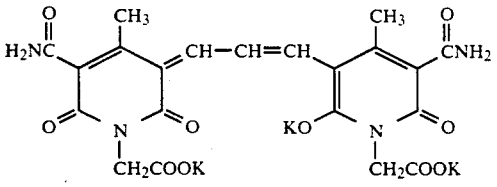
(I-b-6)
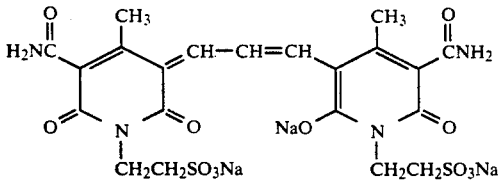
(I-b-7)
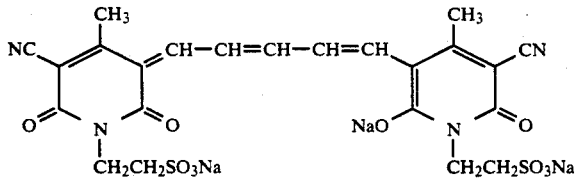
(I-b-8)
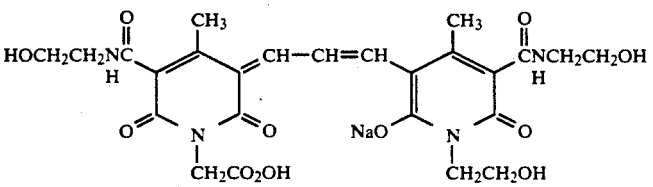

-continued
(I-b-9)
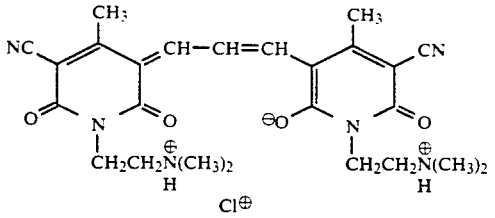
(I-b-10)
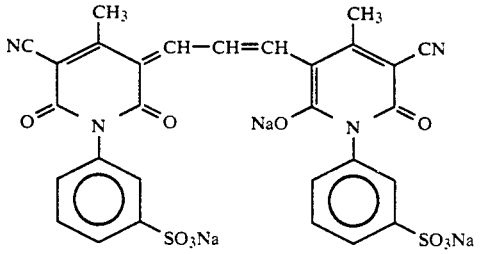
(I-b-11)
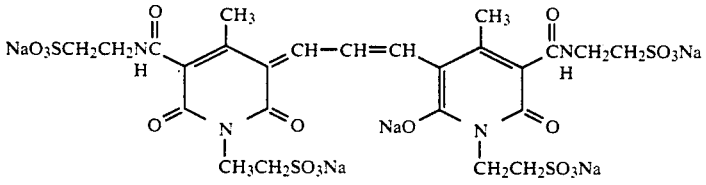
(I-b-12)
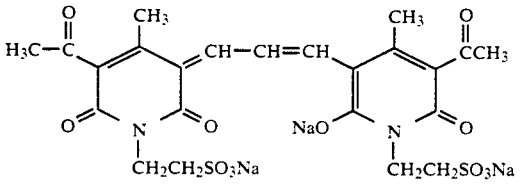
(I-b-13)
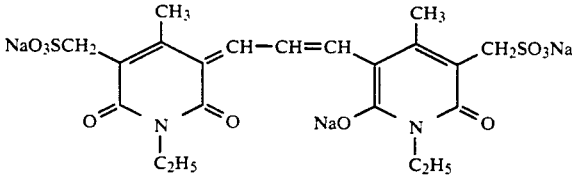
(I-b-14)
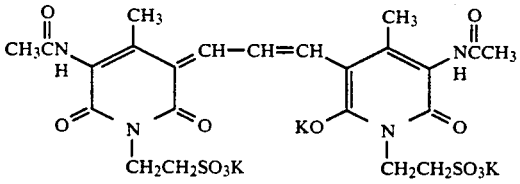
(I-b-15)
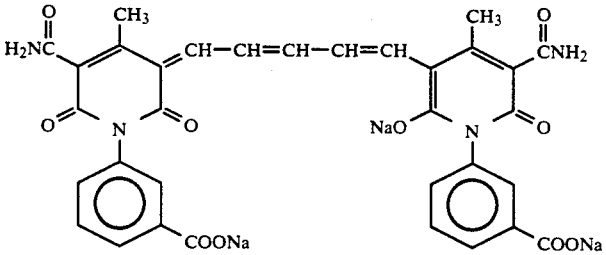

-continued

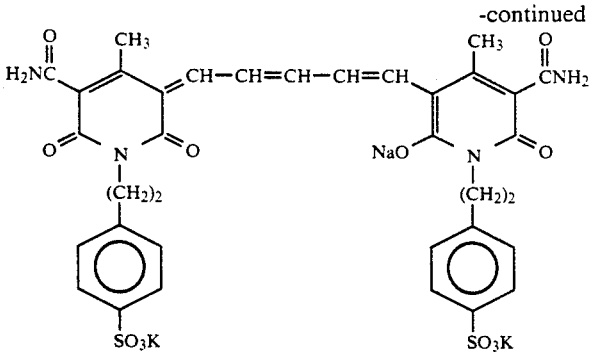

(I-b-16)

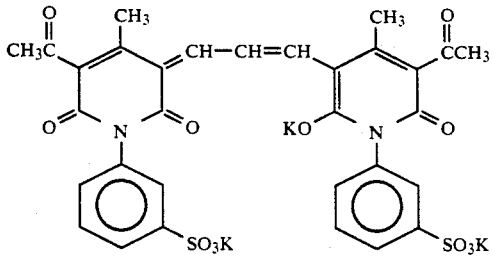

(I-b-17)

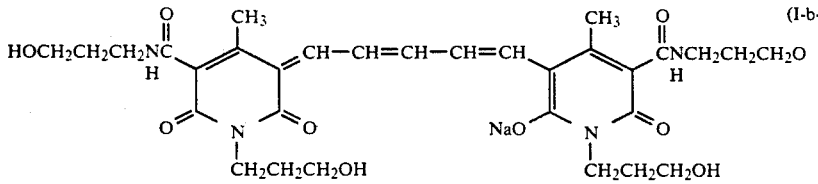

(I-b-18)

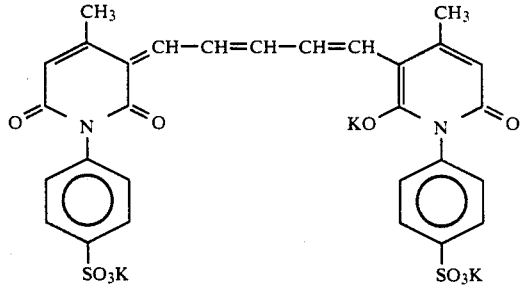

(I-b-19)

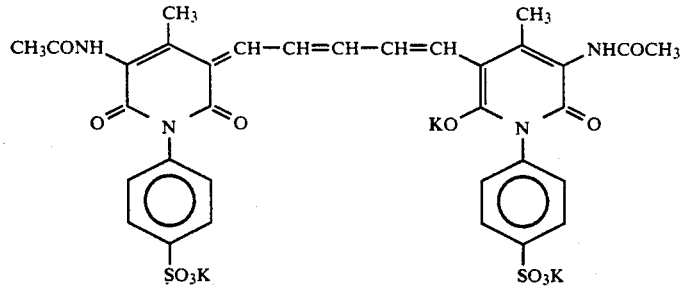

(I-b-20)

The dyes represented by formula (I-b) can be synthesized by the method described in British Patents 1,278,621, 1,512,863, and 1,579,899.

The dyes represented by formula (I-c) are described in detail below.

The aliphatic groups represented by $R_{21}$, $R_{22}$, $R_{23}$, $R_{24}$, $R_{25}$, $R_{26}$, $R_{27}$, $R_{28}$, and $R_{29}$ includes a straight chain, branched, or cyclic alkyl group, an aralkyl, and an alkenyl group and examples thereof are methyl, ethyl, n-butyl, benzyl, 2-sulfoethyl, 4-sulfobutyl, 2-sulfobenzyl, 2,4-disulfobenzyl, 2-carboxyethyl, carboxymethyl, 2-hydroxyethyl, dimethylaminoethyl, and trifluoromethyl.

Examples of the aromatic group represented by $R_{21}$, $R_{22}$, $R_{23}$, $R_{24}$, $R_{25}$, $R_{26}$, $R_{27}$, $R_{28}$, and $R_{29}$ phenyl, naphthyl, 4-sulfophenyl, 2,5-disulfophenyl, 4-carboxyphenyl, 5,7-disulfo-3-naphthyl, 4-methoxyphenyl, and p-tolyl.

The heterocyclic group represented by $R_{21}$, $R_{22}$, $R_{24}$, and $R_{25}$, is a 5- or 6 membered nitrogen-containing heterocyclic group (including a condensed ring) and examples thereof are 5-sulfopyridin-2-yl and 5-sulfobenzothiazol-2-yl.

Examples of 5-membered ring formed by the combination of $R_{30}$ and $R_{21}$ or $R_{31}$ and $R_{24}$ when $Z_{21}$ represents $NR_{30}$ and $Z_{22}$ represents $NR_{31}$ are an imidazole ring, a benzimidazole ring, a triazole ring, etc., and these rings may be substituted [e.g., a carboxylic acid group, a sulfonic acid group, a hydroxy group, a halogen atom (e.g., fluorine, chlorine, and bromine), an alkyl group (e.g., methyl and ethyl), and an alkoxy group (e.g., methoxy and 4-sulfobutoxy)].

Specific examples of dyes represented by formula (I-c) are illustrated below but the invention is not to be construed as being limited to these compounds.

| Compound | $R_{21}$, $R_{24}$ | $R_{22}$, $R_{25}$ | $R_{23}$, $R_{26}$ | $=(L_1-L_2)_{n1}=L_3(L_4=L_5)_{n1}-$ | $Z_{21}$, $Z_{22}$ | $M^{\oplus}$ |
|---|---|---|---|---|---|---|
| I-c-1 | 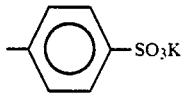 | $-CH_3$ | $-CH_3$ | $=CH-$ | O | H |
| I-c-2 | 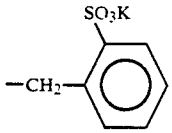 | 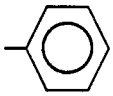 | $-COOK$ | $=CH-$ | O | K |
| I-c-3 | 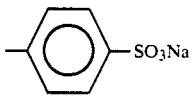 | $-H$ | $-OC_2H_5$ | $=CH-$ | O | H |
| I-c-4 | $-(CH_2)_3SO_3H$ | $-CH_2CH_2OH$ | 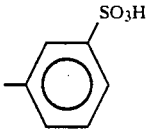 | $=CH-CH=CH-$ | O | H |
| I-c-5 | $+CH_2)_2SO_3K$ | $-COCH$ | $-COOK$ | $=CH-CH=CH-$ | O | H |
| I-c-6 | 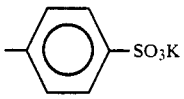 | $-CH_3$ | $-COOC_2H_5$ | $=CH-$ | O | K |
| I-c-7 | 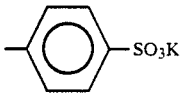 | $-CH_3$ | $-CH_3$ | $=CH-CH=CH-$ | O | H |
| I-c-8 | 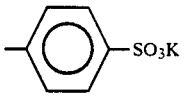 | $-H$ | $-COOK$ | $=CH-CH=CH-$ | O | H |
| I-c-9 | 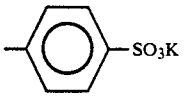 | $-CH_3$ | $-CH_3$ | $=CH+CH=CH)_2$ | O | H |
| I-c-10 | $-CH_2CH_2COOH$ | $-CH_2CH_2OH$ | $-COOH$ | $=CH-CH=CH-$ | O | H |
| I-c-11 | $-CH_2CH_2SO_3K$ | 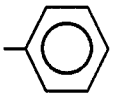 | $-CH_3$ | $=CH-CH=CH-$ | O | H |
| I-c-12 | 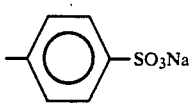 | 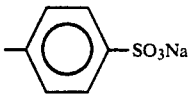 | $-CH_3$ | $=CH-CH=CH-$ | O | H |

-continued

| Compound | $R_{21}$, $R_{24}$ | $R_{22}$, $R_{25}$ | $R_{23}$, $R_{26}$ | $=(L_1-L_2)_{n1}=L_3(L_4=L_5)_{n1}-$ | $Z_{21}$, $Z_{22}$ | $M^{\oplus}$ |
|---|---|---|---|---|---|---|
| I-c-13 | 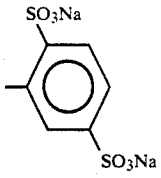 | $-CH_3$ | $-COONa$ | $=CH-CH=CH-$ | O | Na |
| I-c-14 | 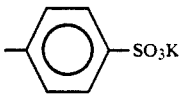 | $-CH_3$ | $-COOK$ | $=CH-CH=CH-$ | O | K |
| I-c-15 | 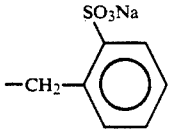 | $-(CH_2)_2SO_3Na$ | $-COONa$ | $=CH-CH=CH-$ | O | H |
| I-c-16 | $-CH_2CH_2SO_3K$ | $-COCH_3$ | $-COOK$ | $=CH-CH=CH-$ | O | H |
| I-c-17 | 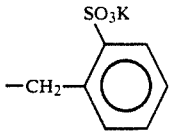 | 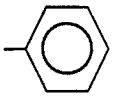 | $-CH_3$ | $=CH-CH=CH-$ | O | K |
| I-c-18 | 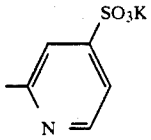 | $-H$ | $-CH_3$ | $=CH-CH=CH-$ | O | H |
| I-c-19 | 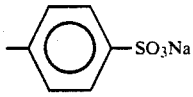 | $-CH_2CH_2OH$ | $-COONa$ | $=CH-CH=CH-$ | O | Na |
| I-c-20 | 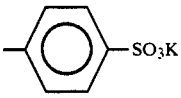 | $-CH_3$ | $-CONHCH_2CH_2OH$ | $=CH-CH=CH-$ | O | K |
| I-c-21 | $-(CH_2)_3SO_3K$ | $-CH_2CH_2COOK$ | 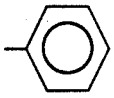 | $=CH-CH=CH-$ | O | H |
| I-c-22 | 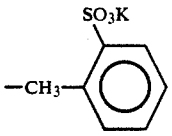 | $-CH_3$ | $-COOK$ | $=CH-CH=CH-$ | O | K |
| I-c-23 | $-CH_2CH_2SO_3K$ | $-CH_3$ | $-COOK$ | $=CH-CH=CH-$ | O | H |
| I-c-24 | 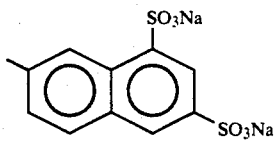 | $-CH_3$ | $-COONa$ | $=CH-CH=CH-$ | O | H |

-continued

| Compound | $R_{21}$, $R_{24}$ | $R_{22}$, $R_{25}$ | $R_{23}$, $R_{26}$ | $=(L_1-L_2)_{n1}=L_3(L_4=L_5)_{n1}-$ | $Z_{21}$, $Z_{22}$ | $M^{\oplus}$ |
|---|---|---|---|---|---|---|
| I-c-25 | 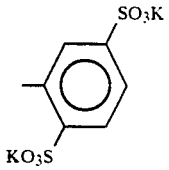 | $-CH_2CH_2OH$ | $-CH_3$ | $=CH-CH=CH-$ | O | H |
| I-c-26 | 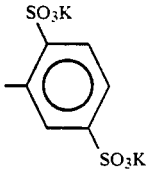 | $-CH_3$ | $-CH_3$ | $=CH(CH=CH)_2$ | O | K |
| I-c-27 | 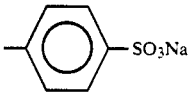 | $-CH_3$ | $-CN$ | $=CH-CH=CH-$ | O | Na |
| I-c-28 | 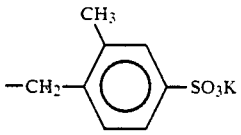 | 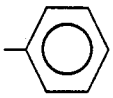 | $-CF_3$ | $=CH-CH=CH-$ | O | K |
| I-c-29 | 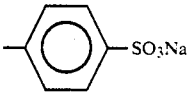 | $-(CH_2)_4SO_3Na$ | $-CH_3$ | $=CH-CH=CH-$ | O | Na |
| I-c-30 | 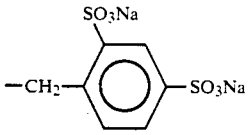 | $-CH_3$ | $-{}^tC_4H_9$ | $=CH-CH=CH-$ | O | Na |

The dyes represented by formula (I-c) can be synthesized using utilizing the methods described in JP-B-39-22069, JP-B-43-3504, JP-B-52-38056, JP-B-54-38129, and JP-B-55-10059, JP-A-49-99620 and JP-A-59-16834, and U.S. Pat. No. 4,181,225.

The dyes represented by formula (I-d) are described in detail below.

The aliphatic group represented by $R_{31}$, $R_{32}$, $R_{33}$, and $R_{34}$, are the same as the aliphatic groups defined for $R_1$, $R_2$, $R_3$, and $R_4$ in formula (I-a).

The aromatic groups represented by $R_{31}$, $R_{32}$, $R_{33}$, and $R_{34}$, are the same as the aromatic groups defined above for $R_1$, $R_2$, $R_3$, and $R_4$ in formula (I-a).

The heterocyclic groups represented by $R_{31}$, $R_{32}$, $R_{33}$, and $R_{34}$, are the same as the heterocyclic groups defined above for $R_1$, $R_2$, $R_3$, and $R_4$ in formula (I-a).

Specific examples of dyes represented by formula (I-d) are illustrated below but the invention is not to be construed as being limited to these dyes.

| No. | $R_{31}$, $R_{33}$ | $R_{32}$, $R_{34}$ | $=(L_1-L_2)=_{n1}L_3-(L_4=L_5)_{n2}$ | $M^{\oplus}$ |
|---|---|---|---|---|
| I-d-1 | ${}^nC_4H_9$ | $-CH_2COOK$ | $=CH-$ | K |
| I-d-2 | $-CH_2CH_2OH$ | $-{}^nC_4H_9$ | $=CH-CH=CH-$ | H |
| I-d-3 | $-CH_2CH_2SO_3K$ | $-C_2H_5$ | $=CH-CH=CH-$ | H |
| I-d-4 | $-CH_2CH_2COOK$ | $-CH_2CH_2COOK$ | $=CH-CH=CH-$ | H |
| I-d-5 | $-CH_3$ | $-CH_3$ | $=CH(CH=CH)_2$ | H |
| I-d-6 | $-{}^nC_4H_9$ | $-CH_2COOK$ | $=CH(CH=CH)_2$ | H |
| I-d-7 | $-C_6H_5$ | $-CH_2COOK$ | $=CH(CH=CH)_2$ | H |
| I-d-8 | $-CH_2CH_2SO_3K$ | $-{}^nC_4H_9$ | $=CH-$ | H |
| I-d-9 | 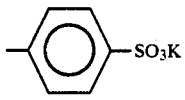 | H | $=CH-CH=CH-$ | H |
| I-d-10 | $-(CH_2)_3SO_3Na$ | H | $=CH-CH=CH-$ | H |
| I-d-11 | $-C_6H_5$ | $-(CH_2)_2SO_3K$ | $=CH-$ | H |
| I-d-12 | $-C_6H_5$ | $-(CH_2)_2SO_3K$ | $=CH-CH=CH-$ | H |

-continued

| No. | $R_{31}$, $R_{33}$ | $R_{32}$, $R_{34}$ | $=(L_1-L_2)=_{n1}L_3-(L_4=L_5)_{n2}$ | $M^{\oplus}$ |
|---|---|---|---|---|
| I-d-13 | $-C_6H_5$ | $-(CH_2)_2SO_3K$ | $=CH-CH=CH-_2$ | H |
| I-d-14 | $-CH_2COOC_2H_5$ | $-{}^nC_4H_9$ | $=CH-CH=CH-$ | H |
| I-d-15 | 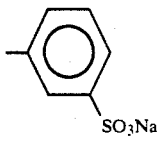 | $-(CH_2)_2SO_3Na$ | $=CH-CH=CH-$ | H |
| I-d-16 | $-CH_3$ | $-(CH_2)_2SO_3K$ | $=CH-$ | H |
| I-d-17 | 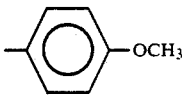 | $-(CH_2)_2SO_3K$ | $=CH-CH=CH-$ | H |
| I-d-18 | 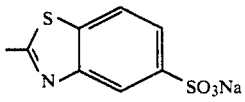 | $-C_2H_5$ | $=CH-CH=CH-$ | H |
| I-d-19 | $-{}^nC_6H_{13}$ | $-(CH_2)_2SO_3K$ | $=CH-$ | H |
| I-d-20 | $-(CH_2)_3SO_3Na$ | H | $=CH-$ | H |

The above-described dyes can be synthesized by the methods described in U.S. Pat. Nos. 3,247,127, 3,469,985, 3,653,905 and 4,078,933.

The dyes represented by formula (I-e) are described in detail below.

$R_{35}$, $R_{36}$, $R_{37}$, and $R_{38}$ each represents an alkyl group (e.g., methyl, ethyl, carboxymethyl, 2-carboxyethyl, 2-hydroxyethyl, methoxyethyl, 2-chloroethyl, benzyl, 2-sulfobenzyl, and 4-sulfophenethyl), an aryl group (e.g., phenyl, 4-sulfophenyl, 3-sulfophenyl, 2-sulfophenyl, 4-carboxyphenyl, 3-carboxyphenyl, and 4-hydroxyphenyl), or a heterocyclic residue (e.g., 2-pyridyl and 2-imidazolyl).

$L_{41}$, $L_{42}$, and $L_{43}$ each represents a methine group and the methine group may be substituted by methyl, ethyl, phenyl, chlorine, sulfoethyl, carboxyethyl, etc.

Also, $n_{41}$ represents 1, 2, or 3.

At least one of $R_{35}$, $R_{36}$, $R_{37}$, and $R_{38}$ has, however, at least one carboxy group or a sulfo group and the sum of these groups is at least 2. Also, the carboxy group or the sulfo group may be in the form of a free acid or a salt thereof (e.g., a sodium salt, a potassium salt and an ammonium salt).

Specific examples of dyes represented by formula (I-e) are shown below but the invention is not to be construed as being limited to these dyes.

(I-e-1)

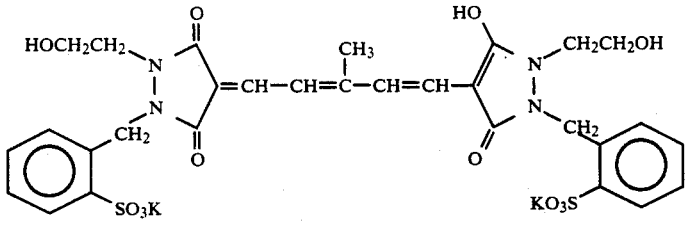

(I-e-2)

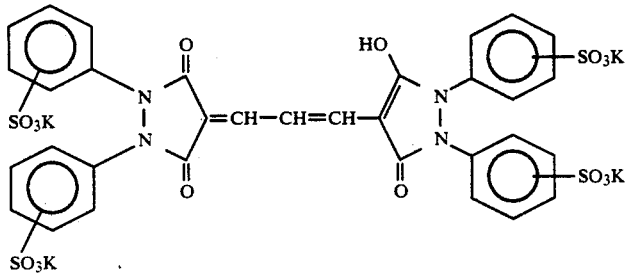

-continued
(I-e-3)
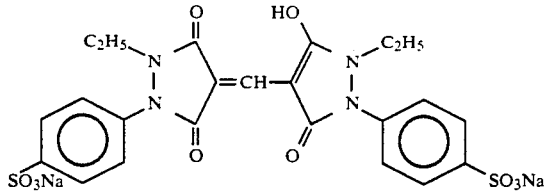
(I-e-4)
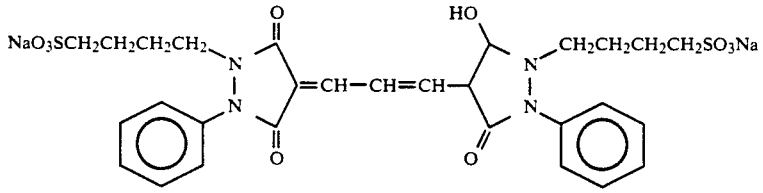
(I-e-5)
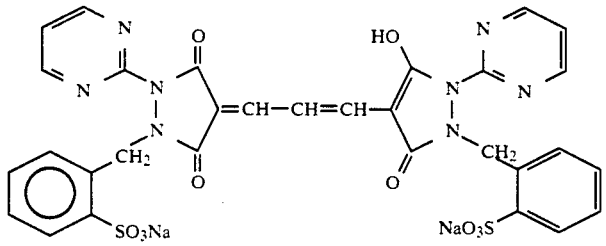
(I-e-6)
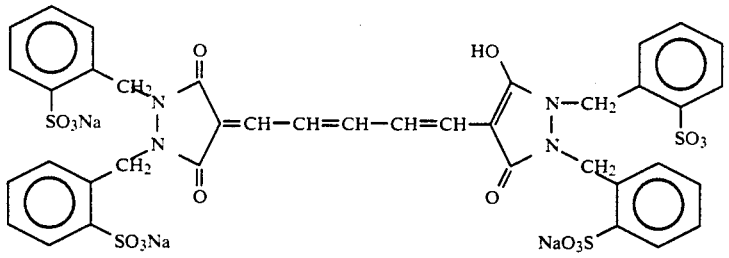
(I-e-7)
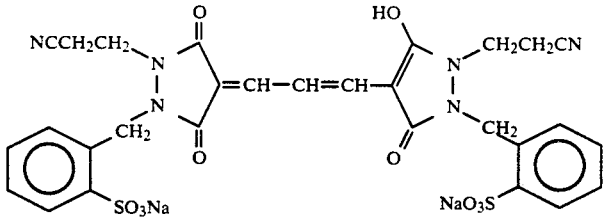
(I-e-8)
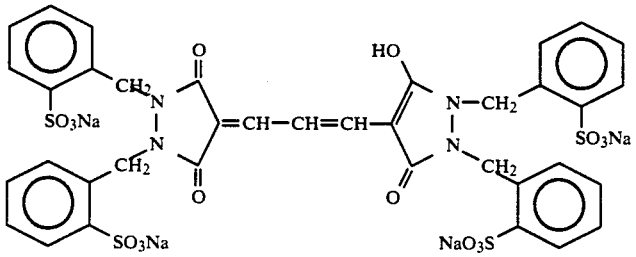

-continued (I-e-9)

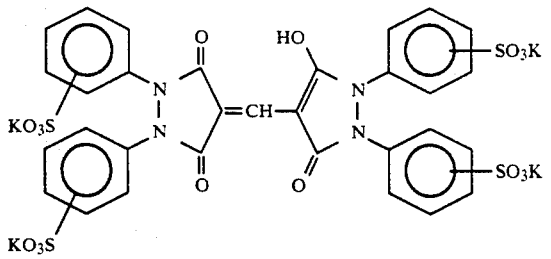

(I-e-10)

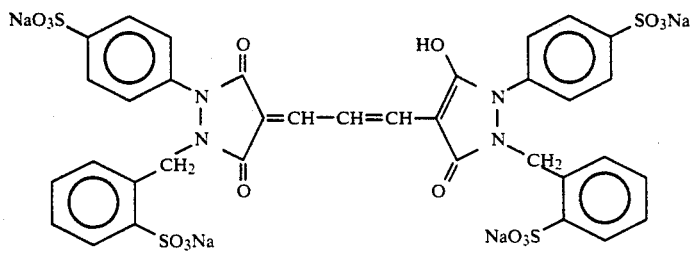

(I-e-11)

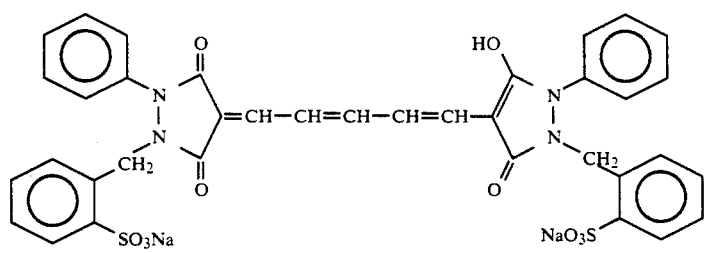

The dyes represented by formula (II) are described in detail below.

Examples of electron attracting groups represented by X and Y in the formula are, for example, a cyano group, a carboxy group, an alkylcarbonyl group [having preferably 7 or less carbon atoms, examples thereof are acetyl and propionyl, each may be substituted (e.g., with a halogen atom such as chlorine)], an arylcarbonyl group [preferred examples of the aryl group are phenyl and naphthyl, each may be substituted with a sulfo group, a carboxy group, a hydroxy group, a halogen atom (e.g., chlorine and bromine), a cyano group, an alkyl group (e.g., methyl and ethyl), an alkoxy group (e.g., methoxy and ethoxy), a carbamoyl group (e.g., methylcarbamoyl), a sulfamoyl group (e.g., ethylsulfamoyl), a nitro group, an alkylsulfonyl group (e.g., methanesulfonyl), an arylsulfonyl group (e.g., benzenesulfonyl), an amino group (e.g., dimethylamino), an acylamino group (e.g., acetylamino and trichloroacetylamino), and a sulfonamido group (e.g., methanesulfonamido)], an alkoxycarbonyl group (which may be substituted, having preferably 7 or less carbon atoms, and examples thereof are ethoxycarbonyl and methoxyethoxycarbonyl), an aryloxy carbonyl group (preferred examples of the aryl group are phenyl and naphthyl and each may have a substituent such as those described above for the arylcarbonyl group), a carbamoyl group (which may be substituted, having preferably 7 or less carbon atoms, and examples thereof are methylcarbamoyl, phenylcarbamoyl, and 3-sulfophenyl carbamoyl), an alkylsulfonyl group (which may be substituted and an example thereof is methanesulfonyl), an arylsulfonyl group (which may be substituted, an example thereof is phenylsulfonyl), and a sulfamoyl group (which may be substituted, and examples thereof are methylsulfamoyl and 4-chlorophenylsulfamoyl).

Also, X and Y may combine with each other to form a ring (e.g., pyrazolone, pyrazolotriazole, oxyindole, iso-oxazolone, barbituric acid ring, thiobarbituric acid ring, an indanedione, and pyridine), and pyrazolone is preferred.

$R_{41}$ and $R_{42}$ each represents a hydrogen atom, a halogen atom (e.g., chlorine and bromine), an alkyl group (which may be substituted, having preferably 5 or less carbon atoms, and examples thereof are methyl and ethyl), an alkoxy group (which may be substituted, having preferably 5 or less carbon atoms, and examples thereof are methoxy, ethoxy, and 2-chloroethoxy), a hydroxy group, a carboxy group, a substituted amino group (e.g., acetylamino, methylamino, diethylamino, and methanesulfonylamino), a carbamoyl group (which may be substituted, such as, for example, methylcarbamoyl), a sulfamoyl group (which may be substituted, such as, for example, ethylsulfamoyl), an alkoxycarbonyl group (e.g., methoxycarbonyl), or a sulfo group.

$R_{43}$ and $R_{44}$ each represents a hydrogen atom, an alkyl group (which may be substituted, having preferably 8 or less carbon atoms, such as, for example, methyl, ethyl, propyl, and butyl, and examples of the substituent are a sulfo group, a carboxy group, a halogen atom, hydroxy group, a cyano group, an alkoxy group, an alkylcarbonyl group, an arylcarbonyl group, an acyloxy group, an acylamino group, a carbamoyl group, a sulfamoyl group, an alkylamino group, a dialkylamino group, an alkoxycarbonyl group, an aryloxycarbonyl group, an alkylsulfonyl group, an arylsulfonyl group, a sulfonylamino group, a ureido group, and an aryl group), an alkenyl group (which may be substituted, such as, for example, 3-hexenyl), an aryl group (preferably phenyl which may be substituted with a substituent as described above for the arylcarbonyl group represented by X or Y), an acyl group (e.g., acetyl and benzoyl), or a sulfonyl group (e.g., methanesulfonyl and phenylsulfonyl).

$R_{43}$ and $R_{44}$ may form together a 5- or 6-membered heterocyclic ring (e.g., piperidine and morpholine).

Also, $R_{41}$ and $R_{43}$ or $R_{42}$ and $R_{44}$ each may combine with each other to form a 5- or 6-membered heterocyclic ring.

At least one of X, Y, $R_{41}$, $R_{42}$, $R_{43}$, and $R_{44}$ has a sulfo group or a carboxy group. The sulfo group or the carboxy group may be the free acid form or a salt form (e.g., a sodium salt, a potassium salt, a $(C_2H_5)_3NH$ salt, a pyridinium salt, and an ammonium salt).

The methine group represented by $L_{11}$, $L_{12}$, and $L_{13}$ may be substituted (e.g., methyl, ethyl, cyano, phenyl, chlorine, and sulfoethyl).

Also, k represents 0 or 1.

Specific examples of the dyes represented by formula (II) are illustrated below but the invention is not to be construed as being limited to these dyes.

II-1

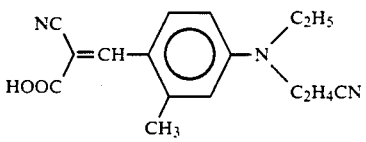

II-2

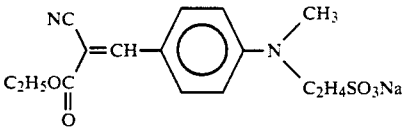

II-3

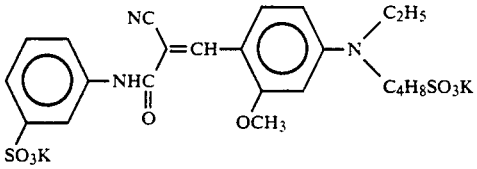

II-4

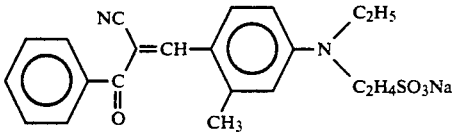

II-5

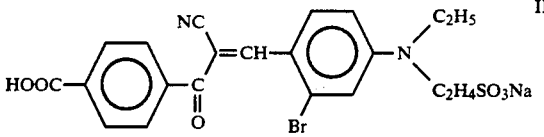

II-6

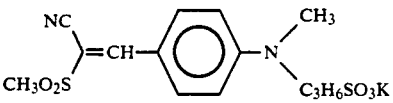

-continued

II-7

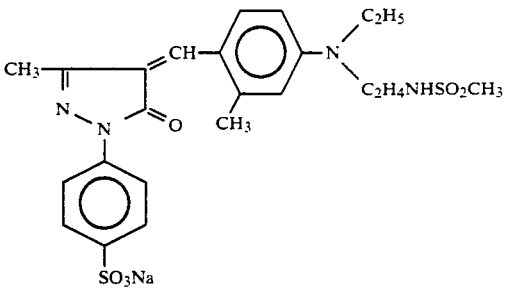

II-8

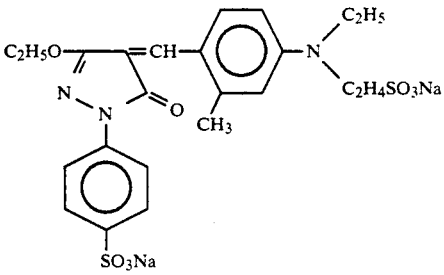

II-9

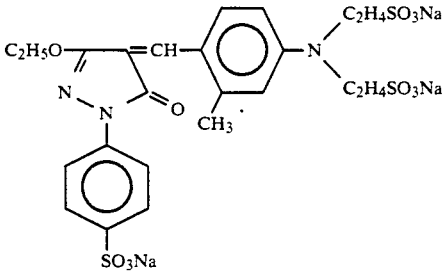

II-10

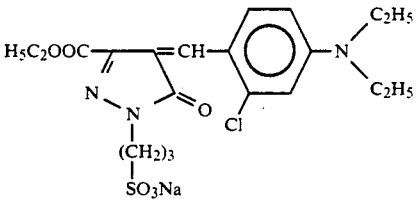

II-11

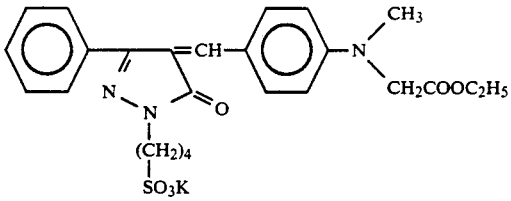

II-12

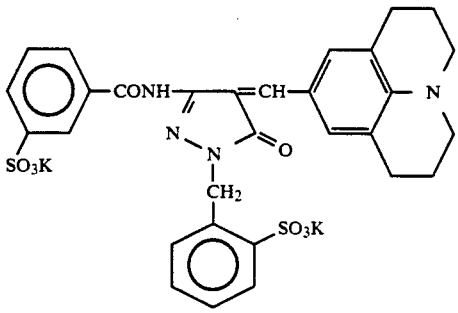

-continued
II-13
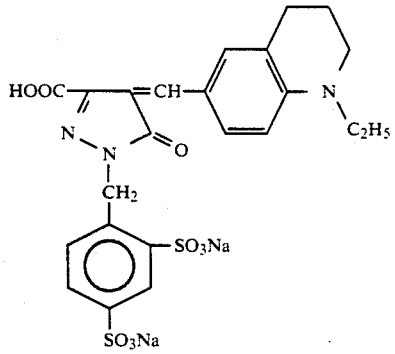
II-14
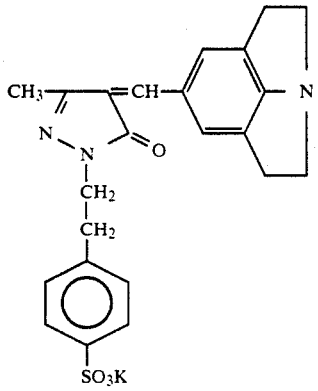
II-15
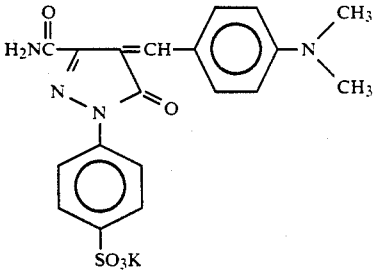
II-16
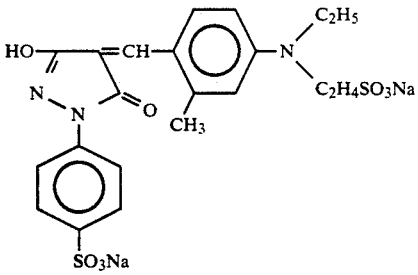
II-17
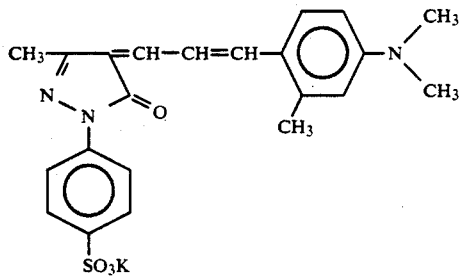
-continued
II-18
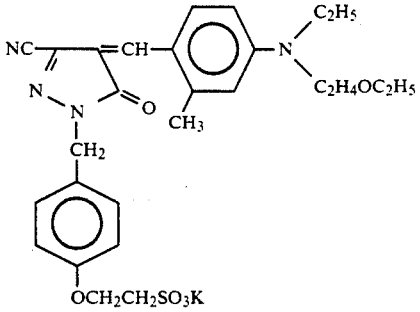
II-19
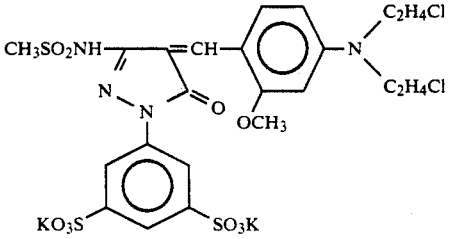
II-23
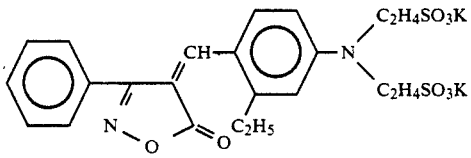
II-24
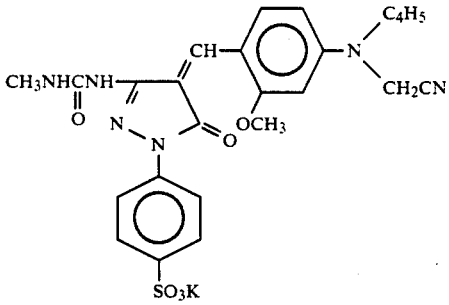
II-25
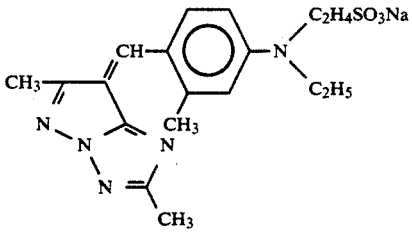
II-26
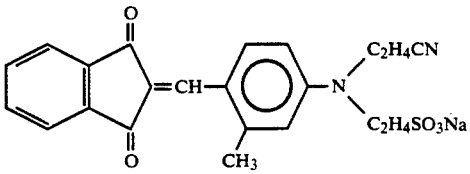

-continued

II-27

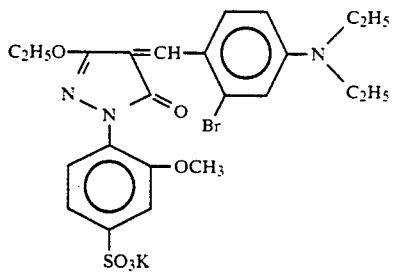

The dyes represented by formula (II) can be easily synthesized by the method described in JP-A-51-3623.

The dyes shown by formula (III) are described in detail below.

The aryl group represented by $Ar_1$ and $Ar_2$ is preferably phenyl or naphthyl which may be substituted [e.g., a sulfonic acid group, a carboxylic acid group, a hydroxy group, an alkyl group having from 1 to 6 carbon atoms (e.g., methyl, ethyl, n-propyl, and isopropyl), an alkoxy group having from 1 to 6 carbon atoms (e.g., methoxy, ethoxy, and butoxy), a carbamoyl group, a sulfamoyl group, a halogen atom (e.g., fluorine, chlorine, bromine), a cyano group, and a nitro group].

The heterocyclic group represented by $Ar_1$ and $Ar_2$ is preferably a 5- or 6-membered nitrogen-containing heterocyclic group and examples thereof are 1-(4-sulfophenyl)-3-carboxy-5-hydroxy-4-pyrazolyl, 1-(4-sulfophenyl)-3-methyl-5-hydroxy-4-pyrazolyl, 1-(2,5-disulfophenyl)-3-carboxy-5-hydroxy-4-pyrazolyl, 1-(2,5-disulfophenyl)-3-carboxy-5-hydroxy-4-pyrazolyl, 1-carboxymethyl-3-carbamoyl-1,2-dihydro-6-hydroxy-4-methyl-2-oxopyridine, 1-(2-sulfoethyl)-3-cyano-1,2-dihydro-6-hydroxy-4-methyl-2-oxopyridine, etc.

Specific examples of the dyes represented by formula (III) are shown below but the invention is not to be construed as being limited to these dyes.

III-1

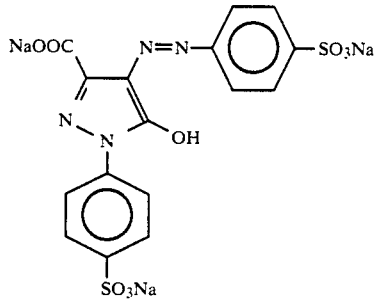

III-2

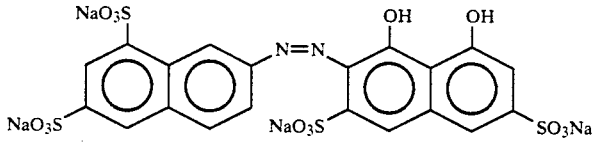

III-3

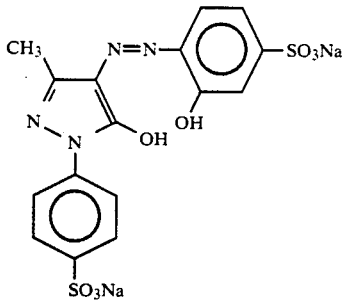

III-4

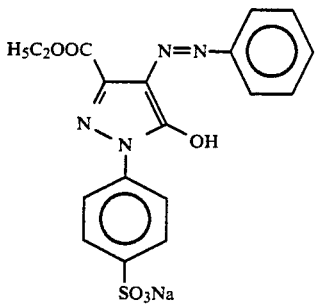

-continued
III-5
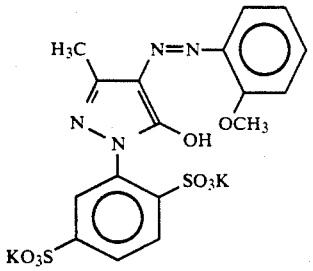
III-6
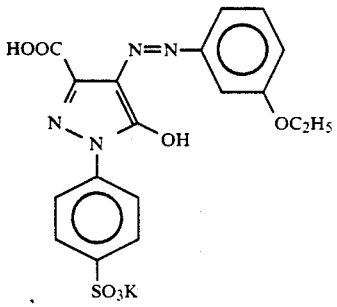
III-7
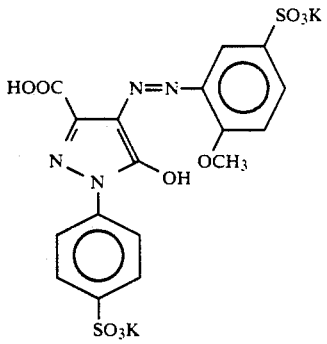
III-8
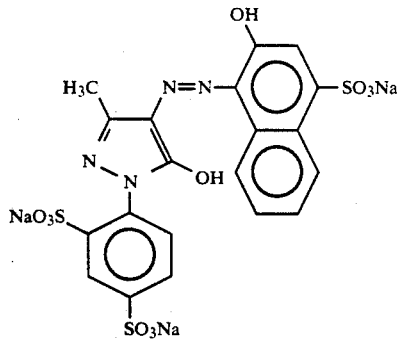
III-9
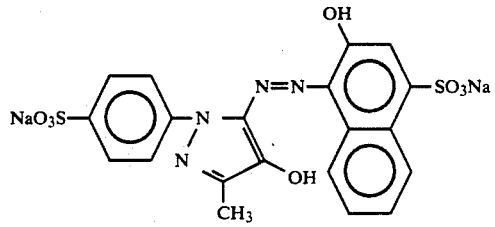

-continued
III-10
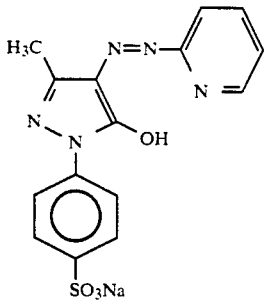
III-11
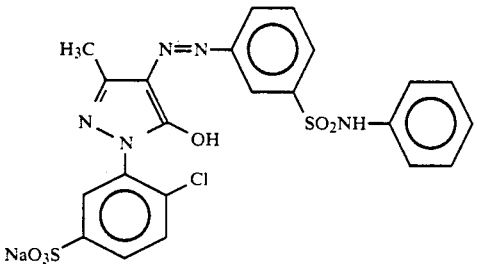
III-12
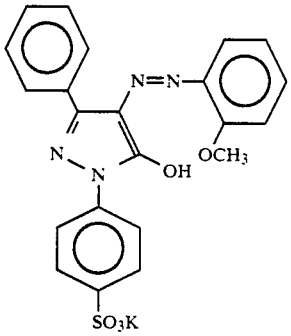
III-13
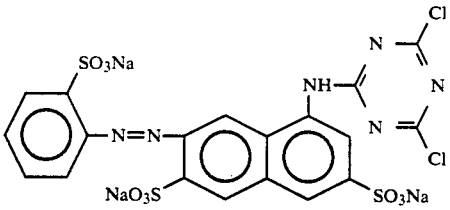
III-14
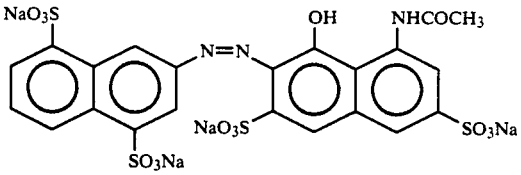
III-15
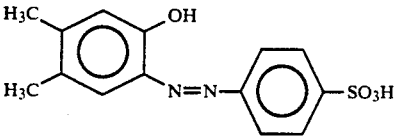

-continued
III-16
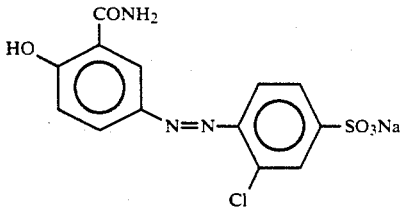
III-17
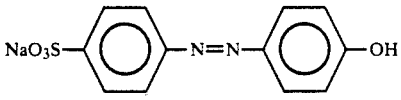
III-18
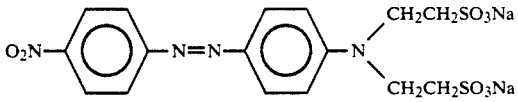
III-19
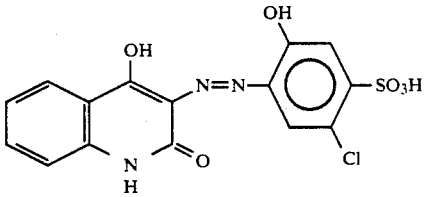
III-20
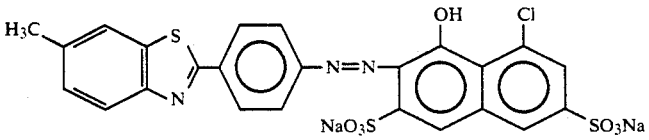
III-21
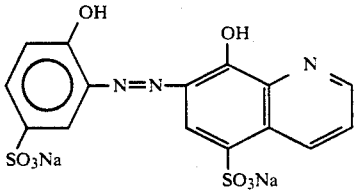
III-22
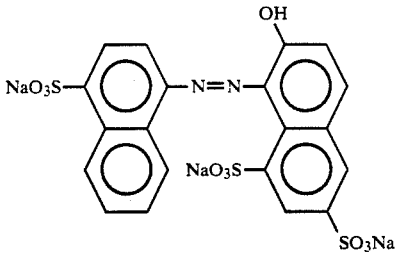
III-23
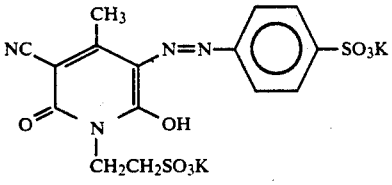
III-24
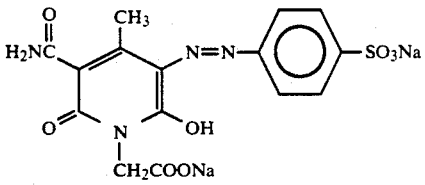

-continued

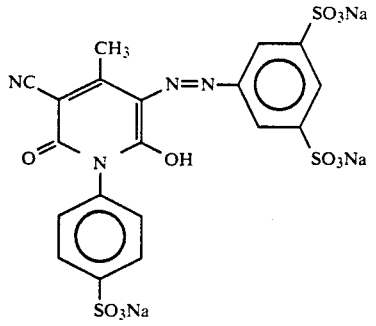

III-25

The dyes represented by formula (III) can be synthesized by the method described in British Patents 575,691, 907,125 and 1,353,525.

Specific examples of the dyes shown by formula (IV) are illustrated below but the invention is not to be construed as being limited to these dyes.

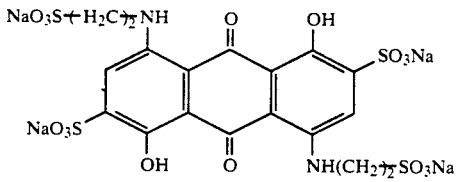

N-1

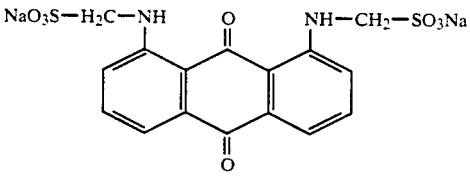

N-2

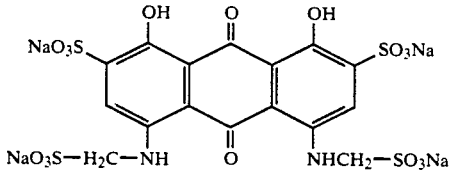

N-3

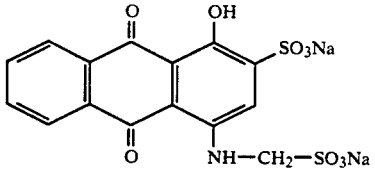

N-4

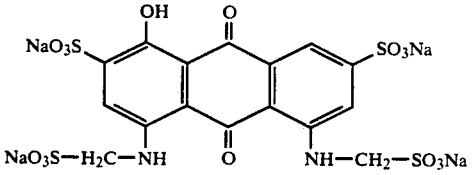

N-5

-continued

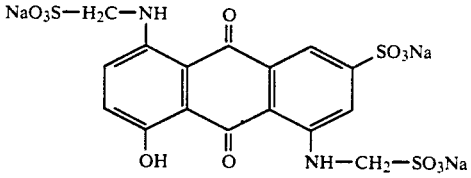

N-6

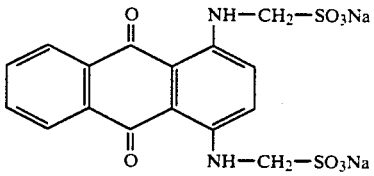

N-7

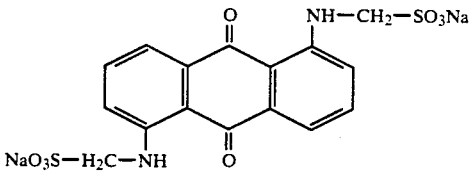

N-8

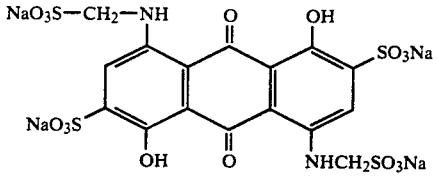

N-9

The dyes represented by formula (IV) can be synthesized by the method described in U.S. Pat. No. 2,865,752.

Specific examples of the dyes represented by formula (V) are illustrated below but the invention is not to be construed as being limited to these dyes.

V-1
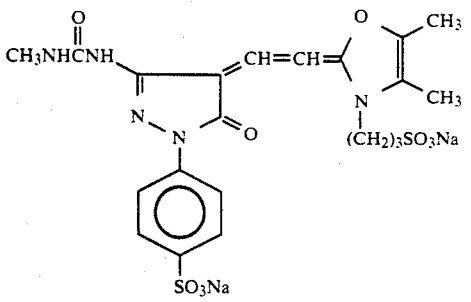
V-2
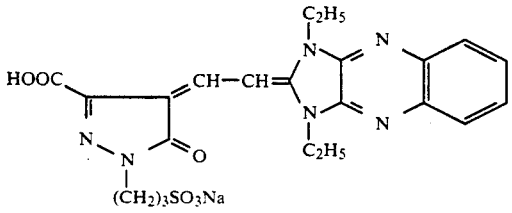
V-3
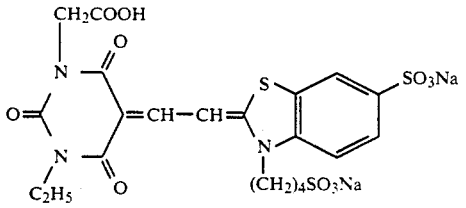
V-4
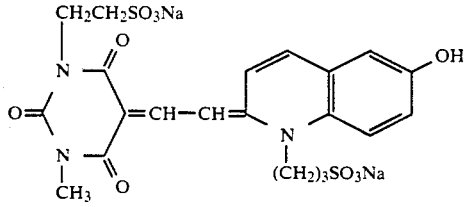
V-5
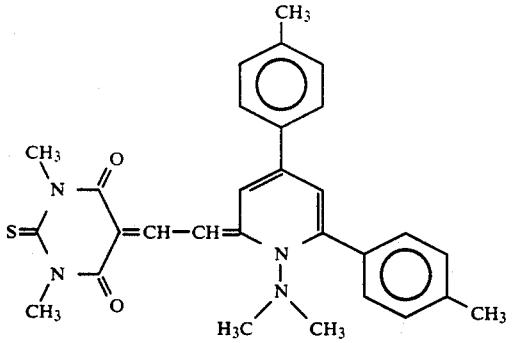
V-6
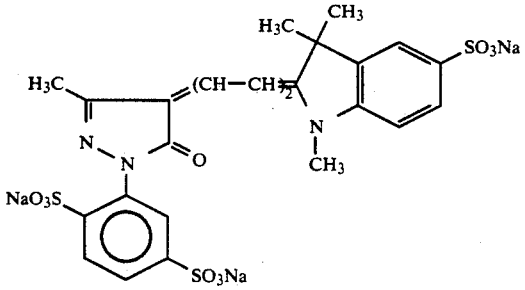

-continued
V-7
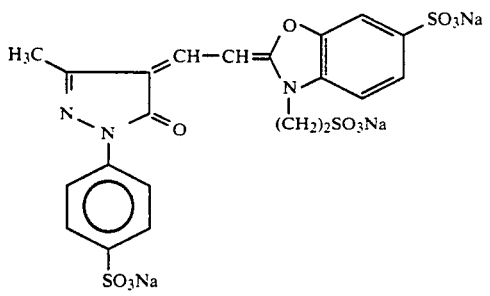
V-8
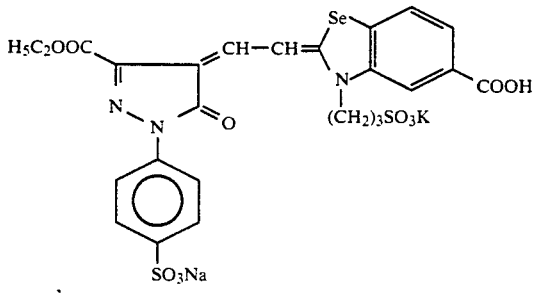
V-9
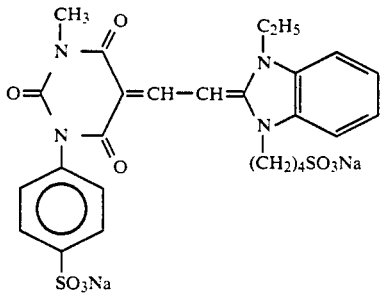
V-10
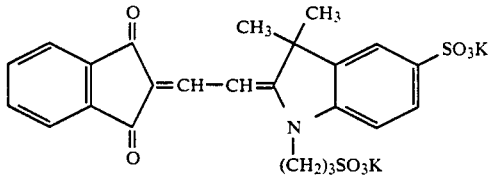
V-11
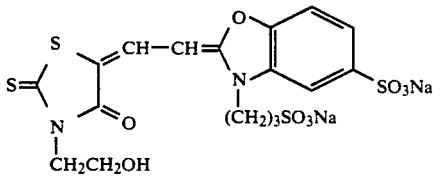
V-12
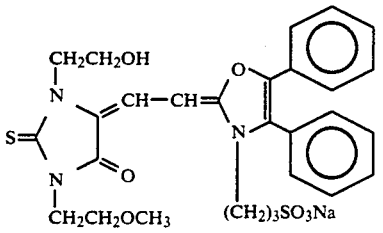

-continued
V-13
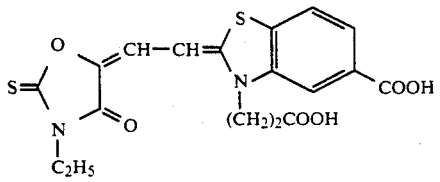
V-14
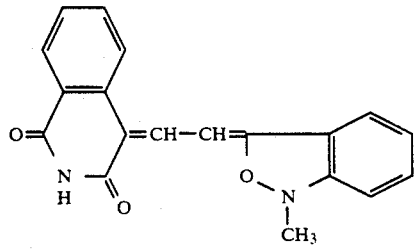
V-15
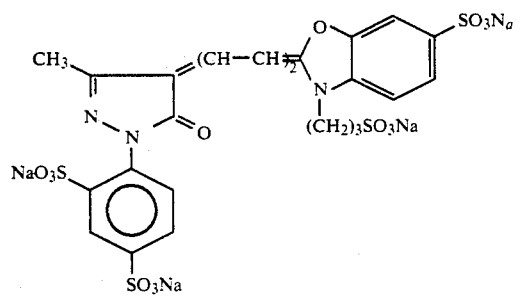
V-16
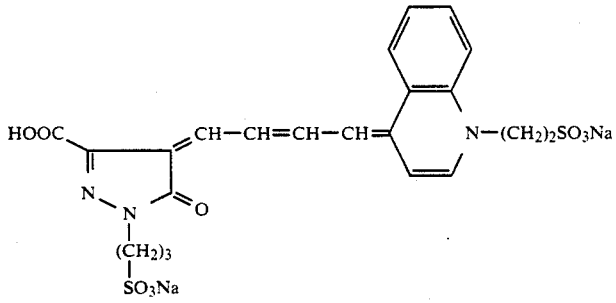
V-17
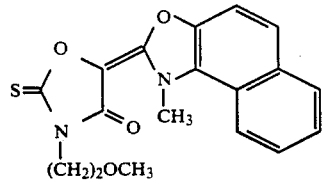
V-18
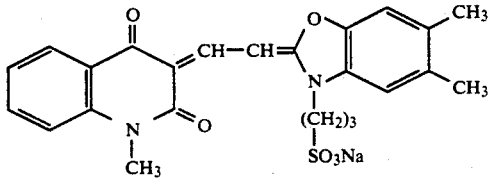
V-19
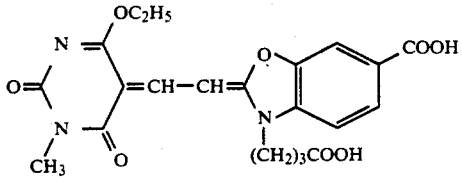

-continued
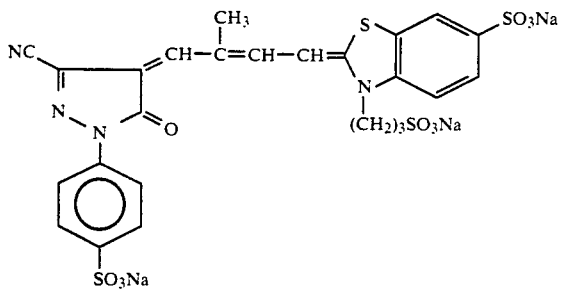
V-20
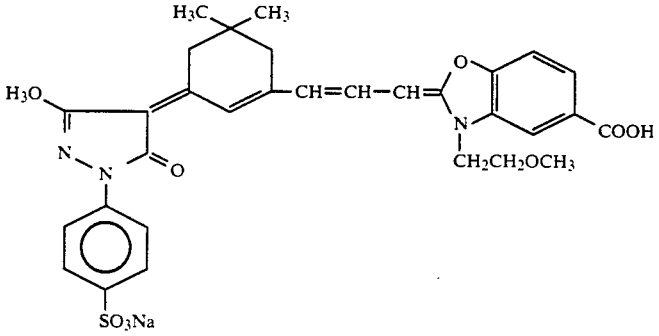
V-21
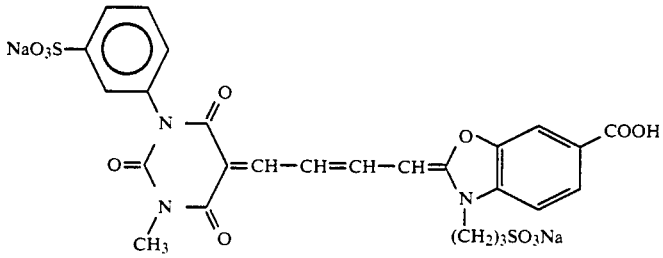
V-22
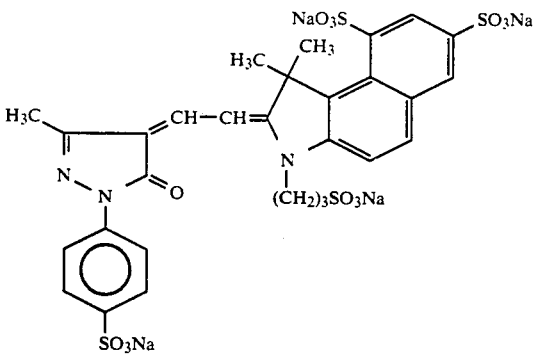
V-23
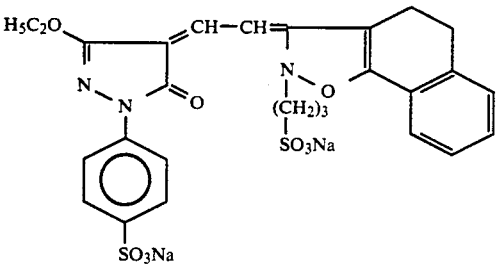
V-24

-continued
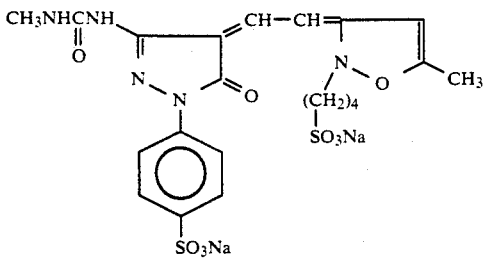
V-25
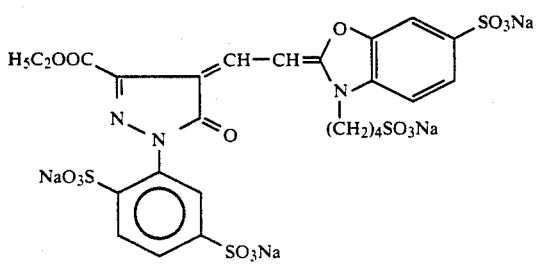
V-26
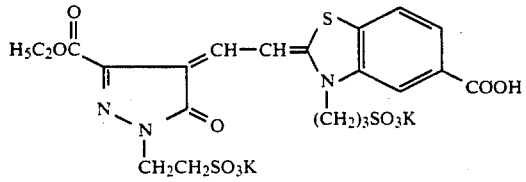
V-27
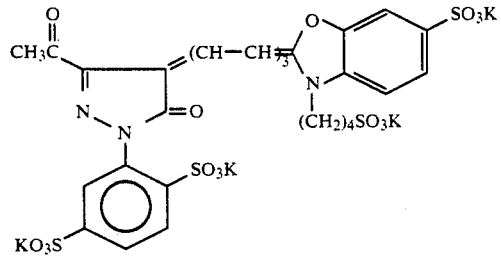
V-28
Specific examples of the dyes represented by formula (VI) are shown below but the invention is not to be construed as being limited to these dyes.
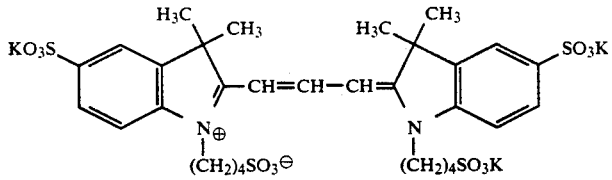
VI-1
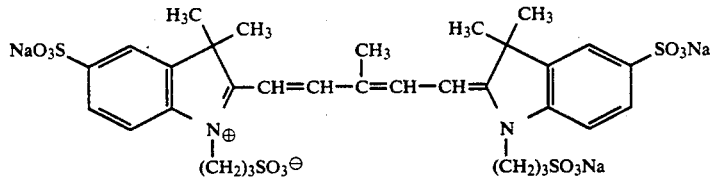
VI-2
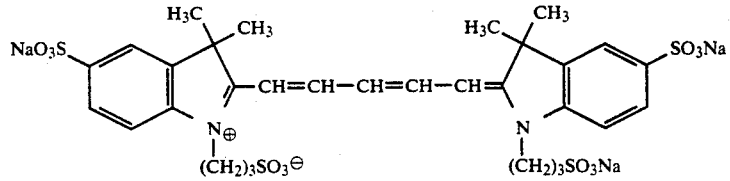
VI-3

-continued
VI-4
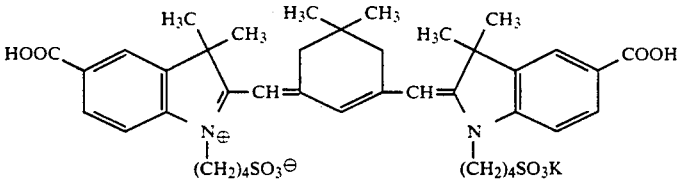
VI-5
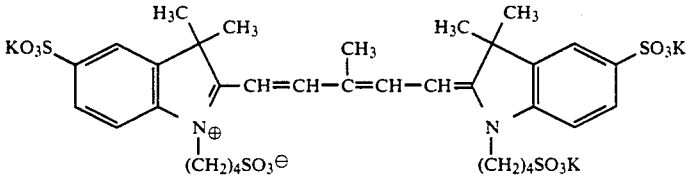
VI-6
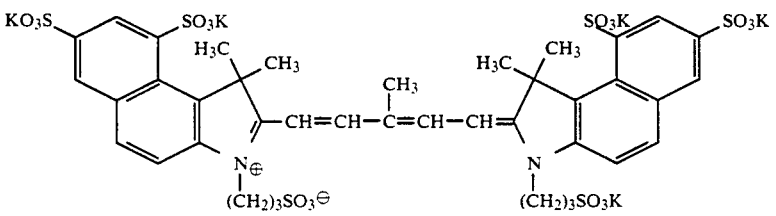
VI-7
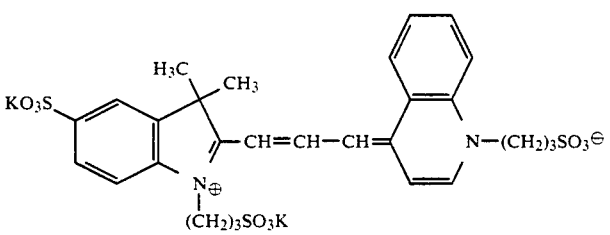
VI-8
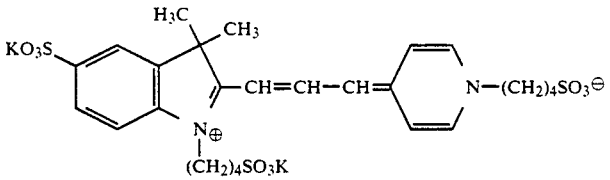
VI-9
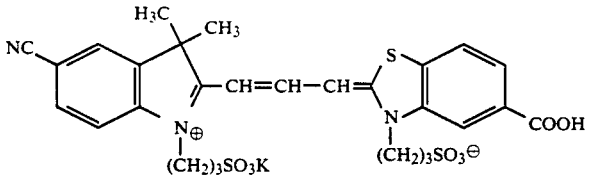
VI-10
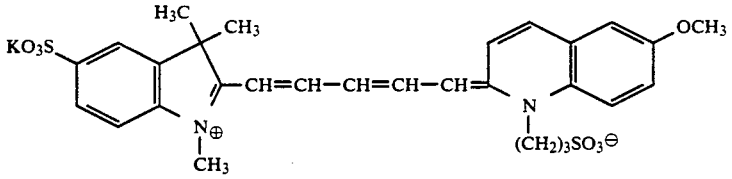
VI-11
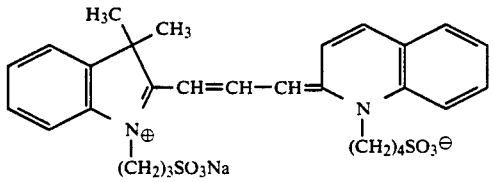

-continued

VI-12

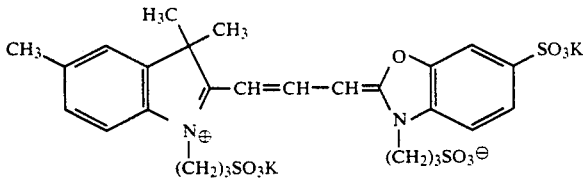

VI-13

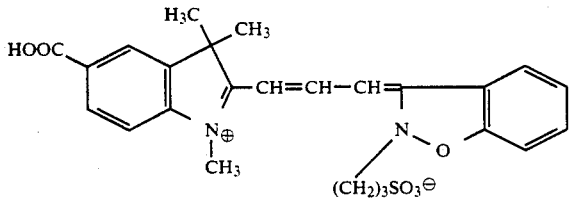

VI-14

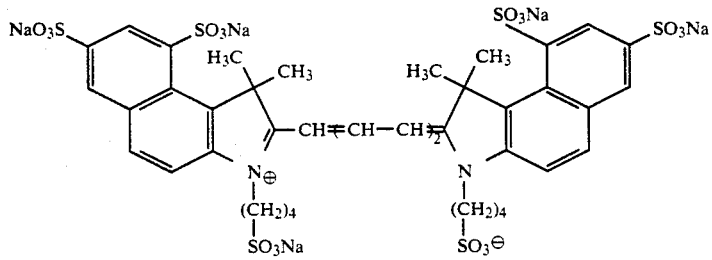

The color photographic light-sensitive material of this invention is formed by coating at least one blue-sensitive silver halide emulsion layer, at least one green-sensitive silver halide emulsion layer, and at least one red-sensitive silver halide emulsion layer on a support. In a conventional color photographic paper, the silver halide emulsion layers are formed on the support in the order as described above but this order may be changed, if desired. The light-sensitive emulsion layers each contains a silver halide emulsion having a sensitivity to the wavelength region set forth and each dye present is in a complementary color relationship to the light to which the emulsion is sensitive, that is, so-called yellow color coupler to blue, magenta color coupler to green, or cyan color coupler to red, thereby color reproduction by the substractive color process can be achieved.

The mean grain size (number mean value of grain sizes as diameters of circles having areas equivalent to the projected areas of the grains) of the silver halide grains present in the silver halide emulsion for use in this invention is preferably from 0.1 μm to 2 μm.

Also, the silver halide emulsion is preferably a so-called monodisperse emulsion wherein the variation coefficient (the standard deviation of the grain size divided by the mean grain size) of the grain size distribution is 20% or less, and preferably 15% or less. In this case, it is preferred for broad tolerance to use the above-described monodisperse emulsion as a blend in a same layer or as two layers.

The silver halide emulsion for use in this invention can contain various multivalent metal ion impurities in the grain formation step or the physical ripening step.

Examples of such compound are salts of cadmium, zinc, lead, copper, thallium, etc., and salts or complex salts of metals belonging to the group VIII of the periodic table, such as iron, ruthenium, palladium osmium, iridium, platinum, etc. The amount of the compound added can vary widely depending on purpose but is preferably from $1\times10^{-9}$ to $1\times10^{-2}$ mol per mol of silver halide.

The silver halide emulsion for use in this invention is usually subjected to a chemical sensitization and a spectral sensitization.

A sulfur sensitization such as the addition of an unstable sulfur compound, a noble metal sensitization such as a gold sensitization, and a reduction sensitization can be used alone or as a combination thereof to achieve chemical sensitization.

Compounds which can be used for chemical sensitization are preferably those described in JP-A-62-215272, pages 18–22.

Spectral sensitization is employed to achieve spectral sensitivity in a desired wavelength region for the silver halide emulsion of each emulsion layer of the color photographic light-sensitive material of this invention. It is preferred to perform the spectral sensitization by adding a spectral sensitizing dye absorbing light of the wavelength region corresponding to the desired spectral sensitivity in this invention.

Suitable spectral sensitizing dyes used in this case are preferably the dyes shown above as CR compounds but other dyes as described in F. M. Harmer, *Heterocyclic Compounds—Cyanine Dyes and Related Compounds*, John Wiley & Sons, [New York, London, 1964] can be also used. Specific preferred compounds and spectral sensitization methods are described in JP-A-62-215272, pages 22–38.

The silver halide emulsion for use in this invention can contain various compounds or the precursors thereof for stabilizing photographic properties or for inhibiting the formation of fog during production, storage, or photographic processing of the photographic light-sensitive material. Specific examples of preferred compounds are described in JP-A-62-215272, pages 39 to 72.

The silver halide emulsion for use in this invention may be a so-called surface latent image type emulsion forming latent images mainly on the surface of the silver halide grains or a so-called internal latent image type emulsion forming latent images mainly in the inside of the grains.

A yellow coupler, a magenta coupler, and a cyan coupler, each forming yellow, magenta, and cyan colors, respectively by coupling with the oxidation product of an aromatic amine color developing agent are usually used in the color photographic light-sensitive material of this invention.

Cyan couplers, magenta couplers, and yellow couplers which can be advantageously used in this invention are those represented by following formulae (C-I), (C-II), (M-I), (M-II), and (Y).

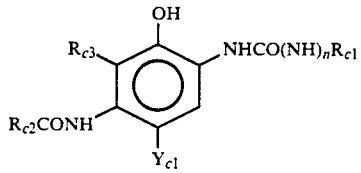
(C-I)

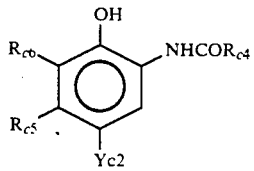
(C-II)

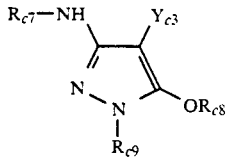
(M-I)

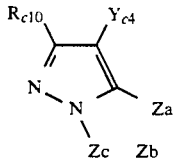
(M-II)

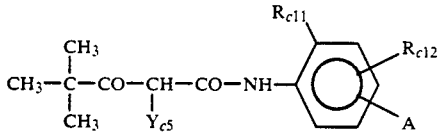
(Y)

In formulae (C-I) and (C-II), $R_{c1}$, $R_{c2}$, and $R_{c4}$ each represents a substituted or unsubstituted aliphatic group, a substituted or unsubstituted aromatic group, or a substituted or unsubstituted heterocyclic group; $R_{c3}$, $R_{c5}$, and $R_{c6}$ each represents a hydrogen atom, a halogen atom, an aliphatic group, an aromatic group, or an acylamino group, said $R_{c3}$ may represent a non-metallic atomic group forming with $R_{c2}$ a nitrogen-containing 5- or 6-membered ring; $Y_{c1}$ and $Y_{c2}$ each represents a hydrogen atom or a group capable of being released on coupling with the oxidation product of a color developing agent; and n represents 0 or 1.

$R_{c5}$ in formula (C-II) is preferably an aliphatic group such as, for example, methyl, ethyl, propyl, butyl, pentadecyl, tert-butyl, cyclohexyl, cyclohexylmethyl, phenylthiomethyl, dodecyloxyphenylthiomethyl, butaneamidomethyl, and methoxymethyl.

Preferred embodiments of cyan coupler represented by formula (C-I) or (C-II) are as follows.

In formula (C-I), $R_{c1}$ is preferably an aryl group or a heterocyclic group and is more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

In formula (C-I), when $R_{c3}$ and $R_{c2}$ do not form a ring, $R_{c2}$ is preferably a substituted or unsubstituted alkyl group or a substituted or unsubstituted aryl group and particularly preferably a substituted aryloxy-substituted alkyl group. $R_{c3}$ is preferably a hydrogen atom.

In formula (C-II), $R_{c4}$ is preferably a substituted or unsubstituted alkyl group or a substituted or unsubstituted aryl group and is particularly preferably a substituted aryloxy-substituted alkyl group.

In formula (C-II), $R_{c5}$ is preferably an alkyl group having from 2 to 15 carbon atoms or a methyl group having a substituent having 1 or more carbon atoms and preferred examples of substituents are an arylthio group, an alkylthio group, an acylamino group, an aryloxy group, and an alkyloxy group.

In formula (C-II), $R_{c5}$ is more preferably an alkyl group having from 2 to 15 carbon atoms, and is particularly preferably an alkyl group having from 2 to 4 carbon atoms.

In formula (C-II), $R_{c6}$ is preferably a hydrogen atom or a halogen atom and is particularly preferably chlorine or fluorine.

In formulae (C-I) and (C-II), $Y_{c1}$ and $Y_{c2}$ each is preferably a hydrogen atom, a halogen atom, an alkoxy group, an aryloxy group, an acyloxy group, or a sulfonamido group.

In formula (M-I), $R_{c7}$ and $R_{c9}$ each represents an aryl group; $R_{c8}$ represents a hydrogen atom, an aliphatic acyl group, an aromatic acyl group, an aliphatic sulfonyl group, or an aromatic sulfonyl group; and $Y_{c3}$ represents a hydrogen atom or a releasable group.

The substituent for the aryl group (preferably phenyl) represented by $R_{c7}$ and $R_{c9}$ is same as the substituent for $R_{c1}$ described above and when the aryl group has two or more substituents, they may be the same or different.

$R_{c8}$ is preferably a hydrogen atom, an aliphatic acyl group or an aliphatic sulfonyl group, and particularly preferably a hydrogen atom.

$Y_{c3}$ is preferably a group released by sulfur, oxygen, or nitrogen and the sulfur atom-releasing type couplers s described in U.S. Pat. No. 4,351,897 and PCT WO 88/04795 are particularly preferred.

In formula (M-II), $R_{c10}$ represents a hydrogen atom or a substituent; $Y_{c4}$ represents a hydrogen atom or a releasable group, and is particularly preferably a halogen atom or an arylthio group; Za, Zb, and Zc each represents a methine group or a substituted methine group, =N—, or —NH—; one of the Za—Zb bond and the Zb—Zc bond is a double bond and the other is a single bond. When the Zb—Zc bond is a carbon-carbon double bond, the double bond is a part of an aromatic ring. Also, the compound of the formula includes a dimer or higher polymers formed at $R_{c10}$ or $Y_{c4}$ or when Za, Zb, or Zc is a substituted methine group.

In the pyrazoloazole series couplers represented by formula (M-II), the imidazo[1,2-b]pyrazoles described in U.S. Pat. No. 4,500,630 are preferred and pyrazolo[1,5-b][1,2,4]triazole described in U.S. Pat. No. 4,540,654 is particularly preferred from the standpoint less yellow side absorption and the light fastness of colored dyes formed.

Furthermore, pyrazolotriazole couplers having a branched alkyl group directly bonded to the 2-, 3-, or 6-position of the pyrazolotriazole ring as described in JP-A-61-65245, pyrazoloazole couplers having a sulfon amido group in the molecule as described in JP-A-61-65246, pyrazoloazole couplers having an alkoxyphenylsulfonamide ballast group as described in JP-A-61-147254, and pyrazolotriazole couplers having an alkoxy group or an aryloxy group at the 6-position as described in European Patent Applications (unexamined published) 226,849 and 294,785 are preferably used.

In formula (Y), $R_{c11}$ represents a halogen atom, an alkoxy group, a trifluoromethyl group, or an aryl group; $R_{c12}$ represents a hydrogen atom, a halogen atom, or an alkoxy group: A represents $—NHCOR_{c13}$, $—NHSO_2—R_{13}$, $—SO_2NHR_{c13}$, $—COOR_{c13}$, or $$—SO_2N(R_{c14})—R_{c13}$$

(wherein $R_{c13}$ and $R_{c14}$ each represents an alkyl group, an aryl group, or an acyl group); $Y_{c5}$ represents a releasable group.

The substituents for $R_{c12}$, $R_{c13}$, and $R_{c14}$ are the same as the substituents described above for $R_{c1}$ and the releasable group shown by $Y_{c5}$ is preferably of a type released by oxygen or nitrogen, and a nitrogen atom-releasing type is particularly preferred.

Specific examples of the couplers represented by formulae (C-I), (C-II), (M-I), (M-II), and (Y) are illustrated below but the invention is not to be constructed as being limited to these dyes.

(C-1)

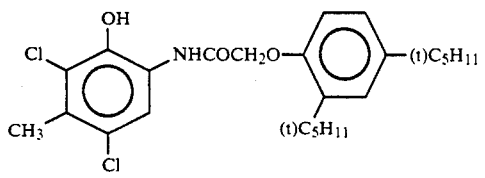

(C-2)

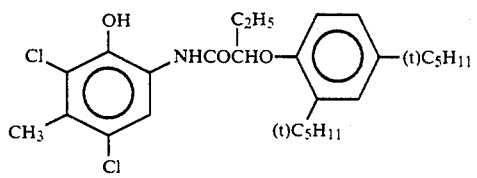

(C-3)

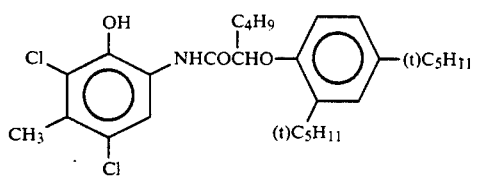

(C-4)

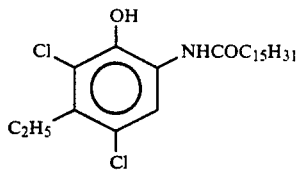

(C-5)

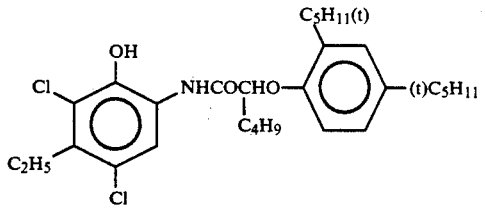

(C-6)

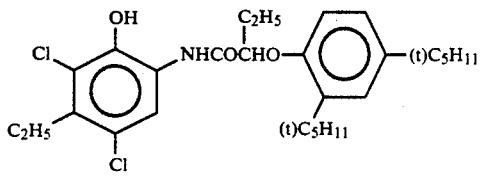

-continued
(C-7)
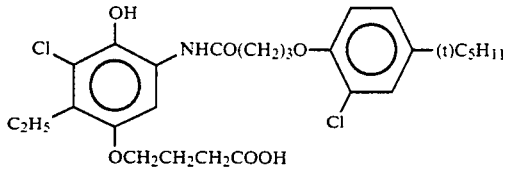
(C-8)
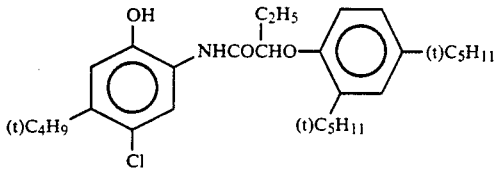
(C-9)
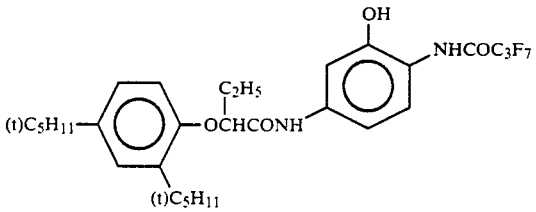
(C-10)
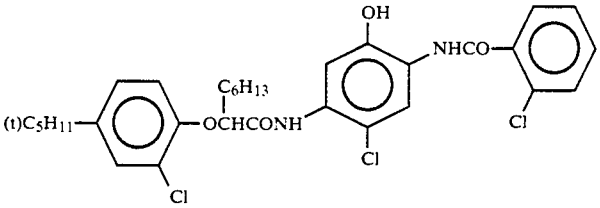
(C-11)
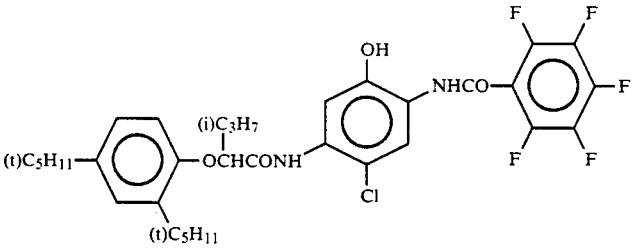
(C-12)
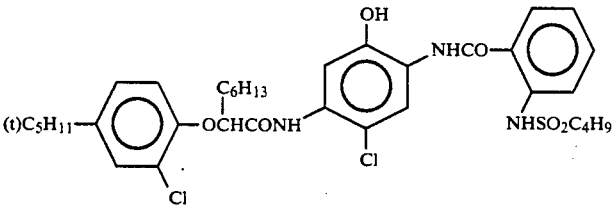
(C-13)
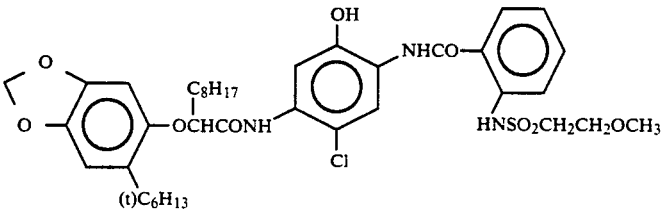

-continued
(C-14)
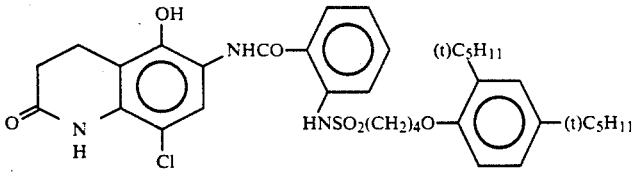
(C-15)
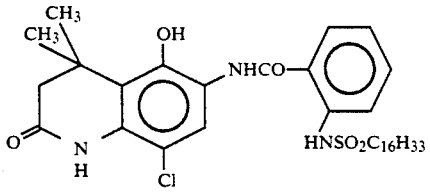
(C-16)
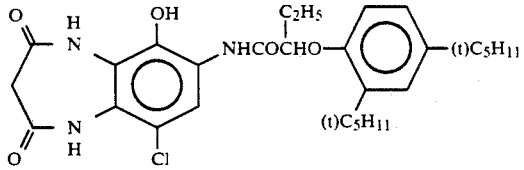
(C-17)
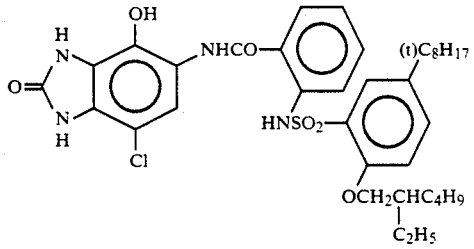
(C-18)
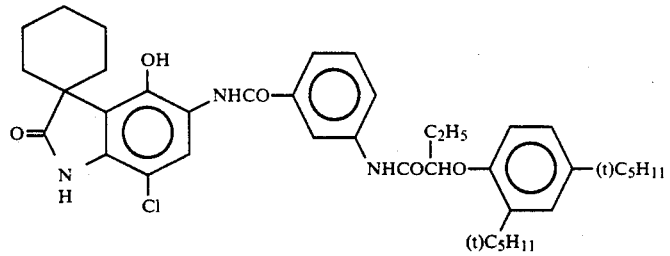
(C-19)
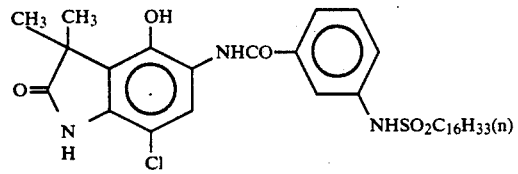
(C-20)
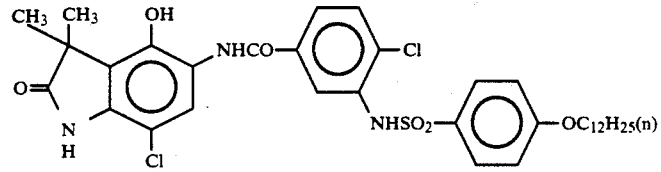

-continued
(C-21)
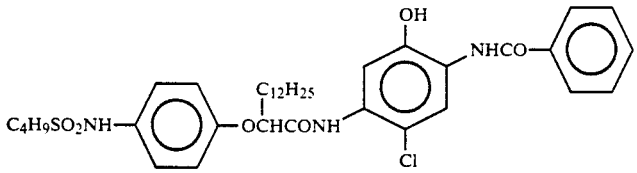
(C-22)
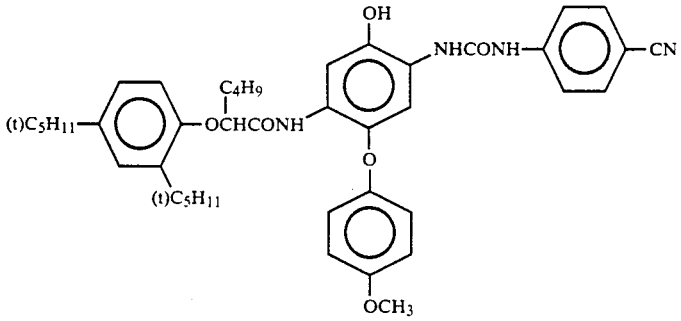
(M-1)
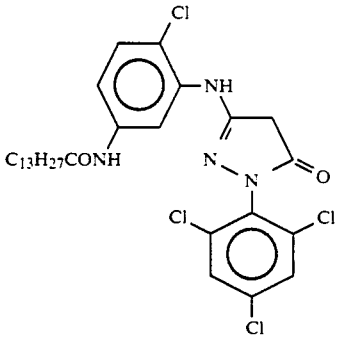
(M-2)
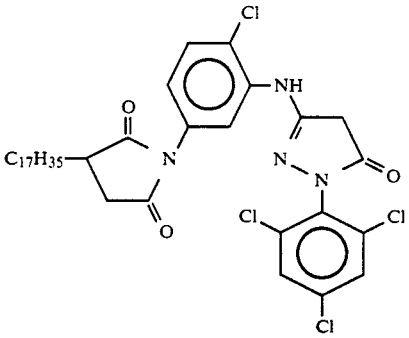
(M-3)
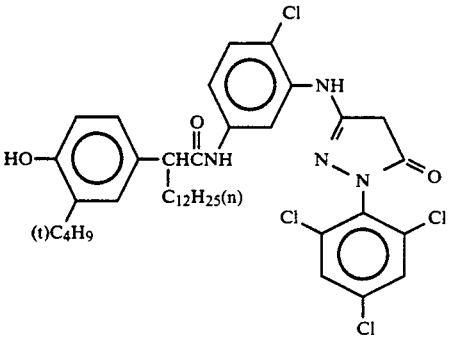

-continued
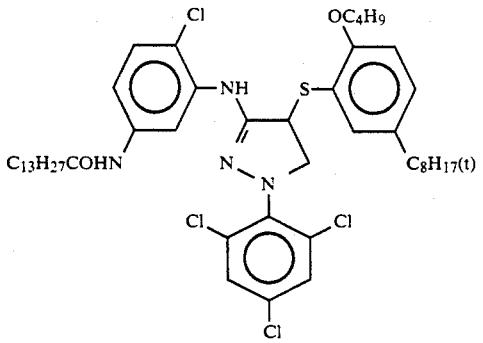
(M-4)
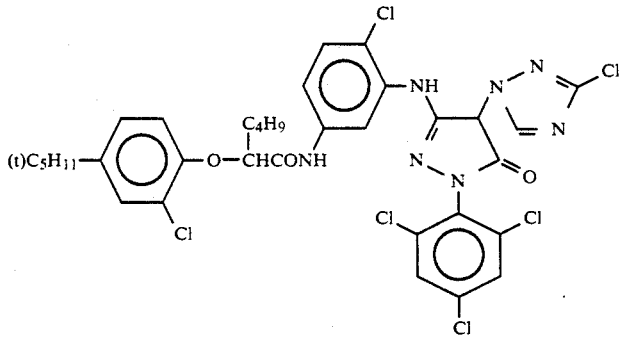
(M-5)
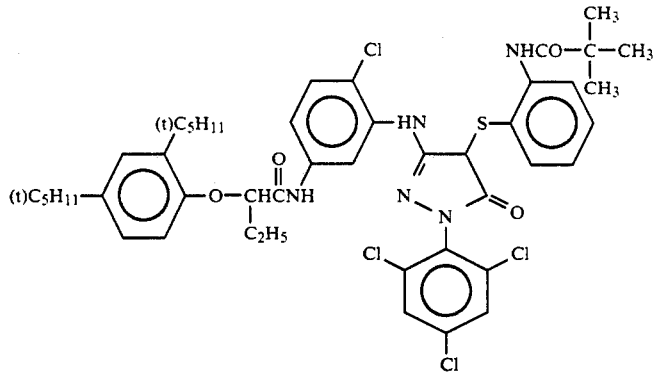
(M-6)
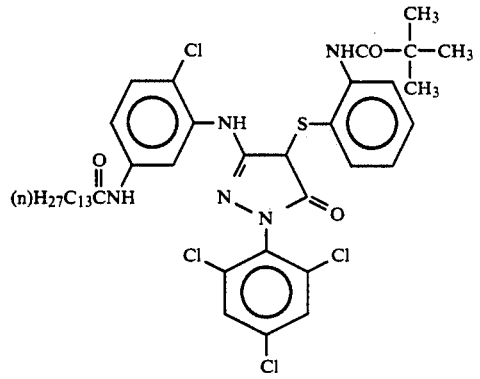
(M-7)

-continued
(M-8)
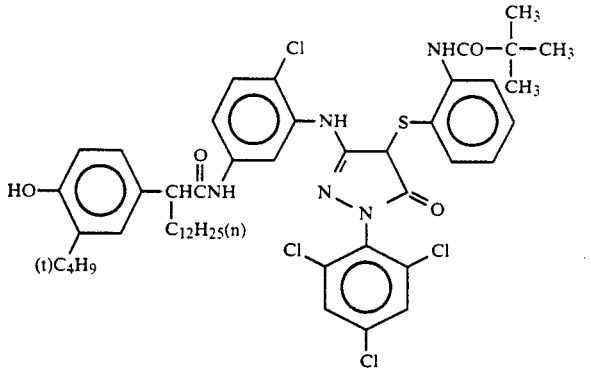

| Compound | $R_{c10}$ | $R_{c15}$ | $Y_{c4}$ |
|---|---|---|---|
| | | 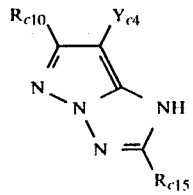 | |
| M-9 | $CH_3$— | 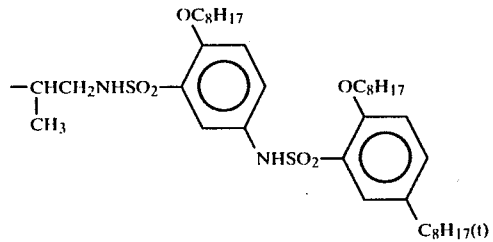 | Cl |
| M-10 | " | 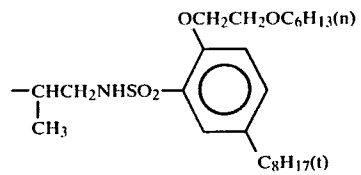 | " |
| M-11 | $(CH_3)_3C$— | 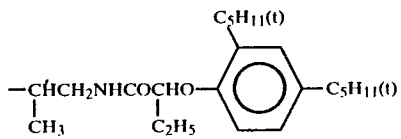 | 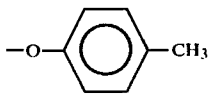 |
| M-12 | 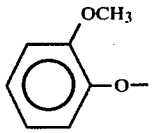 | 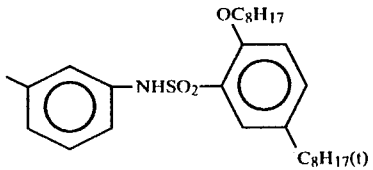 | 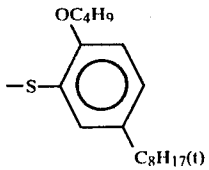 |

-continued
| Compound | $R_{c10}$ | $R_{c15}$ | $Y_{c4}$ |
|---|---|---|---|
| M-13 | $CH_3$— | 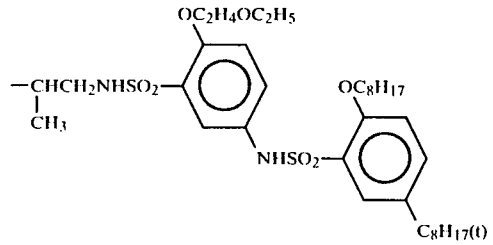 | Cl |
| M-14 | " | 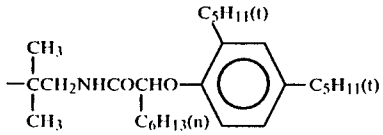 | " |
| M-15 | $CH_3$— | 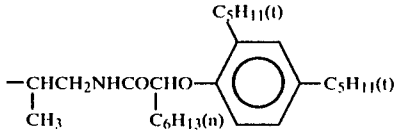 | Cl |
| M-16 | " | 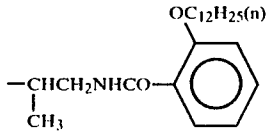 | " |
| M-17 | " | 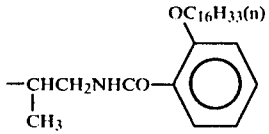 | " |

-continued
| Compound | $R_{c10}$ | $R_{c15}$ | $Y_{c4}$ |
|---|---|---|---|
| M-18 | 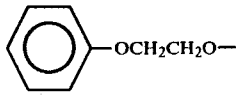 | 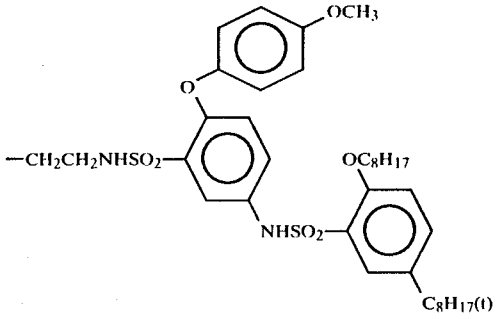 | 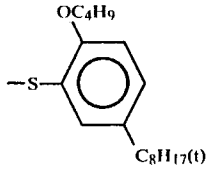 |
| M-19 | $CH_3CH_2O-$ | " | " |
| M-20 | 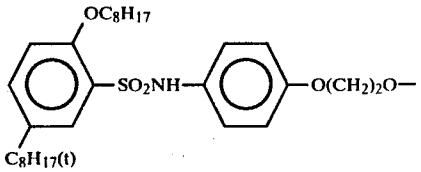 | 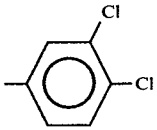 | 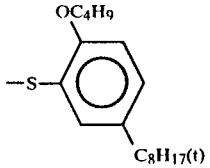 |
| M-21 | 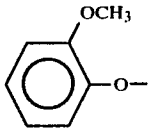 | 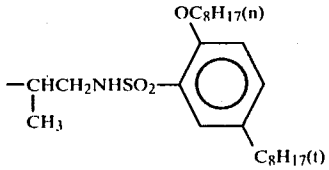 | Cl |
| | 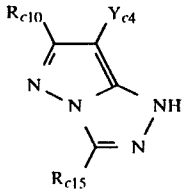 | | |
| M-22 | $CH_3-$ | 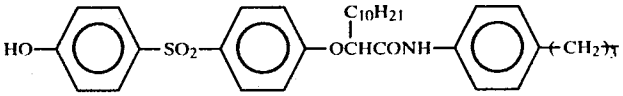 | Cl |

-continued
| Compound | $R_{c10}$ | $R_{c15}$ | $Y_{c4}$ |
|---|---|---|---|
| M-23 | " | 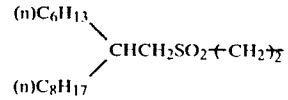 | " |
| M-24 | 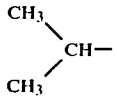 | 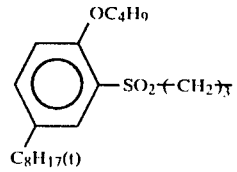 | " |
| M-25 | 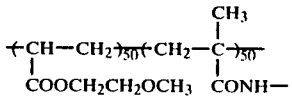 | 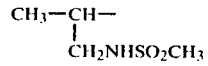 | " |
| M-26 | 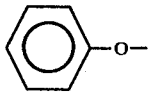 | 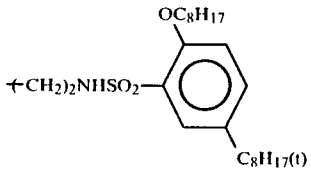 | Cl |
| M-27 | $CH_3$— | 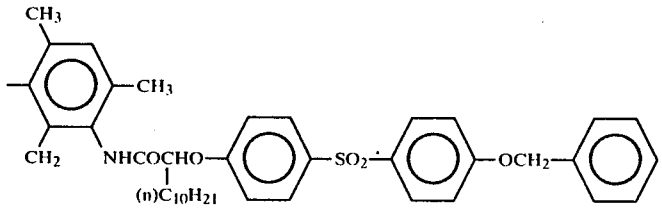 | " |
| M-28 | $(CH_3)_3C$— | 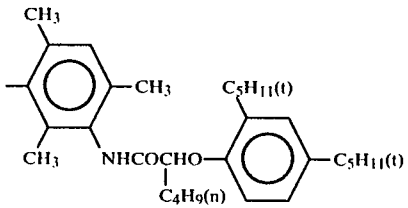 | " |

-continued
| Compound | $R_{c10}$ | $R_{c15}$ | $Y_{c4}$ |
|---|---|---|---|
| M-29 | 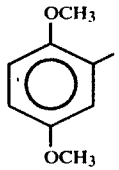 | 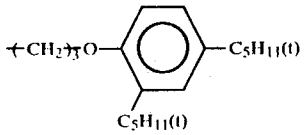 | Cl |
| M-30 | $CH_3-$ | $-CH(C_2H_5)-N(n\text{-}C_{18}H_{37})COCH_2CH_2COOH$ | " |

(Y-1)
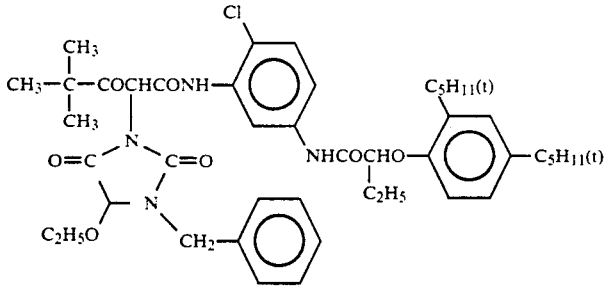
(Y-2)
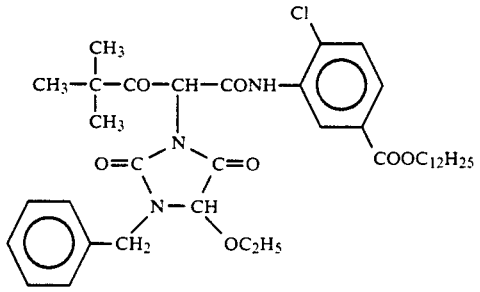
(Y-3)
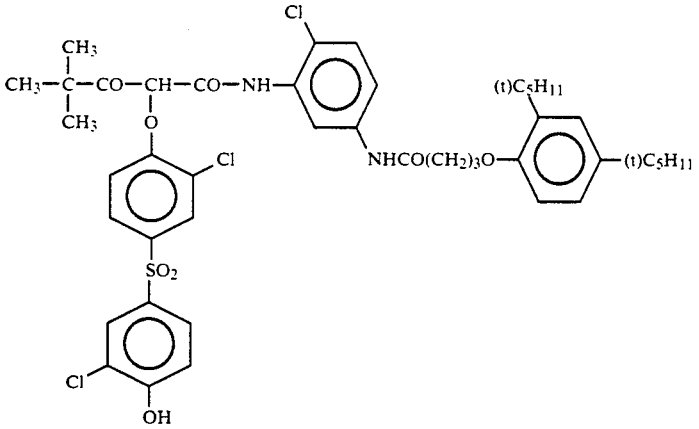
(Y-4)
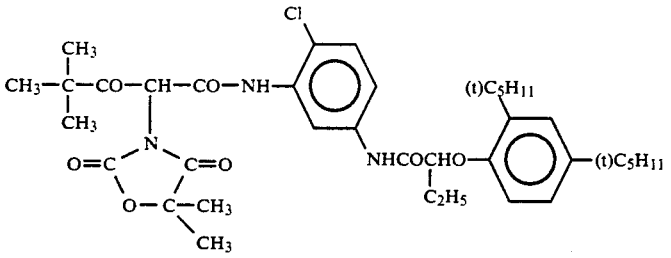
(Y-5)
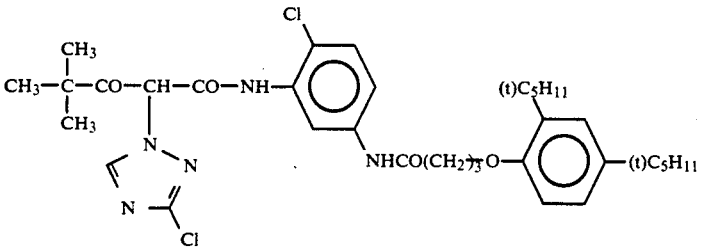

-continued (Y-6)

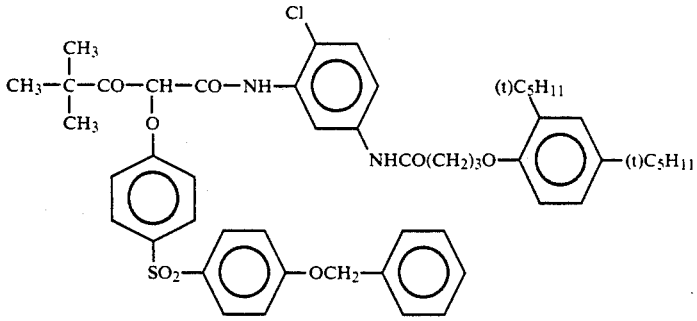

(Y-7)

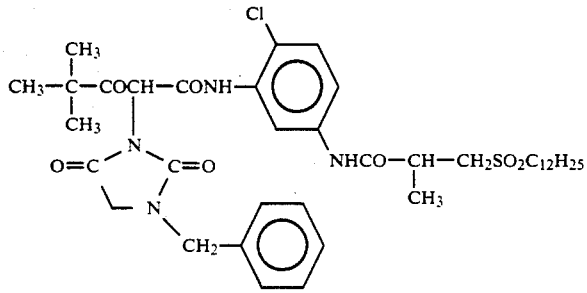

(Y-8)

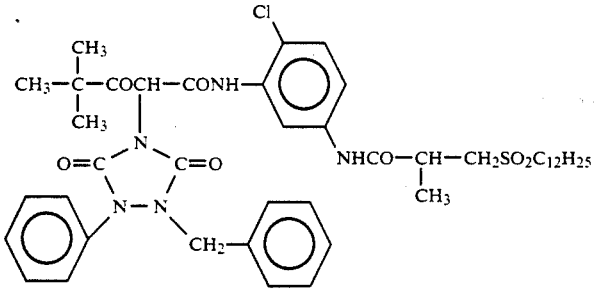

(Y-9)

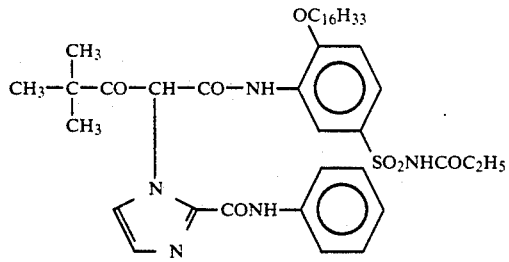

Each of the couplers represented by formulae (C-I) to (Y) is incorporated in a silver halide emulsion of each light-sensitive emulsion layer in an amount of from 0.1 to 1.0 mol, and preferably from 0.1 to 0.5 mol per mol of silver halide.

Various known techniques can be employed to add the aforesaid coupler to a silver halide emulsion in this invention.

Usually, the coupler is added by an oil drop-in-water dispersion method known as an oil protect method. More specifically, after dissolving the coupler in an organic solvent, the solution is dispersed by emulsification in an aqueous gelatin solution containing a surface active agent. Alternatively, water or an aqueous gelatin solution is added to a coupler solution containing a surface active agent and then an oil in-water dispersion is formed by phase inversion.

Also, when the coupler is alkali soluble, the coupler can be dispersed using the so-called a Fischer dispersion method. Also, after removing a low-boiling organic solvent from the coupler dispersion by distillation, noodle washing or ultrafiltration, the dispersion may be mixed with a silver halide emulsion.

The dispersion medium for such a coupler can be a high-boiling organic solvent having a dielectric constant of from 2 to 20 (25° C.) and a refractive index of from 1.5 to 1.7 (25° C.) and/or a water-insoluble polymer.

Preferred examples of high-boiling organic solvents are the high-boiling organic solvents represented by following formulae (A) to (E).

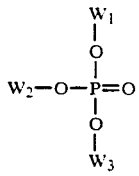

(A)

$W_1-COO-W_2$ (B)

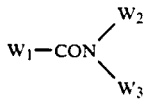

(C)

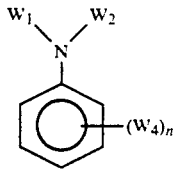

(D)

$W_1-O-W_2$ (E)

wherein $W_1$, $w_2$, and $W_3$ each represents an alkyl group, a cycloalkyl group, an alkenyl group, an aryl group, or a heterocyclic group, and each group may be substituted; $W_4$ represents $W_1$, $OW_1$ or $S-W_1$; and n represents an integer of from 1 to 5, when n is 2 or more, the $W_4$s may be the same or different, and in formula (E), $W_1$ and $W_2$ may form together a condensed ring.

Other high-boiling organic solvents than those represented by formulae (A) to (E), which have a melting point of lower than 100° C., a boiling point of higher than 140° C., are immiscible with water, and are a good solvent for coupler, can be used in this invention. The melting point of the high-boiling organic solvent is preferably lower than 80° C. and the boiling point of the high-boiling organic solvent is preferably higher than 160° C., and more preferably higher than 170° C.

Details of these high-boiling organic solvents are described in JP-A-62-215272, page 137, lower right column to page 144, upper right column.

The coupler can be also dispersed by emulsification in an aqueous hydrophilic colloid solution by impregnation into a loadable latex (e.g., U.S. Pat. No. 4,203,716) with the coupler in the presence of or the absence of the above-described high-boiling organic solvent or by dissolving the coupler in a polymer which is insoluble in water but soluble in an organic solvent.

The homopolymer or copolymer described in PCT WO 88/00723, pages 12–30 is preferably used and in particular, an acrylamide series polymer is preferably used from the standpoint of color image stabilization.

The color photographic light-sensitive material of this invention may further contain a hydroquinone derivative, an aminophenol derivative, a gallic acid derivative, an ascorbic acid derivative, etc., as a color fog inhibitor.

Various fading inhibitors can be used in for the color photographic light-sensitive material of this invention. More specifically, examples of organic fading inhibitors for cyan, magenta and/or yellow images are hydroquinones, 6-hydroxychromans, 5-hydroxycoumarans, spirochromans, p-alkoxyphenols, hindered phenols such as bisphenols, gallic acid derivatives, methylenedioxybenzenes, aminophenols, hindered amines, and the ether or ester derivatives obtained by silylating or alkylating the phenolic hydroxy groups of the aforesaid compounds. Also, metal complexes such as (bis-salicylaldoxymato(nickel complex and (bis-N,N-dialkyldithiocarbamato)nickel complex can be also used.

Specific examples of organic fading inhibitors are described in the following patent specifications.

That is, hydroquinones are described in U.S. Pat. Nos. 2,360,290, 2,418,613, 2,700,453, 2,701,197, 2,728,659, 2,732,300, 2,735,765, 3,982,944, and 4,430,425, British Patent 1,365,921, and U.S. Pat. Nos. 2,710,801 and 2,816,028; 6-hydroxychromans, 5-hydroxycoumarans, and spirochromans are described in U.S. Pat. Nos. 3,432,300, 3,573,050, 3,574,627, 3,698,909, and 2,764,337, and JP-A-52-152225; spiroindanes are described in U.S. Pat. No. 4,360,589; p-alkoxyphenols are described in U.S. Pat. No. 2,735,765, British Patent 2,066,975, JP-A-59-10539, and JP-B-57-19765; hindered phenols are described in U.S. Pat. Nos. 3,700,455 and 4,228,235, JP-A-52-72224, and JP-B-52-6623; gallic acid derivatives, methylenedioxybenzenes, and aminophenols are described in U.S. Pat. Nos. 3,457,079 and 4,332,886, JP-B-56-21144; hindered amines are described in U.S. Pat. Nos. 3,336,135 and 4,268,593, British Patents 1,326,889, 1,354,313, and 1,410,846, JP-B-51-1420, JP-A-58-114036, JP-A-59-53846, and JP-A-59-78344; and metal complexes are described in U.S. Pat. Nos. 4,050,938 and 4,241,155 and British Patent 2,027,731(A).

The above-described compound can achieve the purpose thereof by co-emulsifying the compound with the corresponding color coupler in an amount of from 5 to 100% by weight to the coupler and adding the mixture to the light-sensitive emulsion layer. An ultraviolet absorbent can be incorporated into the cyan coloring layer and layers adjacent on both sides thereof for inhibiting the deterioration of cyan dye images by heat and, in particular, light.

Examples of ultraviolet absorbents which can be used in this invention are benzotriazole compounds substituted by an aryl group described, e.g., in U.S. Pat. No. 3,533,794, 4-thiazolidone compounds described, e.g., in U.S. Pat. Nos. 3,314,794 and 3,352,681, benzophenone compounds described, e.g., in JP-A-46-2784, cinnamic acid ester compounds described, e.g., in U.S. Pat. Nos. 3,705,805 and 3,707,395, butadiene compounds described, e.g., in U.S. Pat. Nos. 4,045,229, and benzoxidol compounds described, e.g., in U.S. Pat. Nos. 3,406,070, 3,677,672, and 4,271,307.

An ultraviolet absorptive coupler (e.g., α-naphtholic cyan dye-forming coupler) and an ultraviolet absorptive polymer can be used. The ultraviolet absorbent may be mordanted to a specific layer, if desired.

The aforesaid benzotriazole compounds substituted by an aryl group are preferred of the above-described compounds.

Also, it is particularly preferred to use the following compound together with the above-described color coupler. In particular, use with a pyrazoloazole coupler is preferred.

More specifically, the use of a compound (F) which reacts with an aromatic amine developing agent remaining after color development processing to form a chemically inactive and substantially colorless compound and/or a compound (G) which reacts with the oxidation product of an aromatic amine color developing agent remaining after color development processing to form a chemically inactive and substantially colorless compound is preferred for preventing the occurrence of stain due to the formation of colored dye by the reaction of a color developing agent or the oxidation product thereof remaining in the layers during storage after processing and the occurrence of other side reaction.

A preferred compound (F) is a compound reacting with p-anisidine at a secondary reaction rate constant $k_2$ (in trioctyl phosphate at 80° C.) in the range of from 1.0 liter/mol·sec. to $1\times10^{-5}$ liter/mol·sec. In addition, the secondary reaction rate constant can be measured by the method described in JP-A-63-158545.

If $k_2$ is larger than the aforesaid range, the compound itself becomes unstable and sometimes the compound is decomposed by reacting with gelatin and water. On the other hand, if $k_2$ is less than the above range, the reaction with a remaining aromatic amine developing agent is delayed, and sometimes the compound does not prevent the occurrence of side actions of the remaining aromatic amino developing agent.

Preferred examples of the compound (F) are represented by following formula (FI) or (FII):

$$R_1-(A)_n-X \quad \text{(FI)}$$

$$R_2-\underset{\underset{B}{|}}{C}=Y \quad \text{(FII)}$$

wherein $R_1$ and $R_2$ each represents an aliphatic group, an aromatic group, or a heterocyclic group; n represents 0 or 1; A represents a group capable of reacting with an aromatic amine developing agent to form a chemical bond; X represents a group released on a reaction with an aromatic amine developing agent; B represents a hydrogen atom, an aliphatic group, an aromatic group, a heterocyclic group, an acyl group, or a sulfonyl group; and Y represents a group accelerating the addition of an aromatic amine developing agent to the compound of formula (FII), and $R_1$ and X or Y and $R_2$ or B may combine with each other to form a ring structure.

In the system of reaction with a remaining aromatic amine developing agent, a replacement reaction and an addition reaction are typical reaction.

Specific examples of preferred compounds represented by formulae (FI) and (FII) are described in JP-A-63-15845, JP-A-62-283338, European Patent Applications (unexamined published) 298,321 and 277,589.

Moreover, preferred examples of the compound (G) which undergoes a reaction with the oxidation product of an aromatic amine developing agent remaining after color development processing to form a chemically inactive and substantially colorless compound can be represented by following formula (GI):

$$R-Z \quad \text{(GI)}$$

wherein R represents an aliphatic group, an aromatic group or a heterocyclic group and Z represents a nucleophilic group or a group capable of being decomposed in a photographic light-sensitive material to release a nucleophilic group. In the compound shown by formula (GI), Z is preferably a group having a Pearson's nucleophilic $^nCH_3I$ value (R. G. Pearson et al, *Journal of American Chemical Society,* 90, 319(1968)) of at least 5 or a group derived from this group.

Specific examples of preferred compounds represented by formula (GI) are described in European Patent Application (unexamined published) 255,722, JP-A-62-143048, JP-A-62-229145, Japanese Patent Applications 63-136724 and 62-214681, European Patent Applications (unexamined published) 298,321 and 277,589.

Details of the combination of the above-described compound (G) and compound (F) are described in European Patent Application (unexamined published) 277,589.

Suitable examples of binders or protective colloids which can be used for the emulsion layers of the photographic light-sensitive material of this invention include advantageously gelatin but other hydrophilic colloids can be also used alone or together with gelatin.

In this invention, the gelatin may be lime gelatin or acid-treated gelatin. The details of the production of gelatin are described in Arther Vaise, *The Macromolecular Chemistry of Gelatin,* published by Academic Press, 1964.

Examples of reflective supports which can be used in this invention include a support having a surface of diffusion reflective metal of second kind. The metal surface preferably has a spectral reflectance in the visible wavelength region of at least 0.5 and also it is preferred that the metal surface is rendered diffusion reflective by surface roughening or using a metal powder. Examples of metals include aluminum, tin, silver, magnesium, or alloys thereof and the surface of the support can be the surface of a metal plate, a metal foil, or a thin metal layer obtained by rolling, vapor deposition, or plating. In particular, it is preferred to form a thin metal layer by vapor-deposition of a metal on another support base material.

It is preferred to form a layer of a waterproof resin, in particular, a thermoplastic resin, on the surface of the metal. Also, it is preferred that an antistatic layer is formed on the opposite side of the support to the side having the metal surface. The details of such a support are described in JP-A-61-210346, JP-A-63-24247, JP-A-63-24251, and JP-A-63-24255.

These supports may be suitably selected depending on the purpose of the material.

The color photographic light-sensitive material of this invention is preferably subjected to a color development, a bleach-fix (blix), and wash processing (or stabilization processing). The bleach and fix may be conducted separately, if desired.

The color developer which can be used in this invention contains an aromatic primary amine color developing agent. Preferred examples are p-phenylenediamine derivatives and specific examples thereof are shown below although the invention is not limited to them.

D-1: N,N-Diethyl-p-phenylenediamine
D-2: 2-Amino-5-diethylaminotriene
D-3: 2-Amino-5-(N-ethyl-N-laurylamino)toluene
D-4: 4-[N-Ethyl-N-(β-hydroxyethyl)amino]aniline
D-5: 2-Methyl-4-[N-ethyl-N-(β-hydroxyethyl-)amino]aniline
D-6: 4-Amino-3-methyl-N-ethyl-N-[β-(methanesulfonamido)ethyl]aniline
D-7: N-(2-Amino-5-diethylaminophenylethyl)methanesulfonamide
D-8: N,N-Dimethyl-p-phenylenediamine
D-9: 4-Amino-3-methyl-N-ethyl-N-methoxyethylaniline
D-10: 4-Amino-3-methyl-N-ethyl-N-β-ethoxyethylaniline D-11: 4-Amino-3-methyl-N-ethyl-N-β-butoxyethylaniline Of the above-described p-phenylenediamine derivatives, 4-amino-3-methyl-N-ethyl-N-[β-(methanesulfonamido)-ethyl]aniline (Compound D-6) is particularly preferred.

Also, the p-phenylenediamine derivatives may be used in the form of salts such as the sulfates, hydrochlorides, sulfites, p-toluenesulfonates thereof.

The amount of the aromatic primary amine developing agent is preferably from about 0.1 g to about 20 g, and more preferably from about 0.5 g to about 10 g per liter of a color developer.

It is preferred to use a color developer containing substantially no benzyl alcohol for processing the color photographic light-sensitive material of this invention. In this invention, the term "containing substantially no benzyl alcohol" means that the developer contains not more than 2 ml/liter, and preferably not more than 0.5 ml/liter of benzyl alcohol, and most preferably no benzyl alcohol.

It is more preferred for the color developer to be used in this invention substantially not to contain sulfite ion. Sulfite ion functions as a preservative for a color developing agent and, at the same time, functions to dissolve silver halide and functions to decrease the dye-forming efficiency by reacting with the oxidation product of a color developing agent. These functions are considered to be one of the reasons that photographic characteristics deviate with continuous processing. In this case, the term "does not substantially contain sulfite ion" means that the concentration of a sulfite ion is preferably less than $3.0\times10^{-3}$ mol/liter and most preferably no sulfite ion is present.

However, in this invention, the presence of a very small amount of sulfite ion which is used for preventing oxidation of the processing agent in a kit in which a color developing agent is concentrated before preparing the processing solution for use is excluded.

It is preferred that the color developer for use in this invention does not substantially contain sulfite ion as described above but it is more preferred that the color developer does not substantially contain hydroxylamine. This is because hydroxylamine has the function of a preservative for a color developing agent and, at the same time, has a silver development activity by itself. Thus, changes in the concentration of hydroxylamine greatly influences the photographic characteristics. The term "does not substantially contain hydroxylamine" as used in this invention means that the concentration of hydroxylamine is preferably less than $5.0\times10^{-3}$ mol/liter, and most preferably no hydroxylamine is present.

It is more preferred for the color developer for use in this invention to contain an organic preservative in place of above-described hydroxylamine or sulfite ion.

In this case, an organic preservative means organic compounds capable of reducing the deterioration rate of an aromatic primary amine color developing agent.

More specifically, the organic preservatives are organic compounds having the function of preventing the aerial oxidation of a color developing agent. Examples of particularly effective organic preservatives are hydroxylamine derivatives (excluding hydroxylamine), hydroxamic acids, hydrazines, hydrazides, phenols, α-hydroxyketones, α-aminoketones, saccharide, monoamines, diamines, polyamines, quaternary ammonium salts, nitroxyradicals, alcohols, oximes, diamide compounds, and condensed cyclic amines. These compounds are disclosed in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, and JP-A-63-44656, U.S. Pat. Nos. 3,615,503 and 2,494,903, JP-A-52-143020, and JP-B-48-30496.

Furthermore, the color developer may, if desired, contain various kinds of metals described in JP-A-57-44148 and JP-A-57-53749, salicylic acids described in JP-A-59-180588, alkanolamines described in JP-A-54-3532, polyethyleneimines described in JP-A-56-94349, or aromatic polyhydroxy compounds described in U.S. Pat. No. 3,746,544 as other preservatives.

In particular, the addition of alkanolamines such as triethanolamine, etc., dialkylhydroxylamines such as diethylhydroxylamine, hydrazine derivatives, or aromatic polyhydroxy compounds is preferred.

Of the above-described organic preservatives, hydroxylamine derivatives and hydrazine derivatives (hydrazines and hydrazides) are particularly preferred and the details thereof are described in Japanese Patent Applications 62-255270, 63-9713, 63-9714, and 63-11300.

Also, the use of the above-described hydroxylamine derivative or hydrazine derivative together with an amine is more preferred from the standpoint of improving the stability of the color developer and improving the stability of continuous processing.

Examples of suitable amines are cyclic amines as described in JP-A-63-239447, the amines described in JP-A-63-128340, and the amines described in Japanese Patent Applications 63-9713 and 63-11300.

In this invention, it is preferred for the color developer to contain chloride ion in an amount of from $3.5\times10^{-2}$ to $1.5\times10^{-1}$ mol/liter, and particularly from $4\times10^{-2}$ to $1\times10^{-1}$ mol/liter. If the concentration of chloride ion is more than $1.5\times10^{-1}$ mol/liter, development is delayed, which is not preferred for attaining the objects of this invention of providing a high maximum density by rapid processing. Also, if the chloride ion concentration is less than $3.5\times10^{-2}$ mol/liter this is undesirable from the standpoint of inhibiting the formation of fog.

In this invention, it is preferred for the color developer to contain bromide ion in an amount of from $3.0\times10^{-5}$ to $1.0\times10^{-3}$ mol/liter, and more preferably from $5.0\times10^{-5}$ to $5\times10^{-4}$ mol/liter. If the bromide ion concentration is more than $1\times10^{-3}$ mol/liter, development is delayed and the maximum density and the sensitivity are lowered, while a concentration of less than $3.0\times10^{-5}$ mol/liter means formation of fog cannot sufficiently prevented.

The chloride ion and the bromide ion can be directly added to the color developer or may be dissolved out in the color developer from the color photographic light-sensitive material during development processing.

In the case of direct addition of the chloride ion and the bromide ion to the color developer, examples of chloride ion sources are sodium chloride, potassium chloride, ammonium chloride, lithium chloride, nickel chloride, magnesium chloride, manganese chloride, calcium chloride, and cadmium chloride. Of these materials, sodium chloride and potassium chloride are preferred.

Also, chloride ion may be supplied from an optical whitening agent added to the color developer.

Examples of bromide ion sources are sodium bromide, potassium bromide, ammonium bromide, lithium bromide, calcium bromide, magnesium bromide, manganese bromide, nickel bromide, cadmium bromide, cerium bromide, and thallium bromide. Of these materials potassium bromide and sodium bromide are preferred.

In the case where these ions are dissolved from the photographic light-sensitive material during development processing, the chloride ion and the bromide ion may be supplied from the silver halide emulsion layers or other layers.

The pH of the color developer for use in this invention is preferably from 9 to 12, and more preferably from 9 to 11.0. Also, the color developer can further contain other known developer components.

For maintaining the above-described pH, it is preferred to use various buffers. Examples of suitable buffers are carbonates, phosphates, borates, tetraborates, hydroxybenzoates, glycyl salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salt, proline salts, trishydroxyaminomethane salts, lysine salts, etc. In particular, carbonates, phosphates, tetraborates and hydroxybenzoates have excellent solubility and also a buffer capacity in the high pH region of at least 9.0, do not adversely influences (formation of fog, etc.) the photographic properties when they are added to the color developer and are inexpensive. Thus, the use of these buffers is particularly preferred in this invention.

Specific examples of suitable preferred buffers are sodium carbonate, potassium carbonate, sodium hydrogencarbonate, potassium hydrogencarbonate, trisodium phosphate, tripotassium phosphate, di-sodium phosphate, di-potassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the invention is not limited to them.

The amount of the buffer present in the color developer is preferably at least 0.1 mol/liter, and more preferably from 0.1 mol/liter to 0.4 mol/liter.

Moreover, the color developer can contain various chelating agents as precipitation inhibitors for calcium and magnesium or to improve the stability of the color developer. Examples of suitable chelating agents are nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, ethylenedimine orthohydroxyphenylacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid.

These chelating agents may be, if desired, used as a mixture of two or more.

The amount of the chelating agent is that sufficient for blocking metal ions in the color developer and preferably 0.1 g to 10 g per liter of the developer.

The color developer for use in this invention can contain, if desired, a development accelerator.

Examples of development accelerators are thioether compounds described in JP-B-37-16088, JP-B-37-5987, JP-B-38-7826, JP-B-44-12380 and JP-B-45-9019, and U.S. Pat. No. 3,813,247, p-phenylenediamine series compounds described in JP-A-52-49829 and JP-A-50-15554, quaternary ammonium salts described in JP-A-50-137726, JP-B-44-30074, JP-A-56-156826, and JP-A-52-43429, amine series compounds described in U.S. Pat. Nos. 2,494,903, 3,128,182, 4,230,796, 3,253,919, JP-B-41-11431, U.S. Pat. Nos. 2,482,546, 2,596,926, and 3,582,346, polyalkylene oxides described in JP-B-37-16088 and JP-B-42-25201, U.S. Pat. Nos. 3,128,183 and 3,532,501, and JP-B-41-11431 and JP-B-42-23883, and further 1-phenyl-3-pyrazolidones, imidazoles, etc.

In this invention, the color developer, if desired, may contain an optional antifoggant. Examples of antifoggants are alkali metal halides such as sodium chloride, potassium bromide, potassium iodide, etc., and organic antifoggants. Examples of organic antifoggants are nitrogen-containing heterocyclic compounds such as benzotriazole, 6-nitrobenzimidazole, 5-nitroindazole, 5-methylbenzotriazole, 5-nitrobenzotriazole, 5-chlorobenzotriazole, 2-thiazolyl-benzimidazole, 2-thiazolylmethyl-benzimidazole, indazole, hydroxyazaindedne, and adenine.

It is preferred for the color developer for use in this invention to contain an optical whitening agent.

4,4'-Diamino-2,2'-disulfostilbene series compounds are preferred as the optical whitening agent. The amount thereof used is from 0 to 5 g/liter, and preferably from 0.1 to 4 g/liter.

Also, if desired, the color developer may further contain various surface active agents such as alkylsulfonic acids, arylsulfonic acids, aliphatic carboxylic acids, aromatic carboxylic acids, etc.

The processing temperature of the color developer employed in this invention is from 20° to 50° C., and preferably from 30° to 40° C. The processing time is from 20 seconds to 5 minutes, and preferably from 30 seconds to 2 minutes.

The replenishing amount is preferably as small as possible but can be from 20 to 600 ml, and preferably from 0 to 300 ml, more preferably from 60 to 200 ml, and most preferably from 60 to 150 ml.

Subsequently, a desilvering step is employed in this invention.

For the desilvering step, a bleach step-fix step, a fix step-blix step, a bleach step-blix step, a blix step, etc., can be used.

The bleach solution, the blix solution, and the fix solution used in this invention are explained below.

Bleaching agents which can be used for the bleach solution or the blix solution include any bleaching agents but in particular, organic complex salts of iron(III) (e.g., aminopolycarboxylic acids such as ethylenediaminetetraacetic acid, diethylenetriaminepentaacetic acid, etc., aminopolyphosphonic acid, phosphonocarboxylic acid, and organic phosphonic acids); organic acids such as citric acid, tartaric acid, malic acid, etc.; persulfates; hydrogenperoxide, etc., are preferably used.

Of these bleaching agents, organic complex salts of iron(III) are particularly preferred from the viewpoints of rapid processing and the prevention of environmental pollution. Specific examples of aminopolycarboxylic acids, aminopolyphosphonic acids, organic phosphonic acids, and the salts thereof for forming the organic complex salts of iron(III) are ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraaacetic acid, methyliminodiacetic acid, iminodiacetic acid, and glycol ether diaminetetraaacetic acid. These compounds may be in the form of the sodium salts, potassium salts, lithium salts, or ammonium salts thereof. Of these compounds, the iron(III) complex salts of ethylenediaminetetraacetic acid, diethylenetriaminepentaacetic acid, cyclohexanediaminetetraacetic acid, 1,3-diaminopropanetetraacetic acid, and methyliminodiacetic acid are preferred due to their high bleaching power.

These ferric ion complex salts may be used as the form of the complex salt or the complex may be formed in a processing solution using a ferric salt such as ferric sulfate, ferric chloride, ferric nitrate, ammonium ferric sulfate, ferric phosphate, etc., and a chelating agent such as aminopolycarboxylic acid, aminopolyphosphonic acid, phosphonocarboxylic acid, etc. In this case, the chelating agent may be used in an excess amount to the amount necessary to form the ferric ion complex salt.

Of the iron complex salts, an aminopolycarboxylic acid iron complex is preferred and the amount thereof used is from 0.01 to 1.0 mol/liter, and preferably from 0.05 to 0.50 mol/liter.

Various compounds can be used as a bleach accelerator for the bleach solution, blix solution and/or the prebath therefor. For example, compounds having a mercapto group or a disulfide bond described in U.S. Pat. No. 3,893,858, German Patent 1,290,812, JP-A-52-95630, and Research Disclosure, No. 17129 (Jul., 1978), the thiourea series compounds described in JP-B-45-8506, JP-A-52-20832, JP-A-53-32735, and U.S. Pat. No. 3,706,561, and halides such as iodide, bromide, etc., can be used. They are preferred in the standpoint of excellent bleaching power.

Furthermore, the bleach solution or the blix solution for use in this invention can further contain a rehalogenating agent such as bromides (e.g., potassium bromide, sodium bromide, and ammonium bromide), chlorides (e.g., potassium chloride, sodium chloride, and ammonium chloride), and iodides (e.g., ammonium iodide).

If desired, the bleach solution or the blix solution for use in this invention can further contain a corrosion inhibitor such as one or more inorganic, organic acids, or the alkali metal salts or ammonium salts thereof having a pH buffer capacity such as borax, sodium metaborate, acetic acid, sodium acetate, sodium carbonate, potassium carbonate, phosphorous acid, phosphoric acid, sodium phosphate, citric acid, sodium citrate, tartaric acid, etc., and ammonium nitrate, guanidine, etc.

Fixing agents which can be used for the blix solution or the fix solution, can be thiosulfates such as sodium thiosulfate, ammonium thiosulfate, etc.; thiocyanates such as sodium thiocyanate, ammonium thiocyanate, etc., thioether compounds such as ethylenebisthioglycolic acid, 3,6-dithia-1,8-octandiol, etc., and water-soluble silver halide solvents such as thioureas. They can be used alone or as a mixture thereof. Also a specific blix solution containing a combination of a large amount of a halide such as potassium iodide and a fixing agent as described in JP-A-55-155354 can be used in this invention.

In this invention, the use of a thiosulfate, in particular, ammonium thiosulfate, is preferred. The amount of the fixing agent is preferably from 0.3 to 2 mols, and more preferably from 0.5 to 1.0 mol per liter of the processing solution. Also, the pH of the blix solution or the fix solution is preferably from 3 to 10, and more preferably from 5 to 9.

Further, the blix solution can contain an optical whitening agent, a defoaming agent or a surface active agent, and an organic solvent such as polyvinylpyrrolidone, methanol, etc.

It is preferred for the blix solution or the fix solution to contain a sulfite ion-releasing compound such as sulfites (e.g., sodium sulfite, potassium sulfite, and ammonium sulfite), hydrogensulfites (e.g., ammonium hydrogensulfite, sodium hydrogensulfite, and potassium hydrogensulfite), or metahydrogensulfites (e.g., potassium methahydrogensulfite, sodium metahydrogensulfite, and ammonium hydrogensulfte) as a preservative.

The amount of the sulfite compound is preferably from about 0.02 to 0.05 mol/liter, and more preferably from 0.04 to 0.40 mol/liter as sulfite ion.

A sulfite is generally employed as a preservative but ascorbic acid, a carbonyl-hydrogensulfite addition product, or a carbonyl compound may be employed.

Furthermore, the blix solution or the fix solution, if desired, may contain an optical whitening agent, a chelating agent, a defoaming agent, a fungicidal agent, etc.

After the desilvering process by fix or blix, the photographic material is generally washed and/or stabilized.

The amount of wash water vary over a wide range depending on the characteristics (e.g., by the materials used such as couplers, etc.) and uses of the color photographic light-sensitive material, the temperature of wash water, the number (stage number) of wash tanks, the system of counter-current or normal currentflow, and other conditions. The relationship of the number of washing tanks and the amount of water in a multistage counter-current system can be obtained by the method described in *Journal of the Society of Motion Picture and Television Engineers,* Vol. 64, 248–253(1955, May). The number of stages in a multistage counter current system is preferably from 2 to 6, and more preferably from 2 to 4.

Using the multistage counter current system, the amount of wash water can be greatly decreased and, for example, the amount can be less than 0.5 liter per square meter of the photographic light-sensitive material and the effect of this invention is remarkable. However, with an increase of the residence time of water in the tanks, a problem occurs in that bacteria grow and the float formed attach to the light-sensitive material. To solve this problem, a method of decreasing the contents of calcium and magnesium described in JP-A-62-288838 can be very effectively used. Also, isothiazolone compounds and thiabendazoles described in JP-A-57-8542, chlorinated antibacterial agents such as chlorinated sodium isocyanurate, etc., described in JP-A-61-120145, benzotriazole, copper ions, etc., described in JP-A-61-267761, and germicides described in Hiroshi Horiguchi, *Bookin Boobai no Kagaku (Antiacterial and Antifungal Chemistry),* published by Sankyol Shuppan, 1986, *Biseibutsu no Mekkin, Sakkin, Boobai Gijutsu (Sterilizing and Antifungal Techniques of Microorganisms),* edited by Eisei Gijutsu Kai, published by Kogyoo Gijutsu Kai, 1082, and *Bookin Boobaizai Jiten (Antibacterial and Antifungal Agents Handbook),* edited by Nippon Bookin Boobai Gakkai, 1986 can be used.

Furthermore, the wash water may contain a surface active agent as a wetting agent and a chelating agent such as ethylenediaminetetraacetic acid as a water softener.

After this wash step or without the wash step, the photographic light-sensitive material can be processed with a stabilization solution. The stabilization solution contains a compound having an image stabilizing function and examples of such a compound are aldehyde compounds such as formaldehyde, buffers for adjusting the pH of the layers suitable for dye stabilization, and ammonium compounds. Also, the above-described antibacterial agents and antifungal agents can be used in the stabilization solution to prevent the growth of bacteria in the processing solution and providing an antifungal property to the photographic light-sensitive material after processing.

Furthermore, the stabilization solution may contain a surface active agent, an optical whitening agent, and a hardening agent.

When stabilization is directly employed without employing a wash step in the processing of the color photographic light-sensitive material of this invention, the methods described in JP-A-57-8543, JP-A-58-14834, and JP-A-60-220345 can be used.

Furthermore, a chelating agent such as 1-hydroxyethylidene-1,1-diphosphonic acid, ethylenediaminetetramethylenephosphonic acid, etc., a magnesium compound, or a bismuth compound can be advantageously used for the stabilization solution.

As wash solution or a stabilization solution which is used after desilvering processing, a rinse solution can be similarly used.

The pH of the wash solution or the stabilization solution is preferably from 4 to 10, and more preferably from 5 to 8. The temperature can be selected depending on the use, characteristics, etc., of the color photographic light-sensitive material but is generally from 15° to 45° C., and preferably from 20° to 40° C. The processing time can be optionally set but is preferably as short as possible. The time is preferably from 15 sec. to 1 minute and 45 seconds, and more preferably from 30 seconds to 90 seconds. The replenishing amount is preferably small from the standpoints of reduction in running cost, reduction of the amount of waste solution, and handling properties.

A preferred replenishing amount is from 0.5 to 50 times, and preferably from 3 to 40 times the amount carried over from a prior bath per unit area of the light-sensitive material. Also, a replenishing amount of less than 1 liter, and preferably less than 500 ml per square meter of the light-sensitive material. Also the replenishment may be conducted continuously or intermittently.

The solution used for the wash step and/or the stabilization step can also be used for the pre-step. As an example, the overflow wash water, the amount of which is reduced by a multilayer counter-current system, is introduced into a blix bath which is a prebath and a concentrated solution is used to replenish the blix bath, therby the amount of the waste solution can be reduced.

The following examples are intended to illustrate the present invention but not to limit it in any way.

EXAMPLE 1

Preparation of Supports

By forming a waterproof titanium oxide-containing resin layer having the composition shown below on the surface of a white base paper, 100% LBKP (hardwood bleached sulfate pulp) (basis weight 175 g/m$^2$, thickness about 180 μm), Support A, and I to VI was prepared.

Support A

To 90 parts by weight of a polyethylene composition (density 0.920 g/cc., melt index (MI) 5.0 g/10 minutes) was added 10 parts by weight of a white titanium oxide pigment surface treated with silicon oxide and aluminum oxide and after kneading the mixture, the resultant mixture was coated on the base paper by melt-extrusion coating to form a waterproof resin layer having a thickness of 30 μm. On the other hand, another polyethylene composition (density 0.950 g/cc, MI 8.0 g/10 minutes) only was coated on the back surface of the white base paper to form a waterproof resin layer having a thickness of 20 μm.

Support I

To 86 parts by weight of the polyethylene composition as used for Support A was added 14 parts by weight of anastase-type titanium oxide white pigment surface treated as described below and after kneading the mixture, the mixture was coated on the base paper by melt-extrusion coating to form a waterproof resin layer having a thickness of 30 μm.

The titanium oxide powder used for Support A was immersed in an ethanol solution of 2,4-dihydroxy-2-methylpentane followed by heating to evaporate off the ethanol, whereby the surface-treated titanium oxide white pigment was obtained. The methanol solution was coated on the surface of the titanium oxide particles in an amount of about 1% by weight based on a weight of a corresponding particle based on each titanium oxide particle.

Then, the polyethylene composition as the back layer of the support A was coated on the back surface of the white base paper to form a waterproof resin layer.

By following the same procedure as above, using each composition shown in Table 1 below, Supports II, III, IV, and V were prepared.

TABLE 1

| Support No. | Concentration of Titanium Oxide | Layer Thickness (μm) |
|---|---|---|
| II | 13 parts by weight | 30 |
| III | 10 parts by weight | 30 |
| IV | 15 parts by weight | 30 |
| V | 20 parts by weight | 30 |

Support VI

A composition composed of 50 parts by weight of the hexaacrylate ester of the addition product corresponding to 12 mols of dipentaerythritolpropylene oxide and 50 parts by weight of rutile type titanium oxide was mixed and dispersed for longer than 20 hours by a ball mill and coated on a base paper shown below in a dry thickness of 10 μm and dried. The base paper used was obtained by forming a layer of a polyethylene composition having a thickness of 20 μm on a white base paper as used for Support A and forming a layer of a polyethylene composition (density 0.960 g/cc, MI 25 g/10 minutes) on the back surface thereof.

The coated layer was irradiated with electron rays corresponding to 5 megarad as the absorbed dose at an accelerating voltage of 200 Kv in a nitrogen gas atmosphere to provide Support VI.

The dispersibility of the white pigment particles in the surface portion of the waterproof resin layer of each support in this invention was determined as follows.

Resin of about 0.05 μm in thickness was etched from the surface using an ion sputtering method, the white pigment particles thus exposed were observed with an electron microscope, the projected area ratio Ri of each particle was determined on 6 continuous unit areas each of 6 μm×6 μm, and the standard deviation $$s = \sqrt{\frac{\sum_{i=1}^{6} (R_i - R)^2}{n-1}} \quad \left(\text{wherein } R = \frac{\sum_{i=1}^{6} R_i}{n-1}\right)$$

and the mean particle occupied area ratio (%) R were obtained. The results obtained are shown in Table 1-a.

TABLE 1-a

| Support Sample | Variation Coefficient ($s/\overline{R}$) of Particle Occupied Area Ratio |
|---|---|
| A | 0.25 |
| I | 0.08 |
| II | 0.07 |
| III | 0.08 |
| IV | 0.07 |
| V | 0.08 |
| VI | 0.04 |

From the above results, it can be seen that Supports I to VI have excellent white pigment dispersibility as compared to Support A.

Support VII

On a polyethylene terephthalate film of 26 μm in thickness containing 2% silica having a mean particle size of 3 μm was coated a solution of an anchor coating agent of a composition composed of 80% by weight a vinylidene chloride copolymer (vinylidene chloride/vinyl chloride/vinyl acetate/maleic anhydride 16/70/10/4) and 20% by weight a trimethylolpropane addition product of tolylene diisocyanate dissolved in ethyl acetate at a dry thickness of 0.1 μm and dried for 2 minutes at 100° C. in an oven. On the anchor coat layer of the base material was formed an aluminum thin layer having a thickness of 800 Å by vacuum vapor deposition at $10^{-5}$ torr. The concave and convex cycle at the surface was from about 40 to 100/mm with a roughness of at least 0.1 μm. The mean roughness of the surface measured using a three-dimensional roughness measuring device was about 0.6 μm.

On the surface of the vapor-deposited thin layer was coated a solution of a composition composed of 95 parts of a vinylidene chloride/vinyl chloride/vinyl acetate/maleic anhydride copolymer (10/70/17/3 by weight ratio) and 5 parts of an addition product of hexamethylene diisocyanate and trimethylolpropane dissolved in ethyl acetate at a dry thickness of 0.2 g/m$^2$ and dried for 2 minutes at 100° C. in an oven to form an adhesive layer.

Then, a wood pulp composed of 20 parts of LBSP and 80 parts of LBKP was beaten with a disc refiner to a Canadian freeness of 300 cc and after adding thereto 1.0 part of sodium stearate, 0.5 parts of anionic polyacrylamide, 1.5 parts of aluminum sulfate, 0.5 parts of polyamidopolyamine epichlorohydrin, and 0.5 parts of an alkylketene dimer at an absolute dry weight ratio to the wood pulp, a paper of a base weight of 160 g/m$^2$ was produced with a Fourtdrinier paper machine.

The density was adjusted to 1.0 g/cm$^3$ by means of a machine calender. After applying a corona discharging treatment to the base paper, a low density polyethylene (MI 7 g/10 minutes, density 0.923 g/cc) was coated thereon at a thickness of 30 μm by extrusion coating to form a polyethylene resin layer. Then, after applying a corona discharging treatment to the other surface (back surface) of the base material, high density polyethylene (MI 8 g/10 minutes, density 0.950 g/cc) was coated thereon by extrusion coating. Thus, a polyethylene-laminated paper coated on both surfaces was prepared.

Then, on the back surface (the surface opposite the vapor-deposited surface) of the above-described aluminum vapor-deposited film a polyurethane series two part type adhesive having the composition shown below was coated in a dry thickness of 3 g/m$^2$ and dried for 2 minutes at 100° C.

| Adhesive | |
|---|---|
| POLY BOND AY-651 A (trade name, made Sanyo Chemical Industries, Ltd.) | 100 parts |
| POLY BOND AY-651 C (trade name, made Sanyo Chemical Industries, Ltd.) | 15 parts |

The coated surface of the film was contacted with the low density polyethylene surface of the above-described surface coated polyethylene-laminated paper and they were heated pressed at 80° C. at a pressure of 10 kg/cm.

Then, a gelatin subbing layer of about 0.1 μm in thickness was formed on the adhesive layer and an antistatic layer composed of colloidal alumina and polyvinylidene chloride was formed on the polyethylene laminate on the back layer.

EXAMPLE 2

After applying a corona discharging treatment onto the reflective support prepared as described in Example 1, a gelatin subbing layer was formed. On the subbing layer were coated the layers shown below to provide a multilayer color photographic paper. The coating compositions were prepared as follows.

Preparation of Coating Composition for Layer 1

In 27.2 ml of ethyl acetate and 8.2 g of a solvent (Solv-1) were added 19.1 g of a yellow coupler (ExY), 4.4 g of a color image stabilizer (Cpd-1), and 0.7 g of a color image stabilizer (Cpd-7), and the solution was dispersed by emulsification in 185 ml of an aqueous 10% gelatin solution containing 8 ml of an aqueous 10% sodium dodecylbenzenesulfonate. On the other hand, after adding a blue-sensitive sensitizing dye described below to a silver chlorobromide emulsion, sulfur sensitization was applied thereto to provide a silver chlorobromide emulsion [cubic, a 3:7 mixture (silver mol ratio) of silver halide grains having a mean grain size of 0.88 μm and silver halide grains having a mean grain size of 0.70 μm, the coefficient of variation of the grain size distribution of both the silver halide grains were 0.08 and 0.10, each silver halide grains locally have 0.3% silver bromide on the surface of the grains). The above-described emulsified dispersion was mixed with the silver chlorobromide emulsion to provide a coating composition for Layer 1.

The coating compositions for Layer 2 to Layer 7 were also prepared by similar methods to the preparation of the composition for Layer 1.

1-oxy-3,5-dichloro-s-triazine sodium salt was used as a gelatin hardening agent. Also, to the silver halide emulsion for each emulsion layer was added hexachloroiridium (IV) potassium during the formation of the emulsion. The amount added thereof was the same regardless of the grains sizes of the silver halide grains of the emulsions, and was $1\times10^{-7}$ mol for the blue-sensitive emulsion layer, $3\times10^{-7}$ mol for the green-sensitive emulsion layer, and $5\times10^{-7}$ mol for the red-sensitive emulsion layer.

As the spectral sensitizing dye(s) for each emulsion layer, the dyes shown below were used as the CR compounds in forming the local phases.

For the Blue-sensitive Emulsion Layer

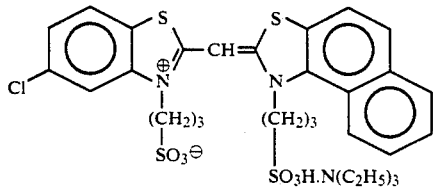

-continued

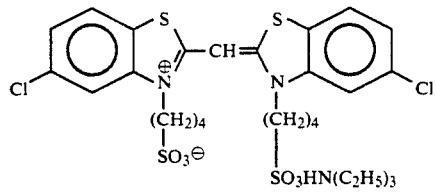

($2.0\times10^{-4}$ mol for the large grain size emulsion and $2.5\times10^{-4}$ mol for the small grain size emulsion per mol of silver halide).

For the Green-sensitive Emulsion Layer

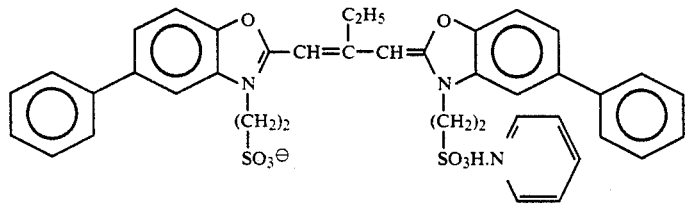

($4.0\times10^{-4}$ mol for the large grain size emulsion and $5.6\times10^{-4}$ mol for the small grain size emulsion per mol of silver halide), and

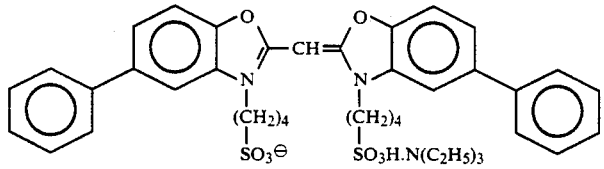

($7.0\times10^{-5}$ mol for the large grain size emulsion and $1.0\times10^{-5}$ mol for the small grain size emulsion per mol of silver halide).

For the Red-sensitive Emulsion Layer

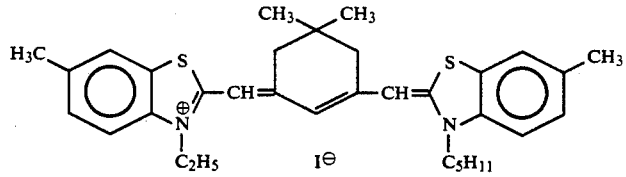

($0.9\times10^{-4}$ mol for the large grain size emulsion and $1.1\times10^{-4}$ mol for the small grain size emulsion per mol of silver halide).

Also, to the red-sensitive emulsion, the following compound was added at $2.6\times10^{-3}$ mol per mol of silver chloride.

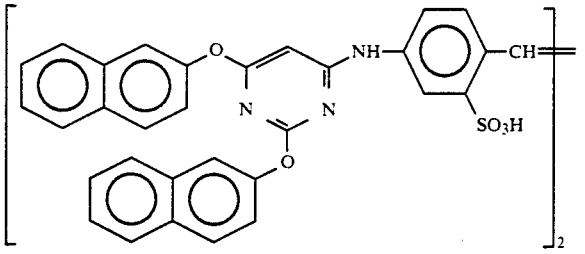

Also, to the blue-sensitive emulsion layer, the green-sensitive emulsion layer, and the red-sensitive emulsion layer 1-(5-methylureidophenyl)-5-mercaptotetrazole at $8.5\times10^{-5}$ mol, $7.7\times10^{-4}$ mol, and $2.5\times10^{-4}$ mol, respectively per mol of silver halide was added.

Also, to the blue-sensitive emulsion layer and the green sensitive emulsion layer 4-hydroxy-6-methyl-1,3,3a,7-tetraazaindene at $1\times10^{-4}$ mol and $2\times10^{-4}$ mol, respectively per mol of silver was added.

Furthermore, to each emulsion layer were added the following dyes for irradiation prevention.

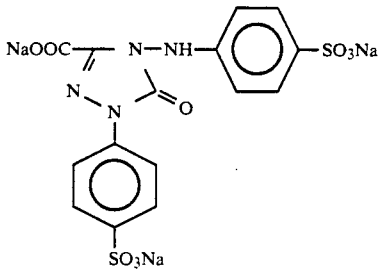

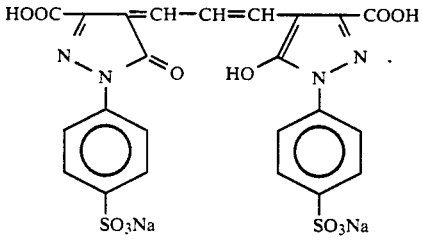

and

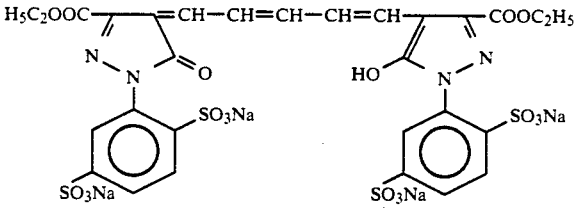

and

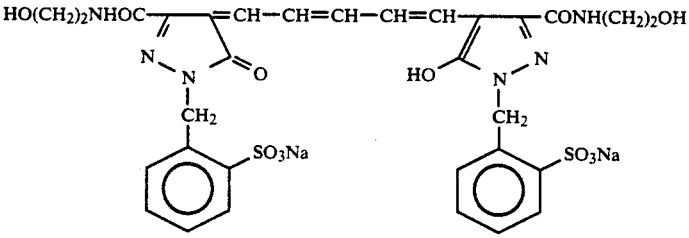

Ratio of 5:2 by weight ratio.

Also, the following compounds were used as antiseptics. (As coating amount).

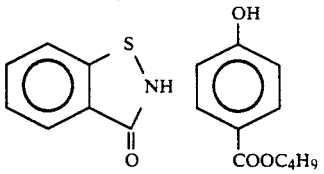

(25.0 mg/m²) (50.0 mg/m²)

Layer Structure

Then, the composition of each layer was as shown below, wherein the amounts given are coating amounts (g/m²) and the coating amount of a silver halide emulsion is shown as the silver coated amount.

| | |
|---|---|
| First Layer: Blue-Sensitive Emulsion Layer | |
| Aforesaid silver chlorobromide emulsion layer | 0.30 |
| Gelatin | 1.86 |
| Yellow coupler (ExY) | 0.82 |
| Color image stabilizer (Cpd-1) | 0.19 |
| Solvent (Solv-1) | 0.35 |
| Color image stabilizer (Cpd-7) | 0.06 |
| Second Layer: Color Mixing Inhibition Layer | |
| Gelatin | 0.99 |
| Color mixing inhibitor (Cpd-5) | 0.08 |
| Solvent (Solv-1) | 0.16 |
| Solvent (Solv-4) | 0.08 |
| Third Layer: Green-sensitive Emulsion Layer | |
| Silver chlorobromide emulsion (cube) 1:3 mixture (Ag mol ratio) of grains having mean grain size of 0.55 μm and that of 0.39 μm, variation coefficient of grain size distribution 0.10 and 0.08, each emulsion locally has 0.8 mol % AgBr on the surface of the grains) | 0.12 |
| Gelatin | 1.24 |
| Magenta coupler (ExM) | 0.20 |
| Color image stabilizer (Cpd-2) | 0.03 |
| Color image stabilizer (Cpd-3) | 0.15 |
| Color image stabilizer (Cpd-4) | 0.02 |
| Color image stabilizer (Cpd-9) | 0.02 |
| Solvent (Solv-2) | 0.40 |
| Fourth Layer: Ultraviolet Absorption Layer | |
| Gelatin | 1.58 |
| Ultraviolet absorbent (UV-1) | 0.47 |
| Color mixing inhibitor (Cpd-5) | 0.05 |
| Solvent (Solv-5) | 0.24 |
| Fifth Layer: Red-sensitive Emulsion Layer | |
| Silver chlorobromide emulsion (cube) 1:4 mixture (Ag mol ratio) of grains having mean grain size of 0.60 μm and that of 0.45 μm, variation coefficient of grain size distribution 0.09 and 0.11, each emulsion locally has 0.6 mol % AgBr on a part of the surface of the grains) | 0.23 |
| Gelatin | 1.34 |
| Cyan coupler (ExC) | 0.32 |
| Cyan coupler (ExC) | 0.32 |
| Color image stabilizer (Cpd-6) | 0.17 |
| Color image stabilizer (Cpd-7) | 0.40 |
| Color image stabilizer (Cpd-8) | 0.04 |
| Solvent (Solv-6) | 0.15 |
| Sixth Layer: Ultraviolet Absorption Layer | |
| Gelatin | 0.53 |
| Ultraviolet absorbent (UV-1) | 0.16 |
| Color mixing inhibitor (Cpd-5) | 0.02 |
| Solvent (Solv-5) | 0.08 |
| Seventh Layer: Protective Layer | |
| Gelatin | 1.33 |
| Acryl-modified copolymer of polyvinyl Alcohol (modified degree 17%) | 0.17 |
| Fluid paraffin | 0.03 |

The compounds used above were as follows.

(ExY) Yellow Coupler:

-continued
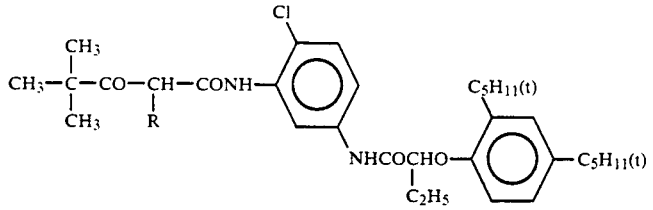
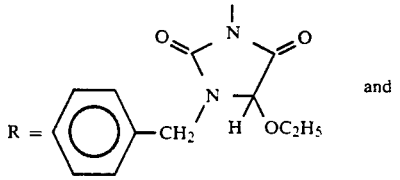
and
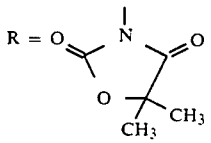
1:1 mixture (mol ratio) of the above couplers.
(ExM) Magenta Coupler:
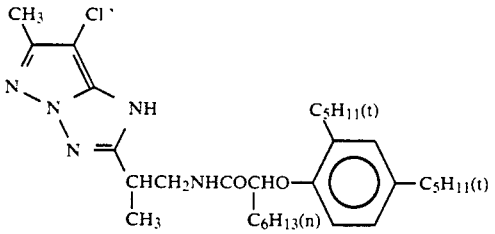
and
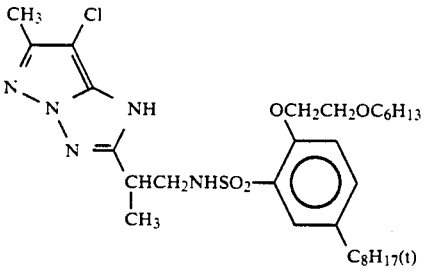
1:1 mixture (mol ratio) of the above couplers.
(ExC) Cyan Coupler:
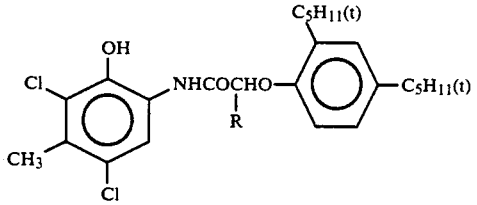
R = $C_2H_5$ and $C_4H_9$
and
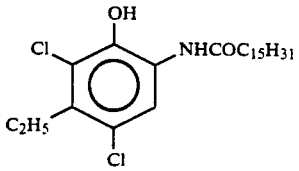
2:4:4 mixture (by weight) of the above couplers.
(Cpd-1) Color Image Stabilizer -continued
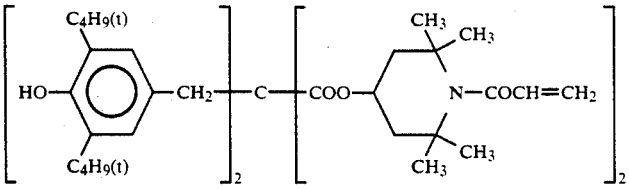
(Cpd-2) Color Image Stabilizer
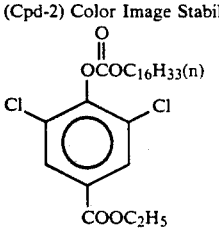
(Cpd-3) Color Image Stabilizer
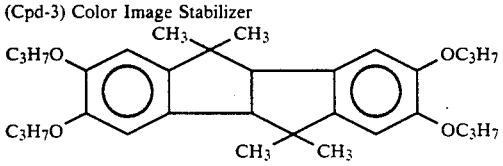
(Cpd-4) Color Image Stabilizer
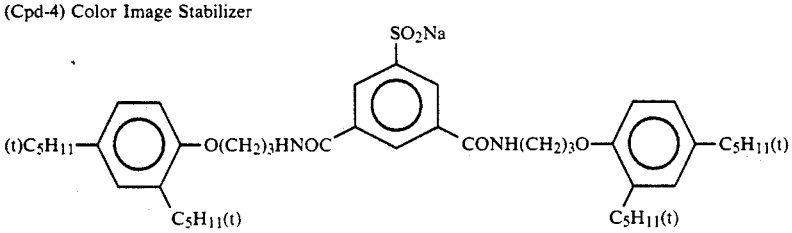
(Cpd-5) Color Mixing Inhibitor
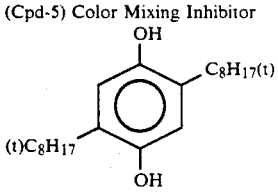
(Cpd-6) Color Image Stabilizer
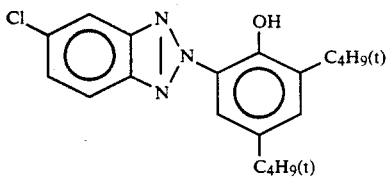
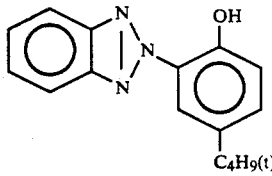
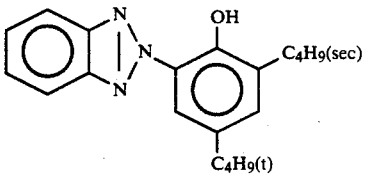
2:2:4 mixture (by weight) of the above stabilizers.
(Cpd-7) Color Image Stabilizer
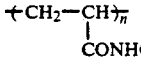
(Average molecular weight 60,000)
(Cpd-8) Color Image Stabilizer -continued
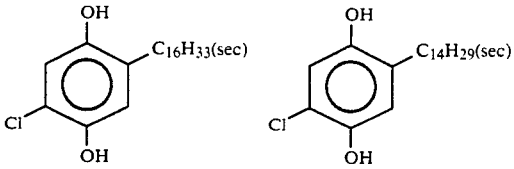
1:1 mixture of the above stabilizers.
(Cpd-9) Color Image Stabilizer
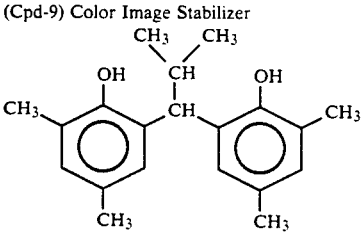
(UV-1) Ultraviolet Absorbent
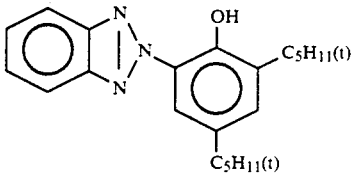
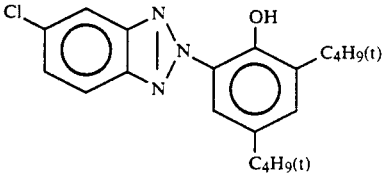
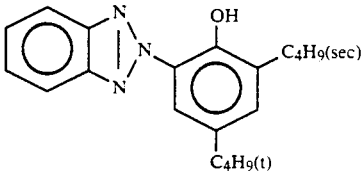
4:2:4 (weight ratio) of the above absorbents.
(Solv-1) Solvent
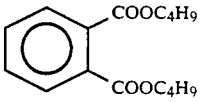
(Solv-2) Solvent
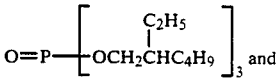
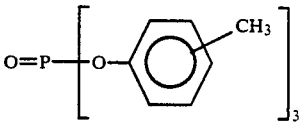
2:1 mixture (volume ratio) of the above solvents.
(Solv-4) Solvent
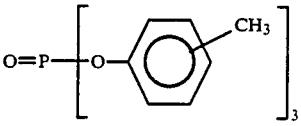
(Solv-5) Solvent
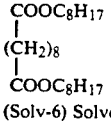
(Solv-6) Solvent -continued

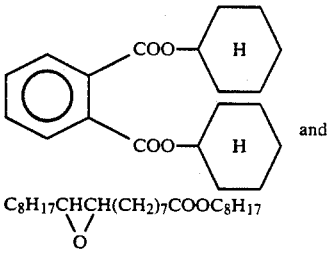

95:5 mixture of the above solvents.

Next, each sample was subjected to a light exposure such that 30% of the coated silver could be developed. After exposure, the sample was continuously processed (running test) according to the following steps until the replenishing amount of the color developer became twice the tank volume of the color developer. Using the running solution thus obtained, sensitometry of each sample was conducted.

Each sample was subjected to a gradation exposure for sensitometry through a color separation filter using an actinometer (Type FWH, made by Fuji Photo Film Co., Ltd., color temperature of the light source: 3200° K.) The exposure was conducted for an exposure time of 1/10 second at an exposure amount of 200 CMS.

| Processing Step | Temp. | Time | Replenisher* | Tank Volume |
|---|---|---|---|---|
| Color Development | 35° C. | 45 sec. | 161 ml | 17 l |
| Blix | 30–35° C. | 45 sec. | 215 ml | 17 l |
| Rinse (1) | 30–35° C. | 20 sec. | — | 10 l |
| Rinse (2) | 30–35° C. | 20 sec. | — | 10 l |
| Rinse (3) | 30–35° C. | 20 sec. | 350 ml | 10 l |
| Drying | 70–80° C. | 60 sec. | | |

*The replenishing amount was per square meter of the light-sensitive material.

A three tank countercurrent system of from rinse (3) to rinse (1) was used in the above-described rinse system.

The compositions of the processing solutions used were as follows.

| | Tank Liquid | Replenisher |
|---|---|---|
| Color Developer | | |
| Water | 800 ml | 800 ml |
| Ethylenediamine-N,N,N,N-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-bis(Carboxymethyl)hydrazine | 5.5 g | 7.0 g |
| Optical whitening agent (Whitex 4B, made by Sumitomo Chemical Company, Limited) | 1.0 g | 2.0 g |
| Water to make | 1 l | 1 l |
| pH (25° C.) | 10.05 | 10.45 |
| Blix Solution (Tank composition was same as that of the replenisher) | | |
| Water | | 400 ml |
| Ammonium Thiosulfate (70% aqueous solution) | | 100 ml |
| Sodium sulfite | | 17 g |
| Ammonium iron(III) ethylenediaminetetraacetate | | 55 g |

-continued

| | Tank Liquid | Replenisher |
|---|---|---|
| Di-sodium ethylenediaminetetraacetate | | 5 g |
| Ammonium bromide | | 40 g |
| Water to make | | 1 l |
| pH (25° C.) | | 6.0 |

Rinse Solution (The rinse composition was the same as that of the replenisher)

Ion exchanged water (the content of each of calcium and magnesium was less than 3 ppm).

By following the same procedure as described above while changing the support and the coating amounts of the dyes, Samples 1 to 26 each appropriately sulfur sensitized, silver halide grains for the red-sensitive emulsion layer having the same grain size, without any silver bromide-rich phase, and containing no iridium compound, as shown in Table 2-1 were prepared.

TABLE 2-1

| Sample No. | Support | Silver Bromide-Rich Phase | Iridium Compound | Reflection Density at 680 nm |
|---|---|---|---|---|
| 1 | I | existed | Used | 1.01 |
| 2 | II | " | " | 1.01 |
| 3 | III | " | " | 1.03 |
| 4 | IV | " | " | 1.01 |
| 5 | V | " | " | 1.01 |
| 6 | VI | " | " | 1.01 |
| 7 | VII | " | " | 1.04 |
| 8 | IV | none | none | 1.01 |
| 9 | IV | " | " | 0.73 |
| 10 | IV | " | " | 0.52 |
| 11 | IV | " | " | 0.31 |
| 12 | IV | existed | " | 1.00 |
| 13 | IV | " | " | 0.72 |
| 14 | IV | " | " | 0.52 |
| 15 | IV | " | " | 0.32 |
| 16 | IV | " | used | 0.72 |
| 17 | IV | " | " | 0.53 |
| 18 | IV | " | " | 0.31 |
| 19 | IV | " | " | 1.20 |
| 20 | IV | " | " | 1.71 |
| 21 | V | " | " | 0.71 |
| 22 | V | " | " | 0.52 |
| 23 | II | " | " | 1.22 |
| 24 | II | " | " | 0.73 |
| 25 | II | " | " | 1.70 |
| 26 | A | " | " | 1.00 |

Each of the samples was light-expressed such that 30% of the coated silver could be developed. Thereafter, each sample was continuously developed (running test) using the following processing steps using a color paper processor until the replenishing amount became twice the tank volume of the color developer. Using the running solution thus obtained, sensitometry of each sample was conducted.

Each sample was subjected to a gradation exposure for sensitometry through a color separation filter using an actinometer (Type FWH, made by Fuji Photo Film Co., Ltd., color temperature of the light source: 3200° K.). In this case, the exposure was for an exposure time of 1/10 second at an exposure amount of 200 CMS.

| Processing Step | Temp. | Time | Replenisher* | Tank Volume |
|---|---|---|---|---|
| Color Development | 35° C. | 45 sec. | 161 ml | 17 l |
| Blix | 30–35° C. | 45 sec. | 215 ml | 17 l |
| Rinse (1) | 30–35° C. | 20 sec. | — | 10 l |
| Rinse (2) | 30–35° C. | 20 sec. | — | 10 l |
| Rinse (3) | 30–35° C. | 20 sec. | 350 ml | 10 l |
| Drying | 70–80° C. | 60 sec. | | |

*The replenishing amount was per square meter of the light-sensitive material.

(The rinse system, a three tank countercurrent system from rinse (3) to rinse (1)).

The compositions of the processing solutions used were as follows.

| | Tank Liquid | Replenisher |
|---|---|---|
| Color Developer | | |
| Water | 800 ml | 800 ml |
| Ethylenediamine-N,N,N,N-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamido-ethyl)-3-methyl-4-aminoaniline sulfate | 5.0 g | 7.0 g |
| N,N-bis(Carboxymethyl)hydrazine | 5.5 g | 7.0 g |
| Optical whitening agent (Whitex 4B, made by Sumitomo Chemical Company, Limited) | 1.0 g | 1.0 g |
| Water to make | 1 l | 1 l |
| pH (25° C.) | 10.05 | 10.45 |
| Blix Solution (The tank liquid composition was same as that of the replenisher) | | |
| Water | | 400 ml |
| Ammonium Thiosulfate (70% aqueous solution) | | 100 ml |
| Sodium sulfite | | 17 g |
| Ammonium iron(III) ethylenediaminetetraacetate | | 55 g |
| Di-sodium ethylenediaminetetraacetate | | 5 g |
| Ammonium bromide | | 40 g |
| Water to make | | 1 l |
| pH (25° C.) | | 6.0 |

Rinse Solution (The tank liquid composition was same as that of the replenisher)

Ion exchanged water (the content of calcium and magnesium each was less than 3 ppm).

The color density of each sample after processing was measured and the sensitivity and gradation were determined. The sensitivity is defined as the reciprocal of the exposure amount providing a color density of 0.5 higher than fog density and is shown by the relative value when the sensitivity of Sample 1 was defined as 100. Also, the gradation is shown as the difference between the logarithm of the exposure amount providing a color density of 0.5 and the logarithm of the exposure amount providing a color density of 2.0.

For determining the sharpness of the images formed, each fresh sample was exposed through a rectangular chart for sharpness measurement using a color enlarger and after processing the sample in the same manner as above, the CTR value (the relative value of the density difference of a fine line when the density difference in 0.2 line/mm is defined to be 1) at 5 line/mm was determined.

These results obtained are shown in Table 2-2 below.

TABLE 2-2

| Sample No. | Test Results (Red-Sensitive Layer) Sensitivity | Gradation | CTF Value |
|---|---|---|---|
| 1 | 100 | 0.48 | 0.66 |
| 2 | 100 | 0.48 | 0.64 |
| 3 | 102 | 0.47 | 0.62 |
| 4 | 101 | 0.48 | 0.67 |
| 5 | 100 | 0.47 | 0.69 |
| 6 | 102 | 0.48 | 0.71 |
| 7 | 96 | 0.48 | 0.74 |
| 8 | 47 | 0.52 | 0.67 |
| 9 | 62 | 0.50 | 0.63 |
| 10 | 76 | 0.47 | 0.61 |
| 11 | 88 | 0.46 | 0.57 |
| 12 | 98 | 0.60 | 0.67 |
| 13 | 129 | 0.55 | 0.63 |
| 14 | 164 | 0.53 | 0.61 |
| 15 | 190 | 0.48 | 0.56 |
| 16 | 130 | 0.45 | 0.64 |
| 17 | 155 | 0.43 | 0.62 |
| 18 | 186 | 0.42 | 0.57 |
| 19 | 79 | 0.48 | 0.69 |
| 20 | 53 | 0.52 | 0.70 |
| 21 | 129 | 0.45 | 0.67 |
| 22 | 154 | 0.43 | 0.65 |
| 23 | 78 | 0.48 | 0.65 |
| 24 | 126 | 0.45 | 0.63 |
| 25 | 54 | 0.52 | 0.66 |
| 26 | 100 | 0.48 | 0.60 |

From the above results, it can be seen that in the samples of this invention, by the use of dye in combination with the support in this invention, the CTR value is greatly improved, the softening of gradation is less, and the sensitivity is high, which are preferred. Even if the CTR value is same, if the gradation is softened, the contrast of the images is reduced and the sharpness is visually inferior. In using silver halide emulsions other than those in this invention, softening of gradation undesirably occurs due to an increase in the amount of dyes.

EXAMPLE 3

After performing continuous processing (running test) using the following processing steps and processing solution using a color paper processor as in Example 2 until the replenished amount became twice the tank volume of the color developer, each sample was also processed as in Example 2 and substantially the same results were obtained.

| Processing Step | Temp. | Time | Replenisher* | Tank Volume |
|---|---|---|---|---|
| Color Development | 35° C. | 45 sec. | 161 ml | 17 l |
| Blix | 30–35° C. | 45 sec. | 215 ml | 17 l |
| Stabilization (1) | 30–37° C. | 20 sec. | — | 10 l |
| Stabilization (2) | 30–37° C. | 20 sec. | — | 10 l |
| Stabilization (3) | 30–37° C. | 20 sec. | — | 10 l |
| Stabilization (4) | 30–37° C. | 30 sec. | 248 ml | 10 l |
| Drying | 70–85° C. | 60 sec. | | |

*The replenishing amount per square meter of the light-sensitive material.

(Four tank countercurrent system from stabilization (4) to stabilization (1)).

The compositions of the processing solutions used were as follows.

| | Tank Liquid | Replenisher |
|---|---|---|
| Color Developer | | |
| Water | 800 ml | 800 ml |
| Ethylenediaminetetraacetic acid | 2.0 g | 2.0 g |
| 4,6-Dihydroxybenzene-1,2,4-trisulfonic acid | 0.3 g | 0.3 g |
| Triethanolamine | 8.0 g | 8.0 g |
| Sodium chloride | 1.4 g | — |
| Potassium carbonate | 25 g | 25 g |
| N-Ethyl-N-(β-methanesulfonamido-ethyl)-3-methyl-4-aminoaniline sulfate | 5.0 g | 7.0 g |
| Diethylhydroxylamine | 4.2 g | 6.0 g |
| Optical whitening agent (4,4'-diaminostilbene series) | 2.0 g | 2.5 g |
| Water to make | 1 l | 1 l |
| pH (25° C.) | 10.05 | 10.45 |
| Blix Solution (The tank liquid composition was the same as that of the replenisher) | | |
| Water | | 400 ml |
| Ammonium Thiosulfate (70% square solution) | | 100 ml |
| Sodium sulfite | | 17 g |
| Ammonium iron(III) ethylenediaminetetraacetate | | 55 g |
| Di-sodium ethylenediaminetetraacetate | | 5 g |
| Glacial acetic acid | | 9 g |
| Water to make | | 1 l |
| pH (25° C.) | | 5.40 |
| Stabilization Solution (The composition of the tank liquid was the same as that of the replenisher) | | |
| Formaldehyde (37% aqueous solution) | | 0.1 g |
| Formaldehyde-sulfite adduct | | 0.7 g |
| 5-Chloro-2-methyl-4-isothazolin 3-one | | 0.02 g |
| 2-Methyl-4-isothiazolin-3-one | | 0.01 g |
| Copper sulfate | | 0.005 g |
| Water to make | | 1 l |
| pH (25° C.) | | 4.0 |

EXAMPLE 4

By following the same procedure as in preparing Sample 1 in Example 2 by changing the amounts of the dyes used, Samples 27 to 36 each having a different reflection density were prepared. Each sample was exposed to a rectangular chart for sharpness measurement such that the magenta density of the high density portion of 0.2 line/mm became 1.5 and became visually grey and processed according to the processing steps in Example 2 using the processing solutions used for the running test for Sample 5 prepared in Example 2.

The reflection densities of Samples 27 to 36, which were obtained are shown in Table 4-1.

The samples exposed to the rectangular chart and processed thus obtained were observed under a light source for color evaluation to evaluate the sharpness. The results obtained are also shown in Table 4-2.

As the distance between the lines decreases, the grey line images become blurred line images and when the blurred extent differs in each cyan, magenta and yellow layer, the color of the blurred portion changes from grey to another color. If such blurring occurs, it is visually seen that there is a larger degree of blurring.

The above confirms that when the sharpness of the cyan images is kept constant, even when the sharpness of the magenta images is increased by increasing the reflection density of magenta, the sharpness as grey is seen as a deteriorated sharpness. Thus, it has been found that there is a preferred reflection density in unprocessed color photographic light-sensitive materials.

TABLE 4-1

| Sample No. | Reflection Density 470 nm | 550 nm | 680 nm |
|---|---|---|---|
| 27 | 0.25 | 1.20 | 1.00 |
| 28 | 0.25 | 1.02 | 1.00 |
| 29 | 0.25 | 0.81 | 1.02 |
| 30 | 0.25 | 0.59 | 1.01 |
| 31 | 0.25 | 0.50 | 1.01 |
| 32 | 0.17 | 1.22 | 1.00 |
| 33 | 0.17 | 0.50 | 1.01 |
| 34 | 0.31 | 0.50 | 1.00 |
| 35 | 0.39 | 0.49 | 1.02 |
| 36 | 0.40 | 0.80 | 1.00 |

TABLE 4-2

| Sample No. | Color of Blur Portions | Visual Sharpness* |
|---|---|---|
| 27 | Blue-green | X |
| 28 | Green | X |
| 29 | Light green to grey | ○ |
| 30 | " | ◎ |
| 31 | Grey | ◎ |
| 32 | Yellow-green | X |
| 33 | Yellow | X |
| 34 | Light blue to grey | ◎ |
| 35 | " | ◎ |
| 36 | Light cyan to grey | ○ |

*Evaluation:
X Inferior
○ Good
◎ Very good

As described above, according to this invention, color photographs having a high sensitivity, high gradation, an excellent sharpness, and an excellent balance of the sharpnesses of the cyan, magenta, and yellow color images.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material which is subject to color development with a color developer, said material comprising a reflective support comprising a support base material coated with a waterproof resin layer, and at least one silver halide emulsion layer thereon, wherein at least one silver halide emulsion layer thereon comprises silver halide grains containing silver chloride in an amount of from 90 to 99.9 mol %., having a silver bromide-rich region near at least one apex of the silver halide grain, and having a mean bromide content at the surface of the grain of not more than 15 mol %, wherein the waterproof resin layer having the silver halide emulsion layer thereon contains titanium oxide in an amount of from 15 to 60% by weight; and further the optical reflection density of the photographic material at 680 nm is not lower than 0.70.

2. The silver halide color photographic material as in claim 1, wherein the optical reflection density of the silver halide color photographic material at 550 nm is lower than the optical reflection density thereof at 680 nm.

3. The silver halide color photographic material as in claim 1 or 2, wherein the optical reflection density of the silver halide color photographic material at 470 nm is 0.20 or more.

4. The silver halide color photographic material as in claim 1, or 2, wherein the silver bromide-rich region and/or another region of the silver halide grains present in the silver halide color photographic material contains an iridium compound.

5. The silver halide color photographic material as in claim 1, wherein the reflective support has a diffusion reflectivity of second kind.

6. The silver halide color photographic material as in claim 1, wherein the photographic material contains at least one of a CR compound of the formula (Is) to (IIIs)

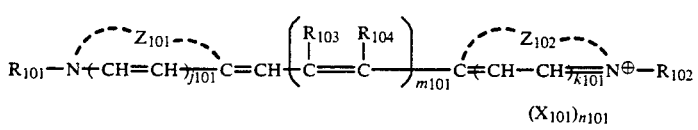

(Is)

Wherein $Z_{101}$ and $Z_{102}$ each represents an atomic group necessary for forming a heterocyclic nucleus; $R_{101}$ and $R_{102}$ each represents an alkyl group, an alkenyl group, an alkynyl group, or an aralkyl group; $m_{101}$ represents a number of from 0 to 3 and when $m_{101}$ is 1, $R_{103}$ represents a hydrogen atom, a lower alkyl group, an aralkyl group, or an aryl group; $R_{104}$ represents a hydrogen atom, when $m_{101}$ is 2 or 3, $R_{103}$ represents a hydrogen atom and $R_{104}$ represents a hydrogen atom, a lower alkyl group having from 1 to 4 carbon atoms or an aralkyl group, and this group may combine with $R_{102}$ to form a 5- or 6-membered ring, and when $m_{101}$ represents 2 or 3 and $R_{104}$ represents a hydrogen atom, $R_{103}$ may combine with another $R_{103}$ to form a hydrocarbon ring or a heterocyclic ring; and $j_{101}$ and $k_{101}$ each represents 0 or 1, $X_{101}$ represents an acid anion; and $n_{101}$ represents 0 or 1;

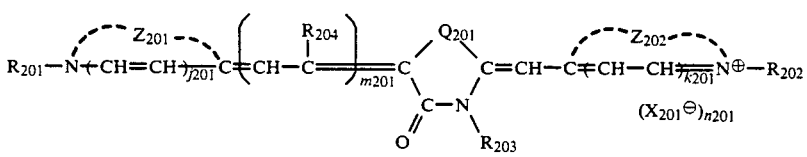

(IIs)

wherein $Z_{201}$ and $Z_{202}$ have the same meaning as $Z_{101}$ and $Z_{102}$; $R_{201}$ and $R_{202}$ have the same meaning as $R_{101}$ and $R_{102}$; $R_{203}$ represents an alkyl group, an alkenyl group, an alkynyl group or an aryl group; $m_{201}$ represents 0, 1, or 2; and $R_{204}$ represents a hydrogen atom, a lower alkyl group, or an aryl group, and when $m_{201}$ represents 2, the $R_{204}$ may combine with the other $R_{204}$ to form a carbocylic ring or a heterocyclic ring, which is preferably a 5- or 6-membered ring; $Q_{201}$ represents a sulfur atom, an oxygen atom, a selenium atom, or

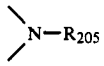

(wherein $R_{205}$ has the same meaning as $R_{203}$) and $j_{201}$, $k_{201}$, $X^{\ominus}_{201}$, and $n_{201}$ have the same meaning as $j_{101}$, $k_{101}$, $X^{\ominus}_{101}$, and $n_{101}$;

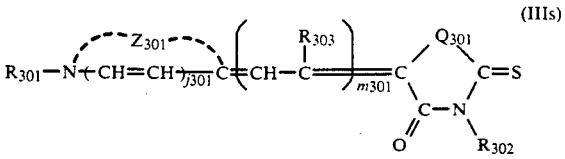

(IIIs)

wherein $Z_{301}$ represents an atomic group necessary for forming a heterocyclic ring; $Q_{301}$ has the same meaning as $Q_{201}$; $R_{301}$ has the same meaning as $R_{101}$ or $R_{102}$; $R_{302}$ has the same meaning as $R_{203}$; $m_{301}$ has the same meaning as $m_{201}$; $R_{303}$ has the same meaning as $R_{204}$, when $m_{301}$ is 2 or 3, $R_{303}$ may combine with another $R_{303}$ to form a carbocyclic ring or a heterocyclic ring; and $j_{301}$ has the same meaning as $j_{101}$.

7. The silver halide color photographic material of claim 1, wherein the photographic material contains at least one of the dyes of the formula (I), (II), (III), (IV), (V), to (VI);

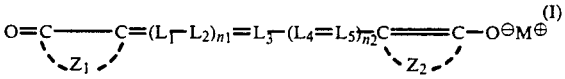

(I)

wherein $Z_1$ and $Z_2$, which may be the same or different, each represents a non-metal atomic group necessary for forming a heterocyclic ring; $L_1$, $L_2$, $L_3$, $L_4$, and $L_5$ each represents a methine group; $n_1$ and $n_2$ each represents 0 or 1; and $M^+$ represents a hydrogen atom or a monovalent cation;

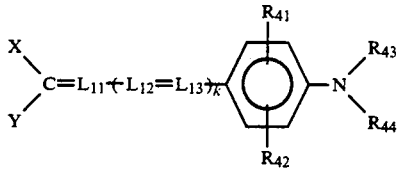

(II)

wherein X and Y, which may be the same of different, each represents an electron attracting group, X and Y may combine with each other to form a ring; $R_{41}$ and $R_{42}$, which may be the same or different, each represents a hydrogen atom, a halogen atom, an alkyl group, an alkoxy group, a hydroxy group, a carboxy group, a substituted amino group, a carbamoyl group, a sulfamoyl group, an alkoxycarbonyl group, or a sulfo group; $R_{43}$ and $R_{44}$, which may be the same or different, each represents a hydrogen atom, an alkyl group, an alkenyl group, an aryl group, an acyl group, or a sulfonyl group, $R_{43}$ and $R_{44}$ may combine with each other to form a 5- or 6-membered ring, and $R_{41}$ and $R_{43}$ or $R_{42}$ and $R_{44}$ each may combine with each other to form a 5- or 6-membered ring; at least one of X, Y, $R_{41}$, $R_{42}$, $R_{43}$, and $R_{44}$ has a sulfo group or a carboxy group as a Substituent; $L_{11}$, $L_{12}$, and $L_{13}$ each represents a methine group; and k represents 0 or 1;

$$Ar_1—N=N—Ar_2 \quad \text{(III)}$$

(wherein $Ar_1$ and $Ar_2$, which may be the same or different, each represents an aryl group or a heterocyclic group;

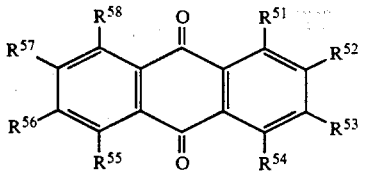
(IV)

wherein $R^{51}$, $R^{54}$, $R^{55}$, and $R^{58}$, which may be the same or different, each represents a hydrogen atom, a hydroxy group, an alkoxy group, an aryloxy group, a carbamoyl group, or an amino group shown by

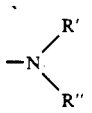

(wherein R' and R'', which may be the same or different, each represents a hydrogen atom, an alkyl group having at least one sulfonic acid group or carboxy group, an aryl group having at least one sulfonic acid group or carboxy group); and $R^{52}$, $R^{53}$, $R^{56}$, and $R^{57}$, which may be the same or the different, each represents a hydrogen atom, a sulfonic acid group, a carboxy group, an alkyl group having at least one sulfonic acid group or carboxy group, or an aryl group having at least one sulfonic acid group or carboxy group;

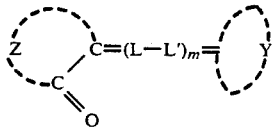
(V)

wherein L and L' each represents a substituted or unsubstituted methine group or a nitrogen atom; m represents an integer of from 0 to 3; Z represents a non-metallic atomic group necessary for forming a pyrazolone nucleus, a hydroxypyridone nucleus, a barbituric acid nucleus, a thiobarbituric acid nucleus, a dimedone nucleus, an indane-1,3-dione nucleus, a rhodanine nucleus, a thiohydantoin nucleus, an oxazolidin-4-one-2-thione nucleus, a homophthalimido nucleus, a pyrimidine-2,4-dione nucleus, or a 1,2,3,4-tetrahydroquinoline-2,4-dione nucleus; and Y represents a non-metallic atomic group necessary for forming an oxazole nucleus, a benzoxazole nucleus, a naphthoxazole nucleus, a thiazole nucleus, a benzothiazole nucleus, a naphthothiazole nucleus, a benzoselenazole nucleus, a pyridine nucleus, a quinoline nucleus, a benzoimidazole nucleus, a naphthimidazole nucleus, an imidazoquinoxaline nucleus, an indolenine nucleus, an isooxazole nucleus, a benzisooxazole nucleus, a naphthisooxazole nucleus, or an acridine nucleus, and Z and Y each may further be substituted;

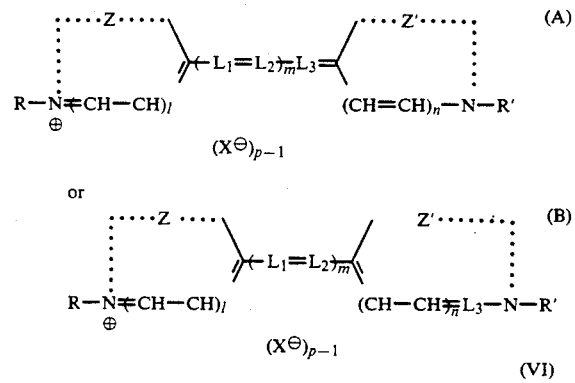
(A)

(B)

(VI)

wherein R and R', which may be the same or different each represents a substituted or unsubstituted alkyl group; $L_1$, $L_2$, and $L_3$, which may be the same or different, each represents a substituted or unsubstituted methine group; m represents an integer of from 0 to 3; Z and Z', which may be the same or different, each represents a non-metallic atomic group necessary for forming a substituted or unsubstituted 5- or 6-membered heterocyclic ring; l and n each represents 0 or 1; $X^-$ represents an anion; and p represents 1 or 2, when the compound of the formula forms an intramolecular salt, p is 1.

* * * * *